US012235035B2

(12) United States Patent
Song

(10) Patent No.: US 12,235,035 B2
(45) Date of Patent: Feb. 25, 2025

(54) REFRIGERATOR AND HOME APPLIANCE

(71) Applicant: LG Electronics Inc., Seoul (KR)

(72) Inventor: Seongmin Song, Seoul (KR)

(73) Assignee: LG Electronics Inc., Seoul (KR)

( * ) Notice: Subject to any disclaimer, the term of this patent is extended or adjusted under 35 U.S.C. 154(b) by 294 days.

(21) Appl. No.: 17/863,722

(22) Filed: Jul. 13, 2022

(65) Prior Publication Data

US 2023/0014764 A1 Jan. 19, 2023

(30) Foreign Application Priority Data

Jul. 13, 2021 (KR) ..... 10-2021-0091829

(51) Int. Cl.
*F25D 23/02* (2006.01)
*F25D 27/00* (2006.01)

(52) U.S. Cl.
CPC ..... *F25D 23/028* (2013.01); *F25D 27/00* (2013.01); *F25D 2400/18* (2013.01)

(58) Field of Classification Search
None
See application file for complete search history.

(56) References Cited

U.S. PATENT DOCUMENTS 6,059,420 A * 5/2000 Rogers ..... F25D 27/00 362/802
8,668,292 B2 * 3/2014 Pae ..... F25D 23/028 312/405
8,789,900 B2 7/2014 Laible
10,180,280 B2 * 1/2019 Lee ..... F25D 23/028
10,670,329 B2 * 6/2020 Kang ..... F25D 27/005
11,674,742 B2 * 6/2023 Park ..... F25D 29/005 361/679.01
11,988,442 B2 * 5/2024 Kwon ..... F25D 29/003
2014/0144083 A1 * 5/2014 Artwohl ..... G09F 23/065 49/70
2014/0226073 A1 * 8/2014 Kamada ..... G02B 6/0088 362/609
2018/0164031 A1 * 6/2018 Lee ..... F25D 11/00
(Continued)

FOREIGN PATENT DOCUMENTS

CN 103250018 8/2013
CN 112781309 A 5/2021
(Continued)

OTHER PUBLICATIONS

Extended European Search Report for EP Appln. No. 22184605.8-1016, dated Nov. 22, 2022, 8 pages.

*Primary Examiner* — Hanh V Tran
(74) *Attorney, Agent, or Firm* — Fish & Richardson P.C.

(57) ABSTRACT

Provided is a refrigerator. The refrigerator includes a cabinet and a door. The door includes a door body in which an insulating material is filled and a panel assembly detachably mounted on the door body. The panel assembly includes a panel which is configured to define a front surface of the door and through which light is transmitted, a back cover configured to define a rear surface of the panel assembly, a lower bracket configured to define a bottom surface of the panel assembly, and a lighting device mounted on the lower bracket to emit light to the panel. A bracket opening through which the lighting device is accessible is defined in the lower bracket.

18 Claims, 47 Drawing Sheets

(56) References Cited

U.S. PATENT DOCUMENTS

| | | | | |
|---|---|---|---|---|
| 2019/0051225 | A1* | 2/2019 | Sylvester | F21V 9/32 |
| 2019/0360745 | A1* | 11/2019 | Lee | F21V 33/0044 |
| 2019/0383551 | A1* | 12/2019 | Choi | F25D 23/028 |
| 2020/0018451 | A1* | 1/2020 | Signorino | F21V 3/04 |
| 2020/0173715 | A1* | 6/2020 | Kim | F25D 29/00 |
| 2024/0183606 | A1* | 6/2024 | Kim | F25D 27/00 |

FOREIGN PATENT DOCUMENTS

| | | | | |
|---|---|---|---|---|
| FR | 2978525 | A1 * | 2/2013 | A47F 11/10 |
| WO | WO-2018043933 | A1 * | 3/2018 | E06B 3/70 |
| WO | WO 2021/112409 | A1 | 6/2021 | |

* cited by examiner

REFRIGERATOR AND HOME APPLIANCE

CROSS-REFERENCE TO RELATED APPLICATIONS

The present application claims priority under 35 U.S.C. 119 and 35 U.S.C. 365 to Korean Patent Application No. 10-2021-0091829, filed on Jul. 13, 2021, which is hereby incorporated by reference in its entirety.

BACKGROUND

The present disclosure relates to a refrigerator and a home appliance.

In general, refrigerators are home appliances for storing foods at low temperature in an inner storage space covered by a refrigerator door. Here, the inside of the storage space is cooled using cool air that is generated by being heat-exchanged with a refrigerant circulated in a refrigeration cycle to store the foods in an optimal state.

Such refrigerators tend to increase more and more in size and provide multi-functions due to the trends of change of dietary life and high quality, and accordingly, refrigerators provided with various structures and convenience devices in consideration of user convenience are brought to the market.

In order to harmonize with an environment in which the refrigerator is disposed or with surrounding furniture or home appliances, structures for varying an outer appearance of a door front of the refrigerator are developed, and this trend is the same throughout the home appliance.

Representatively, U.S. Pat. No. 8,789,900 discloses a structure in which a decoration panel forming an outer appearance is installed on a door front of a refrigerator, and here, the outer appearance of the door front is formed according to a user's preference by detachably configuring the decoration panel.

However, the refrigerator having this structure has a problem in that, when a user wants to change the outer appearance, the entire decoration panel needs to be removed and replaced, and it is not possible to use the decoration panel before replacement any longer.

To solve such a limitation, a refrigerator capable of changing an outer appearance of a front surface of a refrigerator door, that is, an outer appearance of a front surface of the refrigerator without disassembling the refrigerator door, has been developed.

Representatively, Chinese Patent No. 103250018 discloses a refrigerator in which a reflective layer and a transparent panel are disposed on a door front and colored light emitting members are mounted on both side ends of the reflective layer to cause the transparent panel to glow with set color.

However, in the refrigerator having such a structure, there is a limitation in that it is not possible to ensure that a light emitting member is stably mounted due to characteristics of the door that is repeatedly opened and closed.

In addition, there is a limitation in that the light emitting member is disposed on both left and right ends so that the transparent panel does not glow with uniform brightness as a whole. In particular, light may not be transmitted to the bent side end for disposing the light emitting member, and thus a dark appearance may occur.

In addition, in the case of both the side ends on which the light emitting member is disposed, the light is not transmitted, and thus, there is a limitation in that both the side ends of the front surface of the door do not glow brightly.

In addition, in a state in which the light emitting member is turned off, there is a limitation in that an internal configuration is exposed due to the transparent panel, and there is a limitation in that the outer appearance in the off state is not good.

In addition, when service of the light emitting member is required, the entire door has to be disassembled, and in some cases, it is difficult or impossible to reassemble after the disassembly.

In addition, there is a limitation that the heat generated from the light emitting member is not effectively dissipated to cause excessive deformation of the light guide plate, and the temperature of the front surface of the refrigerator door rises, and thus, the user may feel uncomfortable when being approached to open the door. In addition, there is a limitation in that a temperature of a storage space inside the refrigerator is affected, or power consumption increases due to the increase in temperature inside the door.

In addition, there is a limitation that assembly and disassembly of the components including the light emitting member is complicated and cumbersome, and there is a limitation that maintenance is inconvenient.

SUMMARY

Embodiments provide a refrigerator, in which lighting device is easily detached and maintained, and a home appliance.

Embodiments also provide a refrigerator, in which a panel assembly is capable of being improved in assembling workability and productivity, and a home appliance.

Embodiments also provide a refrigerator, in which heat is prevented from being transferred to a user when heat of a lighting device is dissipated and which has improved heat dissipation performance, and a home appliance.

In one embodiment, a refrigerator includes: a cabinet in which a storage space is defined; and a door configured to open and close the storage space, wherein the door includes: a door body in which an insulating material is filled; and a panel assembly detachably mounted on the door body, wherein the panel assembly includes: a panel which is configured to define a front surface of the door and through which light is transmitted; a back cover configured to define a rear surface of the panel assembly; a lower bracket configured to define a bottom surface of the panel assembly; and a lighting device mounted on the lower bracket to emit light to the panel, wherein a bracket opening through which the lighting device is accessible is defined in the lower bracket.

The bracket opening may be opened toward the door body.

The lower bracket may protrude below the panel, and the lighting device may be further disposed below a lower end of the panel.

A light supporter configured to support the lighting device from a lower side may be provided on the lower bracket, and the light supporter may be accessible through the bracket opening.

The bracket opening may have a size corresponding to a size of the light supporter, and the lighting device may be accessible through the bracket opening in a state of being mounted on the light supporter.

The light supporter may be exposed through the bracket opening, and the back cover may be configured to shield the bracket opening so that the light supporter is restricted to the lower bracket.

The light supporter may be made of a metal material and is in contact with the back cover to transfer heat of the lighting device to the back cover.

The light supporter may include: a first supporting portion configured to support the lighting device; and a second supporting portion extending from the first supporting portion to be in contact with the back cover.

A substrate support protruding to support a lower side of the substrate may be disposed on the first supporting portion, and a substrate accommodation groove configured to accommodate a rear end of the substrate may be defined in the second supporting portion.

A cover bent portion that is bent forward may be disposed on a lower end of the back cover, and the cover bent portion may be inserted into the bracket opening to be in contact with the first supporting portion.

A light guide plate configured to guide the light emitted from the lighting device to the panel may be disposed behind the panel, wherein the lighting device may include: a substrate mounted inside the lower bracket; and a light source mounted on the substrate to emit the light to an end of the light guide plate.

A light guide plate support protruding backward and passing through the plurality of light sources may be disposed on a front surface of the lower bracket, and the light guide plate support may further protrude from a top surface of the light source to support a lower end of the light guide plate.

A cover portion extending upward to prevent the light source from being exposed may be disposed on the lower bracket, and an upper end of the cover portion may further extend upward from an upper end of the light source and a lower end of the panel.

A guide protrusion protruding backward to be in contact with a front surface of the light source may be disposed on the lower bracket, and in the state in which the guide protrusion and the light source are in contact with each other, the light source may be aligned vertically below a lower end of the light guide plate.

The panel assembly may further include: a support member disposed on each of both side surfaces of the panel assembly to extend vertically between the panel and the light guide plate; and an upper bracket configured to define a top surface of the panel assembly, wherein the upper bracket may be mounted on a top surface of the support member, and the lower bracket may be mounted on a lower end of the support member.

The panel assembly may include a back cover configured to define a rear surface of the panel assembly, upper and lower ends of the back cover may be coupled to the upper bracket and the lower bracket by a screw, respectively, and the back cover may be configured to shield the bracket opening in the state of being coupled to the upper bracket and the lower bracket.

The support member may be continuously disposed from a left end of the panel assembly to a right end of the panel assembly and be made of a material through which light is transmitted.

The support member may include: a planar front surface portion on which the panel is mounted; and a side surface portion which protrudes backward from each of both left and right ends of the front surface portion and on which the light guide plate is mounted.

A bracket insertion space opened vertically may be defined in each of upper and lower ends of the side surface portion, and each of the upper bracket and the lower bracket may be inserted into the bracket insertion space.

Each of both left and right ends of the back cover may be supported by the side surface portion.

In another embodiment, a home appliance includes: a cabinet configured to define an outer appearance of the home appliance; and a panel assembly mounted on the cabinet to define a front surface, wherein the panel assembly includes: a panel which is configured to define a front surface of the home appliance and through which light is transmitted, a back cover configured to define a rear surface of the panel assembly, a lower bracket configured to define a bottom surface of the panel assembly, and a lighting device mounted on the lower bracket to emit light to the panel. A bracket opening through which the lighting device is accessible is defined in the lower bracket.

In further another embodiment, a panel assembly for a home appliance includes: a panel which is configured to define a front surface of the home appliance and through which light is transmitted, a back cover configured to define a rear surface of the panel assembly, a lower bracket configured to define a bottom surface of the panel assembly, and a lighting device mounted on the lower bracket to emit light to the panel. A bracket opening through which the lighting device is accessible is defined in the lower bracket.

The details of one or more embodiments are set forth in the accompanying drawings and the description below. Other features will be apparent from the description and drawings, and from the claims.

BRIEF DESCRIPTION OF THE DRAWINGS

FIG. 30 is a front view illustrating the outer appearance of the front surface of the refrigerator in a state in which the lighting device of the refrigerator is turned on.

FIG. 38 is a front view illustrating an outer appearance of a front surface of a refrigerator in a state in which a lighting device of the refrigerator is turned on.

DETAILED DESCRIPTION OF THE EMBODIMENTS

Hereinafter, detailed embodiments will be described in detail with reference to the accompanying drawings. However, the present disclosure is limited to the embodiments in which the spirit of the present disclosure is proposed, and other degenerate idea or other embodiments included in the scope of the present disclosure may be easily proposed by addition, changes, deletions, etc. of other elements.

Prior to a description, directions are defined. In an embodiment of the present disclosure, a direction toward a door is defined as a front direction with respect to a cabinet shown in FIGS. 1 and 2, a direction toward the cabinet with respect to the door is defined as a rear direction, a direction toward a bottom on which a refrigerator is installed is defined as a downward direction, and a direction away from the bottom is defined as an upward direction.

Figure 1:
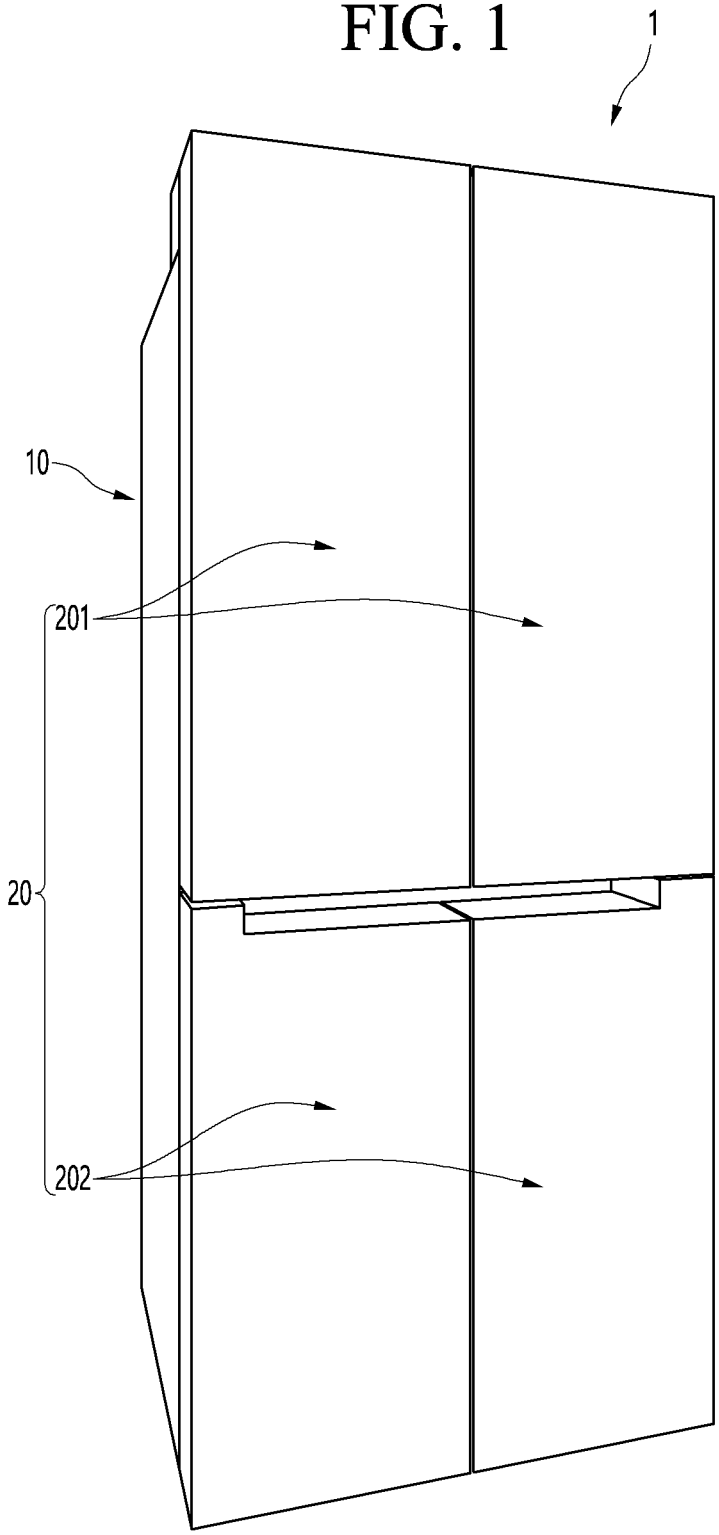
FIG. 1 is a perspective view of a refrigerator according to an embodiment.

FIG. 1 is a perspective view of a refrigerator according to an embodiment.

As illustrated in the drawings, an outer appearance of a refrigerator 1 according to an embodiment may be defined by a cabinet 10 in which a storage space is defined, and a door 20 for opening and closing the storage space of the cabinet 10.

For example, the cabinet 10 may form the storage space partitioned in a vertical direction, a refrigerating compartment may be formed at an upper portion, and a freezing compartment may be formed at a lower portion. The refrigerating compartment may be referred to as an upper storage space, and the freezing compartment may be referred to as a lower storage space.

The door 20 may be configured to open and close each of the refrigerating compartment and the freezing compartment. For example, the door may be rotatably mounted on the cabinet, and the refrigerating compartment and the freezing compartment may each be opened and closed by rotation. Needless to say, the door may also be withdrawn to open and close each of the refrigerating compartment and the freezing compartment.

The door may include a refrigerating compartment door 201 for opening and closing the refrigerating compartment, and a freezing compartment door 202 for opening and closing the freezing compartment. The refrigerating compartment door 201 may be referred to as an upper door, and the freezing compartment door 202 may be referred to as a lower door.

The refrigerating compartment door 201 may include a pair of a left refrigerating compartment door and a right refrigerating compartment door that are arranged side by side. The left refrigerating compartment door and the right refrigerating compartment door may open and close the refrigerating compartment while being independently rotated. The left refrigerating compartment door and the right refrigerating compartment door may be disposed adjacent to each other and may have the same size.

The freezing compartment door 202 may include a pair of a left freezing compartment door and a right freezing compartment door that are arranged side by side. The left freezing compartment door and the right freezing compartment door may open and close the freezing compartment while being independently rotated. The left freezing compartment door and the right freezing compartment door may be disposed adjacent to each other and may have the same size.

Needless to say, although a refrigerator having a structure in which a refrigerating compartment is disposed at an upper portion and a freezing compartment is disposed at a lower portion is described as an example in the embodiment, the present disclosure may be applied to all types of refrigerators equipped with a door without being limited to a type of a refrigerator.

an outer appearance of the front surface of the refrigerator 1 may be formed in the state in which the door 20 is closed and may form the out appearance of the refrigerator 1 viewed from the front in the state in which the refrigerator 1 is installed.

The door 20 may have a structure in which a front surface selectively emits light and may be configured to glow with set color or brightness. Thus, a user may change front color or brightness of the door 20 without separating or disassembling the door 20 and may change the overall outer appearance of the refrigerator 1.

Hereinafter, the structure of the door 20 will be described in detail with reference to drawings.

Figure 2:
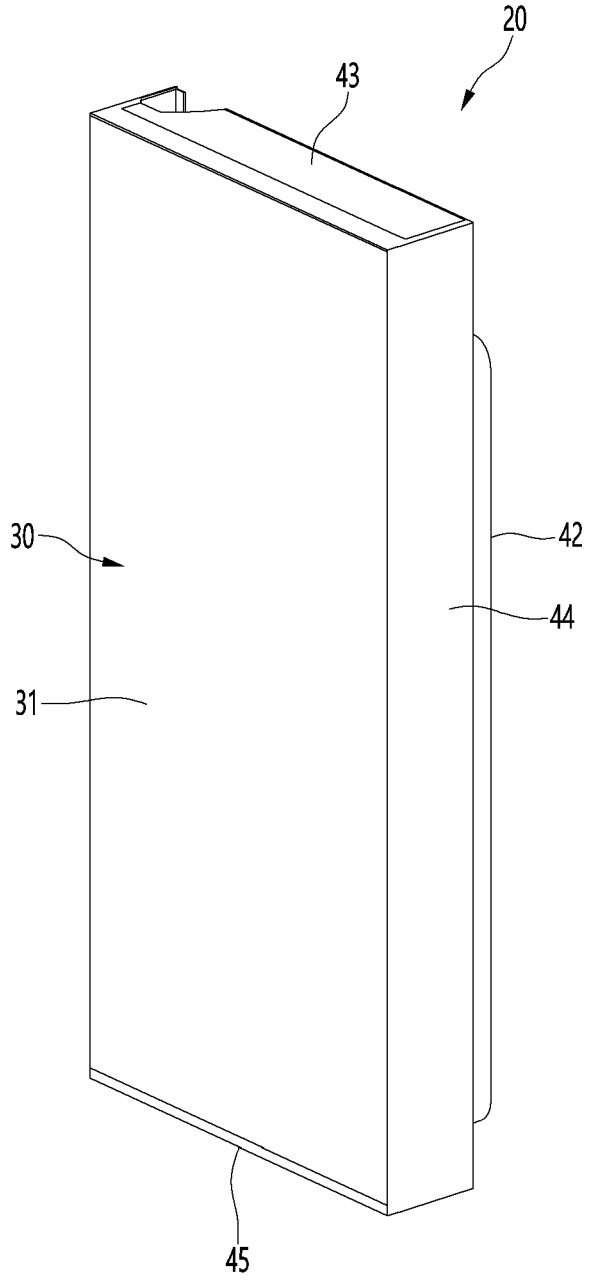
FIG. 2 is a perspective view of a refrigerator door according to an embodiment present disclosure.
Figure 3:
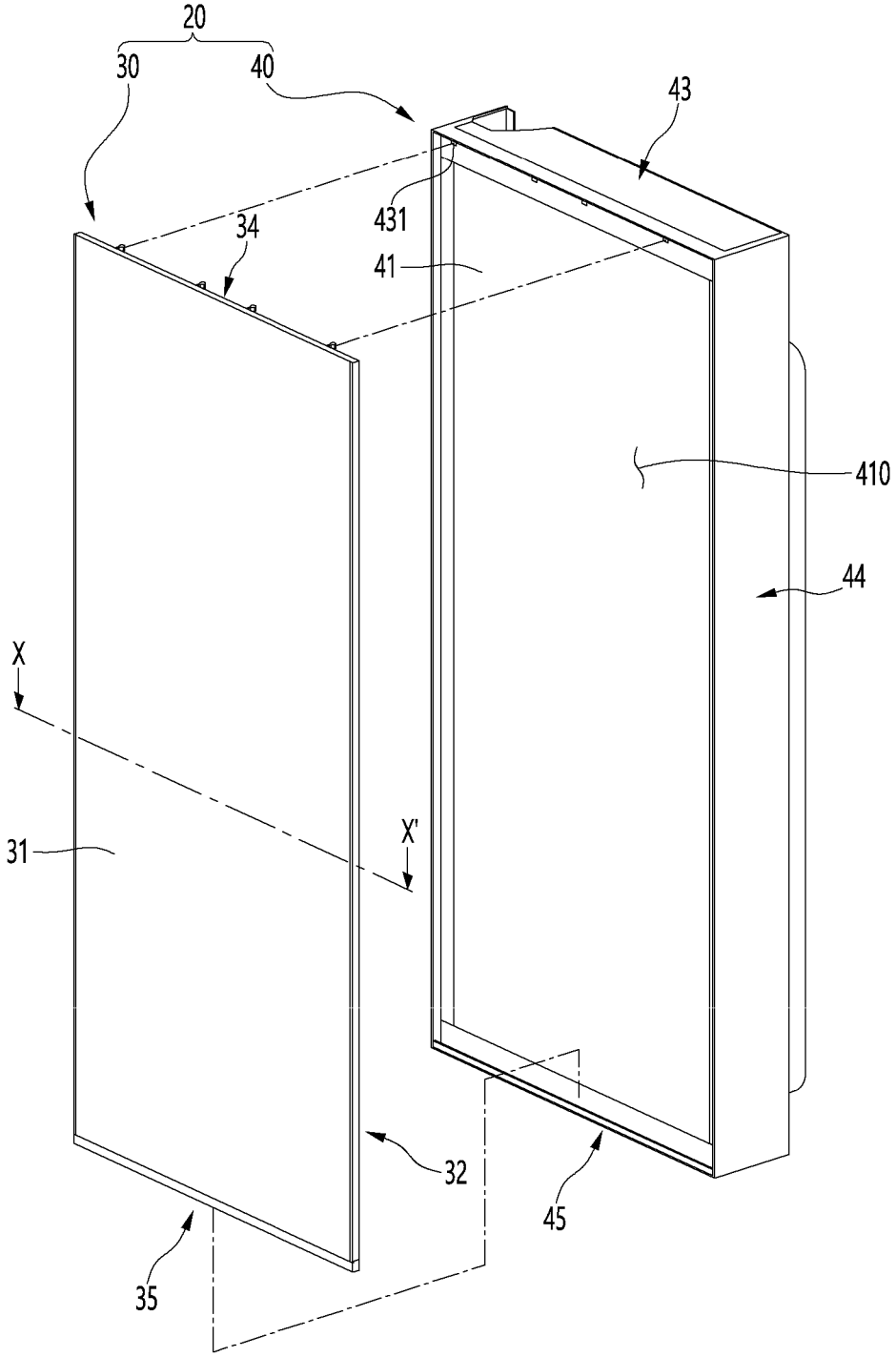
FIG. 3 is an exploded perspective view of the refrigerator door.

FIG. 2 is a perspective view of a refrigerator door according to an embodiment present disclosure. Also, FIG. 3 is an exploded perspective view of the refrigerator door.

As illustrated in the drawings, the door 20 may include a door body 21 defining the overall shape of the door 20, and a panel assembly 30 defining an outer appearance of a front surface of the door 20. That is, the door 20 may be configured in such a way that the panel assembly 30 is mounted on a front surface of the door body 40.

The door body 40 may include a body plate 41 defining a front surface and a door liner 42 defining a rear surface. The body plate 41 may be formed of a metal material and may be formed in a plate shape having a size corresponding to the panel assembly 30. The door liner 42 may be formed of a plastic material and may form a bottom shape of the door 20.

The door body 40 may include a side decoration 44 forming right and left side surfaces of the door body 21. The side decoration 44 may connect right and left side ends of the body plate 41 and right and left side ends of the door liner 42.

The door body 40 may include an upper cap decoration and a lower cap decoration 45 that form top and bottom surfaces of the door body 40. The upper cap decoration 43 may be connected to an upper end of the side decoration 44, an upper end of the body plate 41, and an upper end of the door liner 42. The lower cap decoration 45 may be connected to a lower end of the side decoration 44, a lower end of the body plate 41, and a lower end of the door liner 42.

An outer appearance of the door body 40 may be formed by the body plate 41, the door liner 42, the side decoration 44, the upper cap decoration 43, and the lower cap decoration 45. An insulator may be filled in an internal space of the door body 40, which is formed by coupling the body plate 41, the door liner 2, the side decoration 44, the upper cap decoration 43, and the lower cap decoration 45, and may provide an insulation structure to prevent heat from being transferred through the door 20.

An opened forward panel receiving space 410 may be formed on a front surface of the door body 40. That is, a front end of the side decoration 44 and front ends of the upper cap decoration 43 and the lower cap decoration 45 may protrude more forward than a front surface of the body plate 41, and thus the panel receiving space 410 with an open front side may be formed in front of the body plate 41. The panel receiving space 410 may be formed with a size corresponding to the size of the panel assembly 30 and the panel assembly 30 may be inserted into the panel receiving space 410. A circumference of the panel assembly 30 may be supported by a circumferential surface of the panel receiving space 410, that is, protruding portions of the side decoration 44, the upper cap decoration 43, and the lower cap decoration 45.

The panel assembly 30 may be formed in a plate shape and may be formed with a size corresponding to a front surface of the door body 40. Thus, when the panel assembly 30 is mounted on the front surface of the door body 40, the panel assembly 30 may shield the front surface of the door body 40 and may form an outer appearance of the front surface of the door 20. Since the panel assembly 30 may form the outer appearance of the front surface of the door 20, the panel assembly 30 may be referred to as a door panel, and since the panel assembly 30 may form the outer appearance of the front surface of the refrigerator 1, the panel assembly 30 may also be referred to as an exterior panel.

In the state in which the panel assembly 30 is mounted on the door body 40, a rear surface of the panel assembly 30 may be fixed in contact with the body plate 41. To fixedly mount the panel assembly 30, a lower end of the panel assembly 30 may be caught and restrained with a lower end of the lower cap decoration 45, and an upper end of the panel assembly 30 may be coupled to an upper end of a front surface of the upper cap decoration 43 to firmly couple the panel assembly 30 to the door body 40. The panel assembly 30 may be detachably mounted from the door body 40 for services and maintenance.

A front surface of the panel assembly 30 may be exposed forward in the state in which the panel assembly 30 is mounted on the door body 40, and the panel assembly 30 may substantially form the outer appearance of the front surface of the door 20. The panel assembly 30 may be configured to emit light from an entire front thereof and may be configured to glow with various colors.

To this end, a lighting device 36 may be provided inside the panel assembly 30. A wire 381 may be connected to the lighting device 36 in order to supply and control power. The wire 381 may be exposed outside the rear surface of the panel assembly 30, and a connector 382 may be provided on an end of the wire 381.

Although not illustrated in detail, a structure connected to the connector 382 of the wire 381 to supply power to the lighting device 36 may be provided on a front surface of the door body 40.

In addition, the electric wire 381 and the connector 382 have a structure that supplies power to the lighting device 36 and thus may be referred to as the power supply. In addition, the power supply may be exposed in the same form as a terminal in addition to the structure of the electric wire 381 and the connector 382, and then, when the panel assembly 30 is mounted, the power supply may naturally come into contact with the corresponding terminal disposed on the door body 40 to supply power to the lighting device 36.

Hereinafter, the structure of the panel assembly 30 will be described in more detail with reference to drawings.

Figure 4:
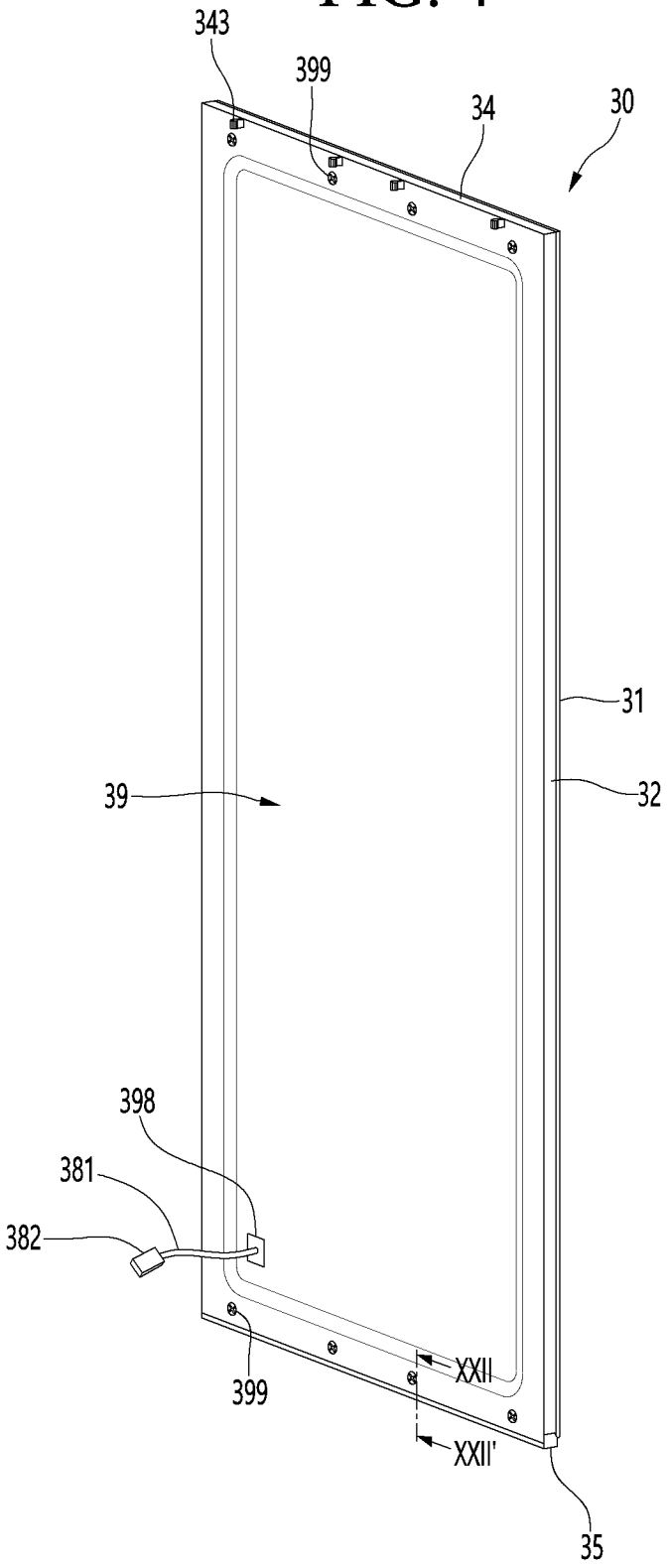
FIG. 4 is a perspective view of a panel assembly viewed from the rear according to an embodiment of the present disclosure.
Figure 5:
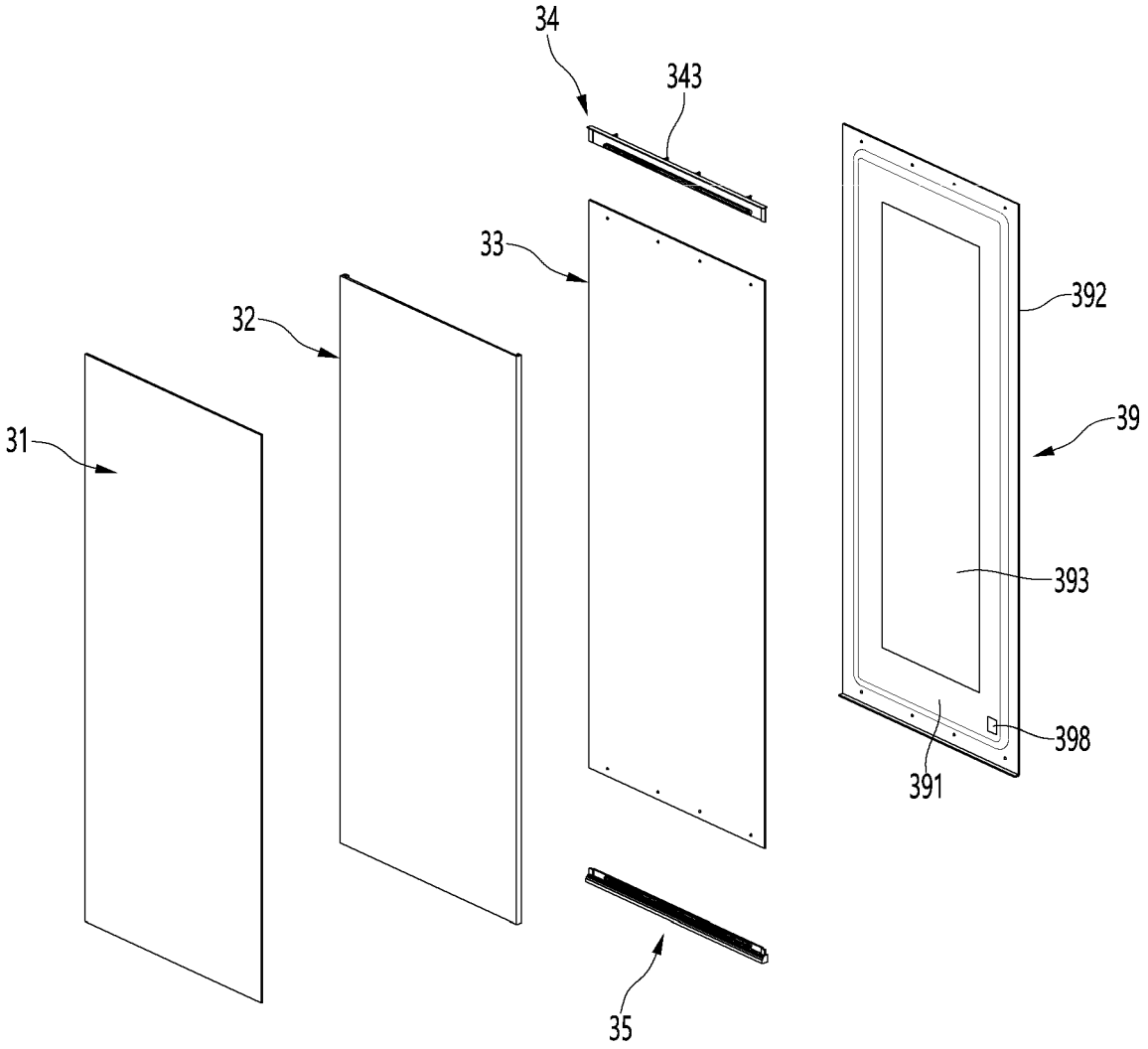
FIG. 5 is an exploded perspective view of the panel assembly viewed from the front.
Figure 6:
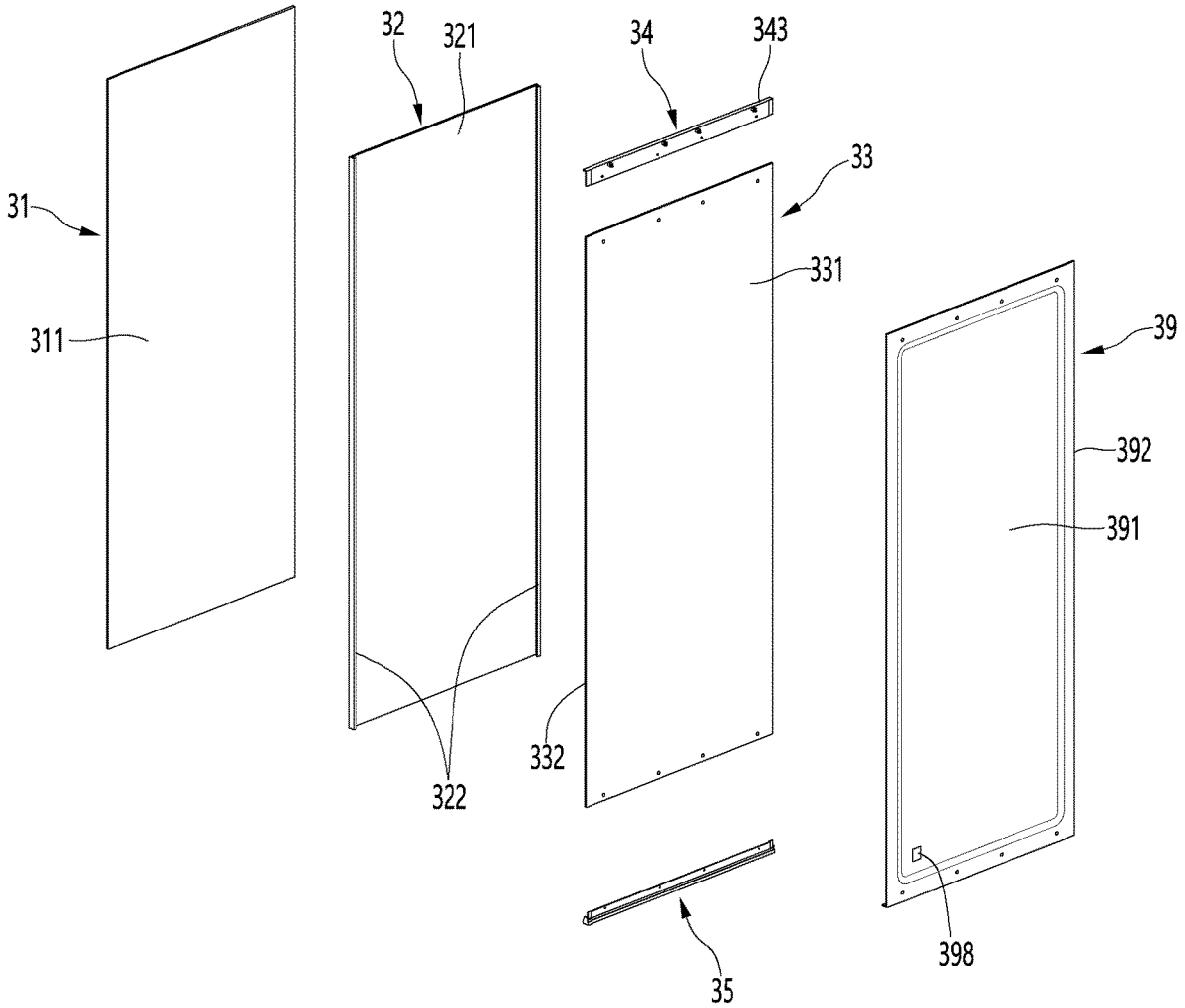
FIG. 6 is an exploded perspective view of the panel assembly viewed from the rear.

FIG. 4 is a perspective view of a panel assembly viewed from the rear according to an embodiment of the present disclosure. FIG. 5 is an exploded perspective view of the panel assembly viewed from the front. FIG. 6 is an exploded perspective view of the panel assembly viewed from the rear.

As shown in the drawings, the panel assembly 30 may include a panel 31 forming an outer appearance of the front surface, the lighting device 36 for emitting light to cause the panel 31 to glow, a light guide plate 33 for guiding light emitted from the lighting device 36, and a support member 32 on which the panel 31 is mounted.

The panel assembly 30 may include an upper bracket 34 forming a top surface of the panel assembly 30 and a lower bracket 35 forming a bottom surface of the panel assembly 30. The lighting device 36 may be mounted on the lower bracket 35. The panel assembly 30 may further include a back cover 39 forming a rear surface.

In more detail, the panel 31 may be formed in a rectangular plate shape and may be formed of a material that transmits light therethrough. For example the panel 31 may be formed of a glass material such as blue glass, white glass, and vapor deposition glass or may be formed of other materials for transmitting light therethrough, such as ABS, PMMA, or PC. The panel 31 may be referred to as a transparent plate or an out plate.

The panel 31 may be formed to be transparent to allow light reflected by the light guide plate 33 to be transmitted. In this case, the transparency may be defined as a degree to which the light reflected from the light guide plate 33 is transmitted and irradiated to the outside to identify that the panel 31 glows in a specific color.

In addition, in all embodiments of the present disclosure, the terms "transparent" and "transmission" may be defined as a state in which the light passes to display a set color through the panel 31.

The panel 31 may be formed to have color and may be formed to represent different colors depending on an operation or on and off states of the lighting device 36. For example, a specific design or pattern may be printed on the panel 31 to have specific color. A film with a specific design or pattern printed thereon may be added to the panel 31, surface treatment such as imprinting, etching, and glass printing may be performed on the panel 21, or a coating or deposition layer having specific color and texture may be formed to form an outer appearance of the panel 31.

The front plate 31 may be configured to transmit light emitted from the lighting device 36 but components behind the front plate 31 may not be seen therethrough. That is, in the state in which the lighting device 36 is turned off, components inside the panel assembly 30 may be prevented from being seen to the outside through the panel 31 due to the color of the panel 31.

In this case, the panel 31 may be provided with a color layer 311 having a color. Here, in an off state, the color layer 311 may have at least color having brightness equal to or greater than 0 other than black. That is, in a state in which the refrigerator 1 is installed, the front surface of the refrigerator 1 may be displayed in a color other than black, and the front color of the refrigerator may be changed according to an operation of the lighting device 36.

The panel 31 may be formed to correspond to a size of a portion of a front surface of the panel assembly 30, which is exposed to the outside. In detail, an upper end and right and left side ends of the panel 31 except for a lower end may be formed to have the same size as those of the panel assembly 30. The lower end of the panel 31 may be positioned somewhat higher than the lower end of the panel assembly 30, that is, the lower end of the lower bracket 35, but the exposed portion of the lower bracket 35 may be shielded by the lower cap decoration 45 in the state in which the panel assembly 30 is mounted. Thus, the entire front surface of the panel 31 which is exposed to the outside in the state in which the panel assembly 30 is mounted may be formed by the panel 31.

The panel 31 may be formed to be larger than the light guide plate 33. A rear surface of the panel 31 may be coupled to a front surface of the support member 32. Thus, in the state in which the panel 31 is mounted on the support member 32, a separate component is not present at the circumference of the panel 31, and the panel 31 may form the outer appearance of the front surface of the panel assembly 30.

The light guide plate 33 may be positioned at a rear spaced apart from the panel 31 and may be configured to guide light emitted from the lighting device 36 disposed at the upper end of the light guide plate 33 forward.

For example, the light guide plate 33 may be made of a transparent polymer material such as acrylic. The light guide plate 33 may have a diffusing agent added thereto for diffusing light entrance on the light guide plate 33 or a pattern for diffusing light may be further formed on the light guide plate 33. Thus, light may be transferred to the panel 31 by the light guide plate 33, and in this case, a pattern of the light guide plate 33 may be set to cause the entire front surface of the panel 31 to glow with uniform brightness.

The light guide plate 33 may be entirely formed in a rectangular plate shape and may be formed with a somewhat smaller size than that of the panel 31. The light guide plate 33 may be supported by the back cover 39 from the rear and may be fixed to be maintained at a predetermined interval from the panel 31 by the support member 32.

The light guide plate 33 may have a set thickness to reflect the light irradiated from the lighting device 36 toward the panel 31. Here, the light guide plate 33 may have a thickness capable of providing an amount of light sufficient to sufficiently illuminate the entire panel 31. For example, when the panel 31 has a thickness of about 3.2 mm, the light guide plate 33 may have a thickness of about 2 mm.

the support member 32 may be disposed between the panel 31 and the light guide plate 33. the support member 32 may be used to fixedly mount the light guide plate 33 and the panel 31, and in particular, may maintain the light guide plate 33 at a predetermined interval from the panel 31.

The front surface of the support member 32 may support the panel 31 and opposite side surfaces of the support member 32 may restrain both ends of the light guide plate 33. The front surface of the support member 32 may be larger than or equal to the size of the light guide plate 33, and in the state in which the light guide plate 33 is mounted, the front surface of the support member 32 and the light guide plate 33 may be maintained in the state of surface-contacting each other.

In detail, the support member 32 may include a front surface portion 321 shaped like a plate on which the panel 31 is mounted, and a side surface portion 322 that is formed at right and left side ends of the front surface portion 321 and on which the light guide plate 33 is mounted. The front surface portion 321 may be formed like a plate corresponding to the panel 31, and a front surface of the light guide plate 33 may be in close contact with a rear surface of the front surface portion 321. The side surface portion 322 may extend rearward from right and left side ends of the front surface portion 321 and may be formed to restrain right and left side ends of the light guide plate 33.

The support member 32 may be referred to as a transmissive plate because of allowing light to pass therethrough and may also be referred to as a frame because of defining a structure including the side surface of the panel assembly 340.

The support member 32 may be formed of a material for transmitting light therethrough and may be entirely formed by injection or extrusion as a single component. For example, the support member 32 may be made of a material such as ABC, PC, or acryl, and the light reflected from the light guide plate 33 may be transmitted to pass through the panel 31.

The support member 32 may be entirely made of a transparent or translucent material, and the support member 32 itself may have a color. Thus, when viewed from the front of the panel assembly 30, a front color, texture, or shape of the panel assembly 30 may be determined by the support member 32. The support member 32 may have corrosion or a pattern formed on the front surface portion 321 through which light is transmitted, and such corrosion or pattern may be formed when viewed from the front of the panel assembly 30.

The upper bracket 34 may be provided at an upper end of the panel assembly 30. The upper bracket 34 may form a top surface of the panel assembly 30. The upper bracket 34 may be injection-molded with a plastic material, and may define a structure coupled to the support member 32 and a structure coupled to the back cover 39.

The upper bracket 34 may be coupled to the upper end of the support member 32 and may extend from a left end of the upper end of the support member 32 to a right end thereof. The upper bracket 34 may be exposed through the top surface of the panel assembly 30 in the state of being mounted.

The back cover 39 may be coupled to the rear surface of the upper bracket 34. The back cover 39 may be coupled to the upper bracket 34 by coupling a screw. The rear surface of the light guide plate 33 may be supported by the front surface of the upper bracket 34. That is, when the back cover 39 is coupled, the upper bracket 34 may support the light guide plate 33 from the rear.

The lower bracket 35 may be provided at the lower end of the panel assembly 30. The lower bracket 35 may form a bottom surface of the panel assembly 30. The lower bracket 35 may be injection-molded with a plastic material and may form a structure coupled to the support member 32 and a structure coupled to the back cover 39.

The lower bracket 35 may be coupled to the lower end of the support member 32 and may extend from a left end of the lower end of the support member 32 to a right end thereof. The lower bracket 35 may be exposed through a bottom surface of the panel assembly 30 in the state of being mounted.

The back cover 39 may be coupled to the rear surface of the lower bracket 35. The back cover 39 may be coupled to the lower bracket 35 by coupling a screw. The rear surface of the light guide plate 33 may be supported by the front surface of the lower bracket 35. That is, when the back cover 39 is coupled, the lower bracket 35 may support the light guide plate 33 from the rear.

Thus, during a process in which the panel assembly 30 is assembled, right and left side ends of the light guide plate 33 may be fixed by the support member 32, and the upper and lower ends of the light guide plate 33 may be supported by the upper bracket 34 and the lower bracket 35 from the rear.

The lighting device 36 may be mounted on the lower bracket 35. The lighting device 36 may be configured to emit for determining the front color and brightness of the panel assembly and to emit light toward the light guide plate 33. The lighting device 36 may be provided inside the lower bracket 35 and may be assembled and mounted with the lower bracket 35 in the state of being mounted on the lower bracket 35.

The back cover 39 may form a rear surface of the panel assembly 30 and may be coupled to the upper bracket 34 and the lower bracket 35. The back cover 39 may be formed of a metal material such as stainless or aluminum. The back cover 39 may be formed with a size corresponding to the size of the panel assembly 30 and may form an entire shape of the rear surface of the panel assembly 30.

The rear surface of the light guide plate 33 may be supported by a cover protrusion 391 protruding on the center of the back cover 39, from the rear. Thus, the light guide plate 33 may have the overall stable support structure and may be maintained in a stable mounting state in the state in which the back cover 39 is mounted. The upper bracket 34 and the lower bracket 35 may be provided at positions corresponding to an upper end and a lower end of the back cover 39.

Right and left side ends of a cover circumferential portion 392, which form a circumference of the back cover 39, may be in contact with the side surface portion 322 of the support member 32, and upper and lower ends of the cover circumferential portion 392 may be in contact with the upper bracket 34 and the lower bracket 35, respectively.

A plurality of screws 399 may be coupled to the upper and lower ends of the cover circumferential portion 392 and may be coupled to the upper bracket 34 and the lower bracket 35 through the back cover 39 to fixedly mount the back cover 39.

The structures of the light guide plate 33, the support member 32, the back cover 39, the upper bracket 34, and the lower bracket 35 will be described below in more detail with reference to the drawings.

Figure 7:
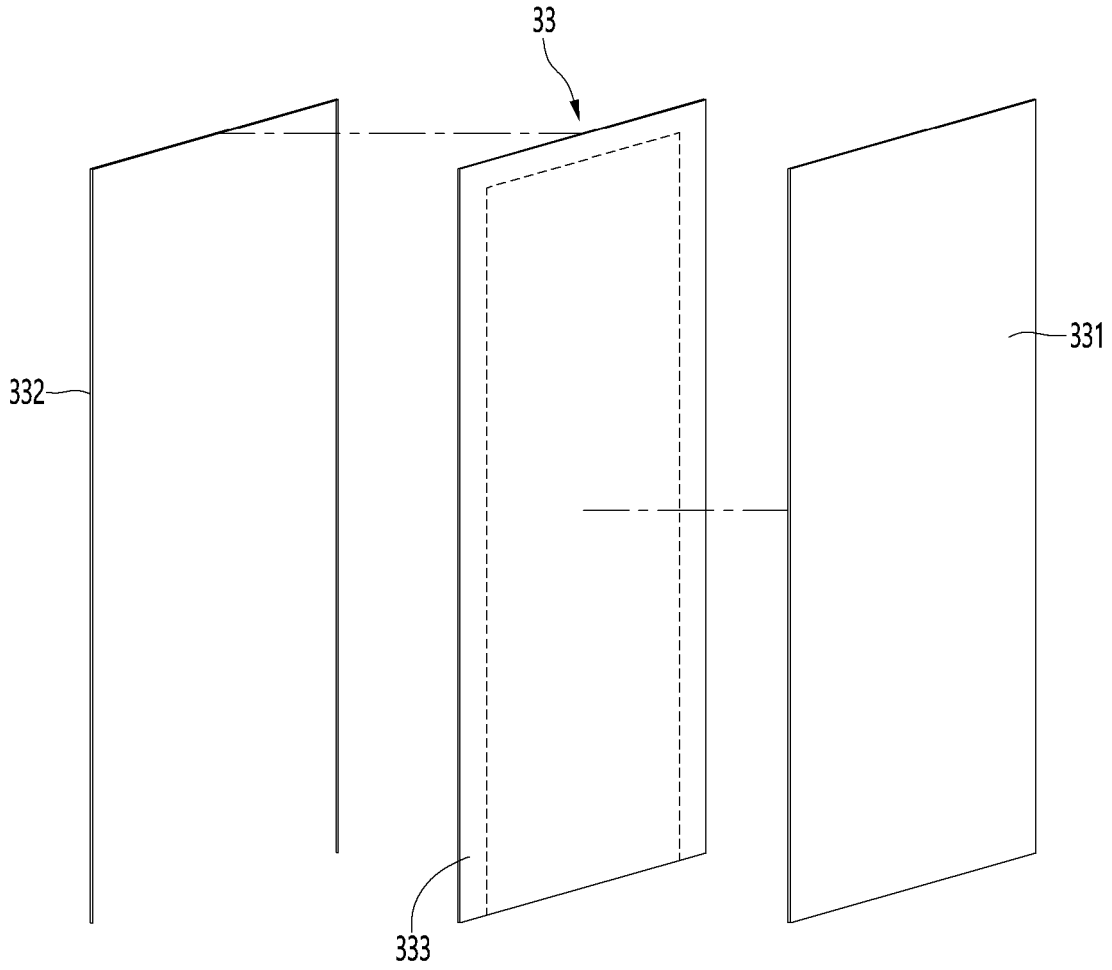
FIG. 7 is an exploded perspective view showing a coupling structure of a light guide plate, a reflective layer, and a reflective member as one component of the panel assembly.

FIG. 7 is an exploded perspective view showing a coupling structure of a light guide plate, a reflective layer, and a reflective member as one component of the panel assembly.

As shown in the drawing, the light guide plate 33 may be formed in a rectangular plate shape. The light guide plate 33 may be formed with a size corresponding to or somewhat smaller than the size of the front surface portion 321 of the panel 31 and the support member 32.

The light guide plate 33 may be formed with a thickness to be inserted into a side surface of the support member 32, and in the state in which the light guide plate 33 is mounted on the support member 32, a front surface of the light guide plate 33 may be in completely in contact with a rear surface of the front surface portion 321 of the support member 32, and thus a gap may not be generated therebetween.

The light guide plate 33 may be formed to reflect light of the lighting device 36, emitted from below, along the light guide plate 33 and to uniformly transfer the light forward, that is, to an entire surface of the panel 31.

To this end, a pattern for reflecting light emitted along the light guide plate 33 forward may be formed on the light guide plate 33. For example, the light guide plate 33 may have a pattern that increases in density upward from a center of the light guide plate 33 so as to have uniform brightness as a whole, and the density of the pattern may gradually increase from the center toward both left and right sides.

In addition, the pattern may not be provided at a position closest to the lighting device 36 on the lower end of the light guide plate 33, or the density of the pattern may be provided to be relatively low. In addition, a pattern portion 333 having a relatively high pattern density may be provided around a circumference except for the lower end of the light guide plate 33. Thus, reflectance may increase on the pattern portion 333 to prevent an edge portion of the panel 31 from being darkened by the sealant 313 or the coupling structures inside the panel assembly 30, thereby allowing the panel 31 to have uniform brightness throughout. For example, the pattern may be provided to a width of about 10 mm to about 20 mm at the upper end and both ends of the light guide plate 33 except for the lower end. In addition, the pattern around the light guide plate 33 may be provided in a shape different from that of the central portion of the light guide plate 33 to increase in light collection around the light guide plate 33.

A reflective layer 331 may be disposed on the rear surface of the light guide plate 33. The reflective layer 331 may be formed with the same size of the size of the light guide plate 33 and may be formed like a sheet. The reflective layer 331 may be in close contact with the rear surface of the light guide plate 33, and as necessary, may also be adhered to the rear surface of the light guide plate 33.

The reflective layer 331 may be coated or patterned to cause a front surface thereof to reflect light, and the front surface of the reflective layer 331 may be in contact with the rear surface of the light guide plate 33. Thus, light moved along the reflective layer 331 may be reflected by the front surface of the reflective layer 331 to be directed forward and may be reflected to the panel 31.

The reflective layer 331 may be slidably inserted into the support member 32 in the state of being in contact with the light guide plate 33 and may be maintained in the state of being in contact with the reflective layer 331. To this end, the reflective layer 331 may be configured to be maintained in the state of being in contact with the light guide plate 33 by static electricity or friction force.

A reflective member 332 may be further provided along an outer circumference of the light guide plate 33. The reflective member 332 may be formed of the same material as that of the reflective layer 331 and may direct light leaking through a circumference surface of the light guide plate 33 again into the light guide plate 33 to further increase the reflection efficiency of the light guide plate 33.

Light leaking to the outside through a circumference of the light guide plate 33 may be blocked by the reflective member 332, and thus light may also be prevented from leaking to the outside through the side surface portion 322 of the support member 32 formed of a transparent or translucent material, which is adjacent to an end of the light guide plate 33.

The reflective member 332 may be adhered to a circumference of an outer surface of the light guide plate 33 by a tape or an adhesive, and a surface on which a pattern for reflecting light into the light guide plate 33 is formed may be adhered to a circumference surface of the light guide plate 33.

The reflective member 332 may be provided on a portion of an entire circumferential surface of the light guide plate 33. In detail, the reflective member 332 may be provided along a top surface and both left and right surfaces rather than a bottom surface (light entrance surface) facing the lighting device 36 on the circumference of the light guide plate 33. The light guide plate 33 may be mounted on the support member 32 in a state in which the reflective layer 331 and the reflective member 332 are in contact with each other.

Figure 8:
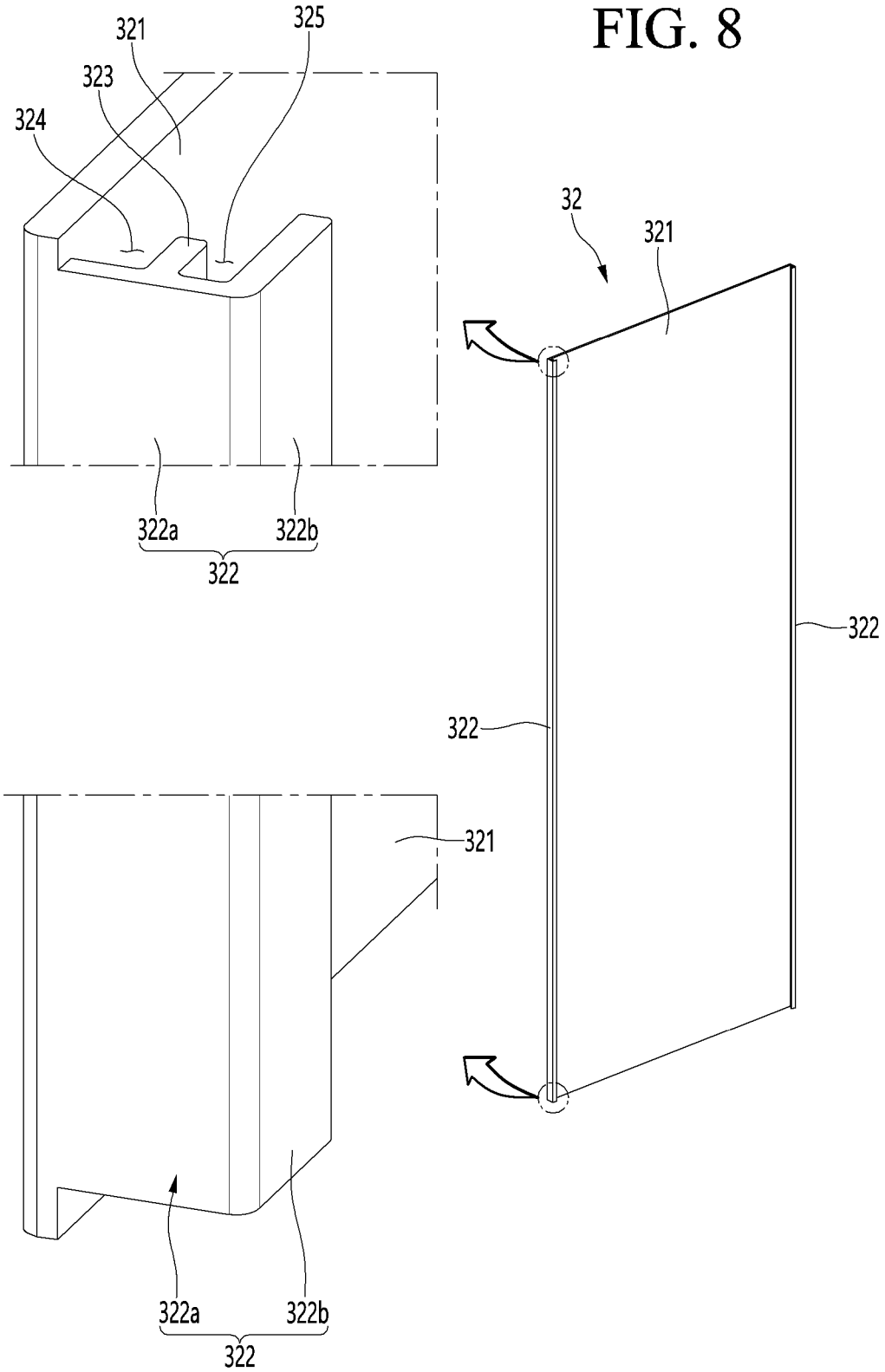
FIG. 8 is a rear perspective view illustrating a support member that is one component of the panel assembly.
Figure 9:
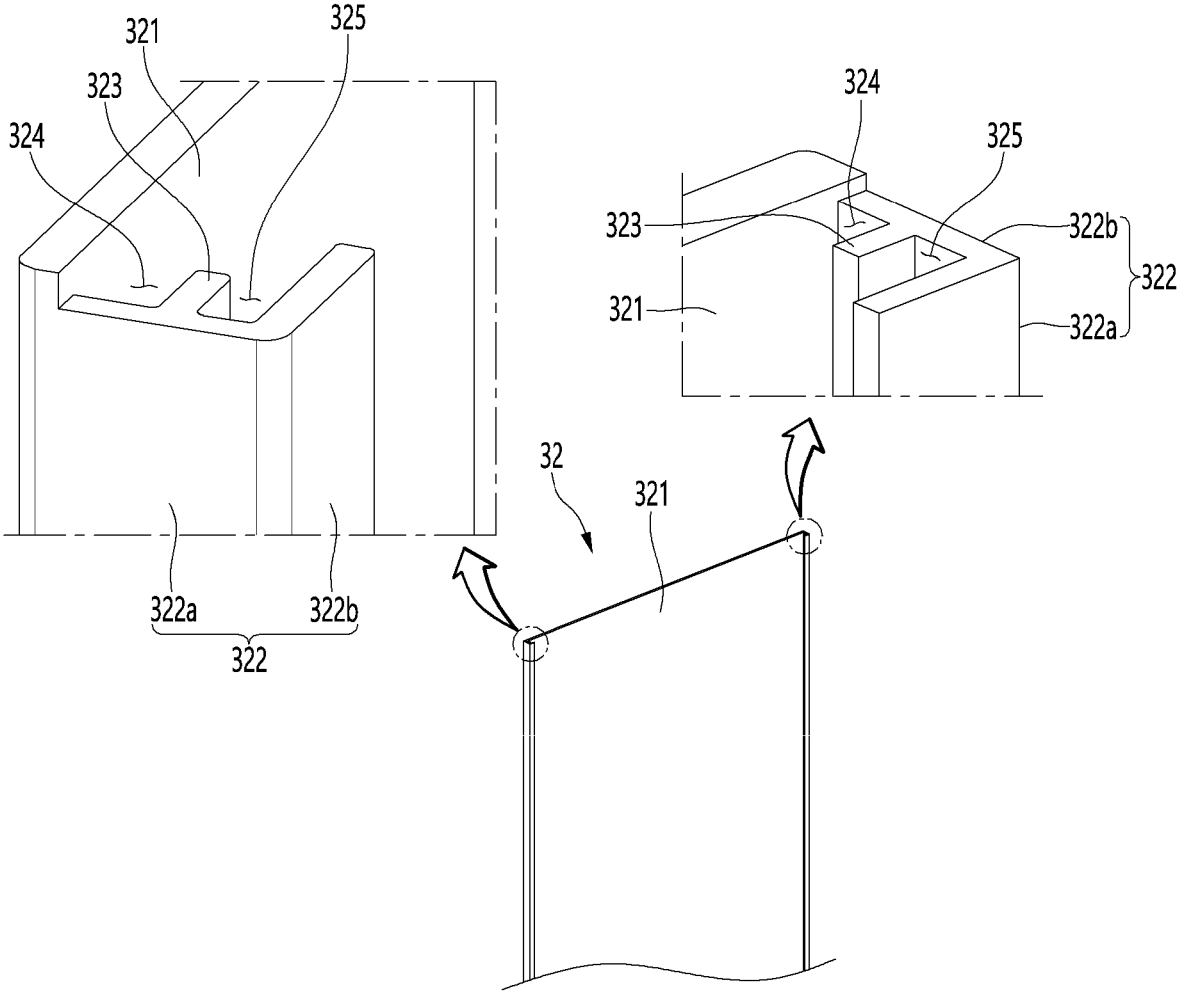
FIG. 9 is a partial enlarged view illustrating a structure of an upper portion of the support member.
Figure 10:
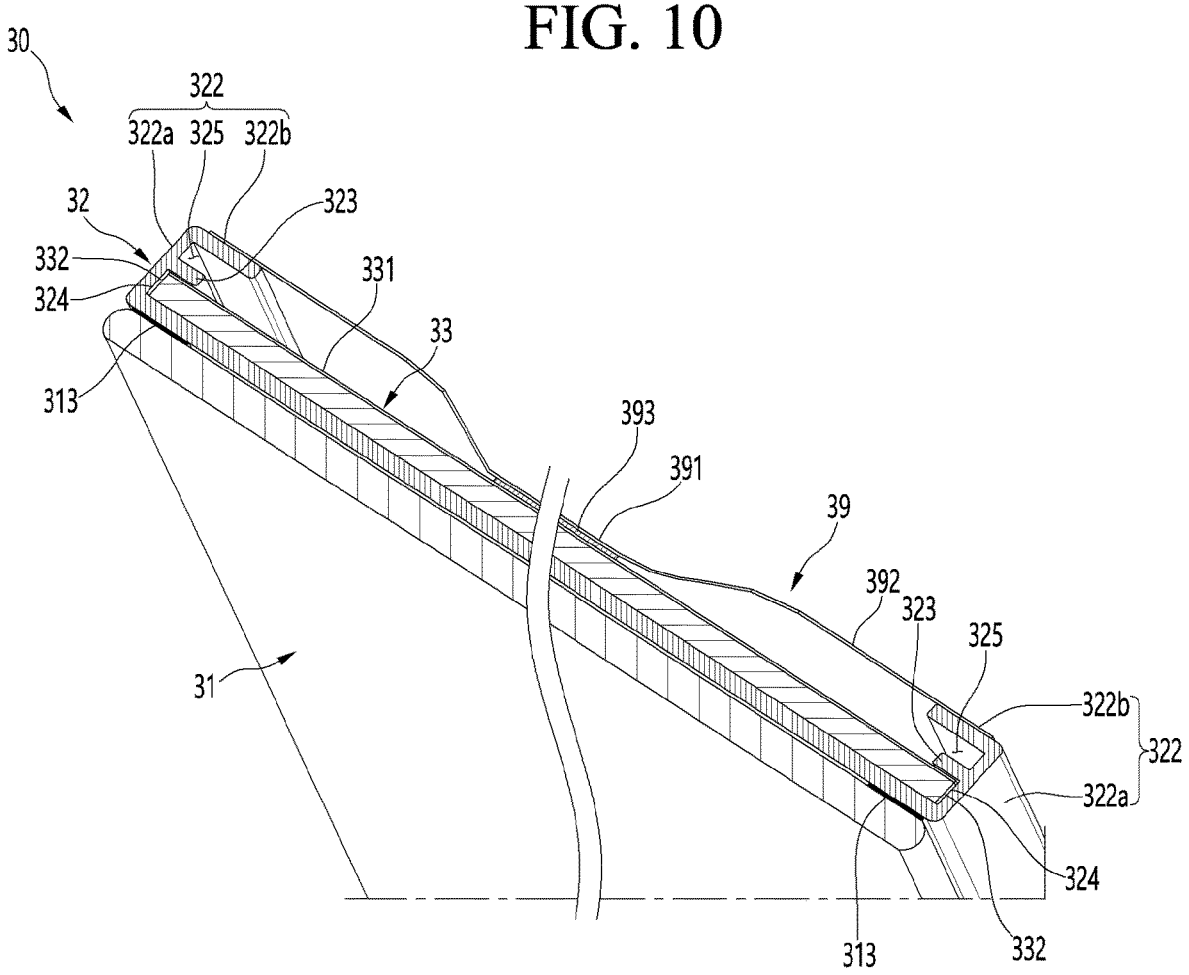
FIG. 10 is a cutaway perspective view taken along line X-X' of FIG. 3.

FIG. 8 is a rear perspective view illustrating a support member that is one component of the panel assembly. FIG. 9 is a partial enlarged view illustrating a structure of an upper portion of the support member. FIG. 10 is a cutaway perspective view taken along line X-X' of FIG. 3.

As shown in the drawings, the support member 32 may be entirely formed by injection molding of a resin material and may be formed of a transparent material, and thus light reflected forward through the light guide plate 33 may be transmitted and directed toward the panel 31.

The support member 32 may include the front surface portion 321 shaped like a plate, and the side surface portion 322 that protrudes rearward from the right and left side ends of the front surface portion 321. The front surface portion 321 may be disposed between the panel 31 and the light guide plate 33, the front surface may support the panel 31, and the rear surface may support the light guide plate 33.

The front surface portion 321 may be provided in a plate shape having a size corresponding to that of the panel 31, and a sealant 313 may be applied around the front surface portion 321 so that the panel 31 adheres to the support member 32. Here, the sealant 313 may be made of a transparent material or a material capable of transmitting light, and the panel 31 may be configured so that the entire area including an area to which the sealant 313 is applied glows.

In the state in which the light guide plate 33 is mounted, the rear surface of the front surface portion 321 may be maintained in the state of being in completely contact with the front surface of the light guide plate 33. Thus, the light guide plate 33 may always be maintained at a predetermined interval and may direct light of an entire portion of the light guide plate 33 toward the panel 31 without being interfered.

The side surface portion 322 may be formed along the right and left side ends of the light guide plate 33. The side surface portion 322 may be stepped with upper and lower ends of the light guide plate 33 and may be formed to match with side ends of the upper bracket 34 and the lower bracket 35.

The side surface portion 322 may include a first surface **322*a* extending rearward from the right and left side ends of the front surface portion 321 and a second surface 323 protruding to face each other in an internal surface of the first portion 322*a*** at both ends.

The first surface **322*a* may extend perpendicularly to the front surface portion 321 from the right and left side ends of the front surface portion 321 and may form a side surface of the panel assembly 30. That is, an extending length of the first surface 322*a* may correspond to a width of the side surface of the panel assembly 30. An inner space of the panel assembly 30 may be defined by the first surface 322*a*, and a space in which at least the light guide plate 33, the upper bracket 34, and the lower bracket 35 are mounted may be defined. Upper and lower ends of the first surface 322*a* may be provided to be stepped with respect to upper and lower ends of the front surface portion 321**.

The second surface **322*b* may be bent inward from an extending end of the first surface 322*a*. That is, one pair of the second surfaces 322*b* that are formed on one pair of the first surfaces 322*a***, respectively, may extend to face each other.

The second surface **322*b* may extend perpendicularly to the first portion 322*a* and may be formed to restrain both ends of the upper bracket 34 and the lower bracket 35. The second surface 322*b* may extend from an upper end of the first surface 322*a* to a lower end thereof and may support right and left side ends of the back cover 39**.

A side rib 323 may be further formed on an internal surface of the first surface **322*a*. The side rib 323 may be formed between the front surface portion 321 and the second surface 322***b* and may extend perpendicularly to the first surface 322*a*. The side rib 323 may extend from an upper end of the first surface 322*a* to a lower end thereof. The right and left width of the side rib 323 may be shorter than that of the second surface 322*b*.

Thus, the side rib 323 may divide a space formed by the side surface portion 322 into front and rear sides to form a space into which the light guide plate 33, the upper bracket 34, and the lower bracket 35 are slidably inserted.

In detail, the side rib 323 may be positioned between the front surface portion 321 and the second surface 322*b* and may be formed in parallel to the front surface portion 321 and the second surface 322*b*. The side rib 323 may partition a space between the front surface portion 321 and the second surface 322*b* to form a light guide plate insertion space 324 into which the light guide plate 33 is inserted, and a bracket insertion space 325 into which the upper bracket 34 and the lower bracket 35 are inserted.

The light guide plate insertion space 324 may be formed between the front surface portion 321 and the side rib 323. A distance of the light guide plate insertion space 324 in a front and rear direction may be provided to have a size corresponding to the thickness of the light guide plate 33. Thus, the light guide plate 33 may be slidably moved into the light guide plate insertion space 324, and the right and left side ends of the light guide plate 33 may be restrained at both side ends of the support member 32. In this case, the front surface of the light guide plate 33 may be in contact with the rear surface of the front surface portion 321.

In the state in which the light guide plate 33 is inserted into the light guide plate insertion space 324, the lower end of the light guide plate 33 may be positioned to face the lighting device 36. In particular, the light guide plate 33 may be disposed on the same extension line as the light source 362 of the lighting device 36, and in the state in which the light guide plate 33 is fixedly inserted into the light guide plate insertion space 324, movement in forward and backward directions of the light guide plate 33 may be restrained.

That is, even if the door 20 is repeatedly opened and closed, the light guide plate 33 may be in contact with the front surface portion may be maintained at a predetermined interval from the panel 31, and may not deviate from a position at which the light guide plate 33 is originally installed. The state in which the light guide plate 33 is disposed on the same extension line as the light source 362 included in the lighting device 36 may be maintained, and thus it may be possible to ensure that light emitted from the light source 362 is directed toward an end of the light guide plate 33.

The bracket insertion space 325 may be formed between the side rib 323 and the second surface 322*b*. A distance of the bracket insertion space 325 in the front and rear direction may correspond to the thickness of an upper bracket front surface portion 341 and a lower bracket front surface portion 351. Thus, the upper bracket 34 and the lower bracket 35 may be inserted into the bracket insertion space 325 from above and below and may be fixedly mounted on the upper and lower ends of the support member 32.

Here, the upper bracket 34 and the lower bracket 35 may be inserted into the bracket insertion space 325 and simultaneously may be seated on the stepped portions of the upper and lower ends of the side surface portion 322 so as to be firmly coupled to the support member 32. The upper bracket 34 and the lower bracket 35 define upper and lower ends of the panel assembly 30 while being coupled to the support member 32.

Figure 11:
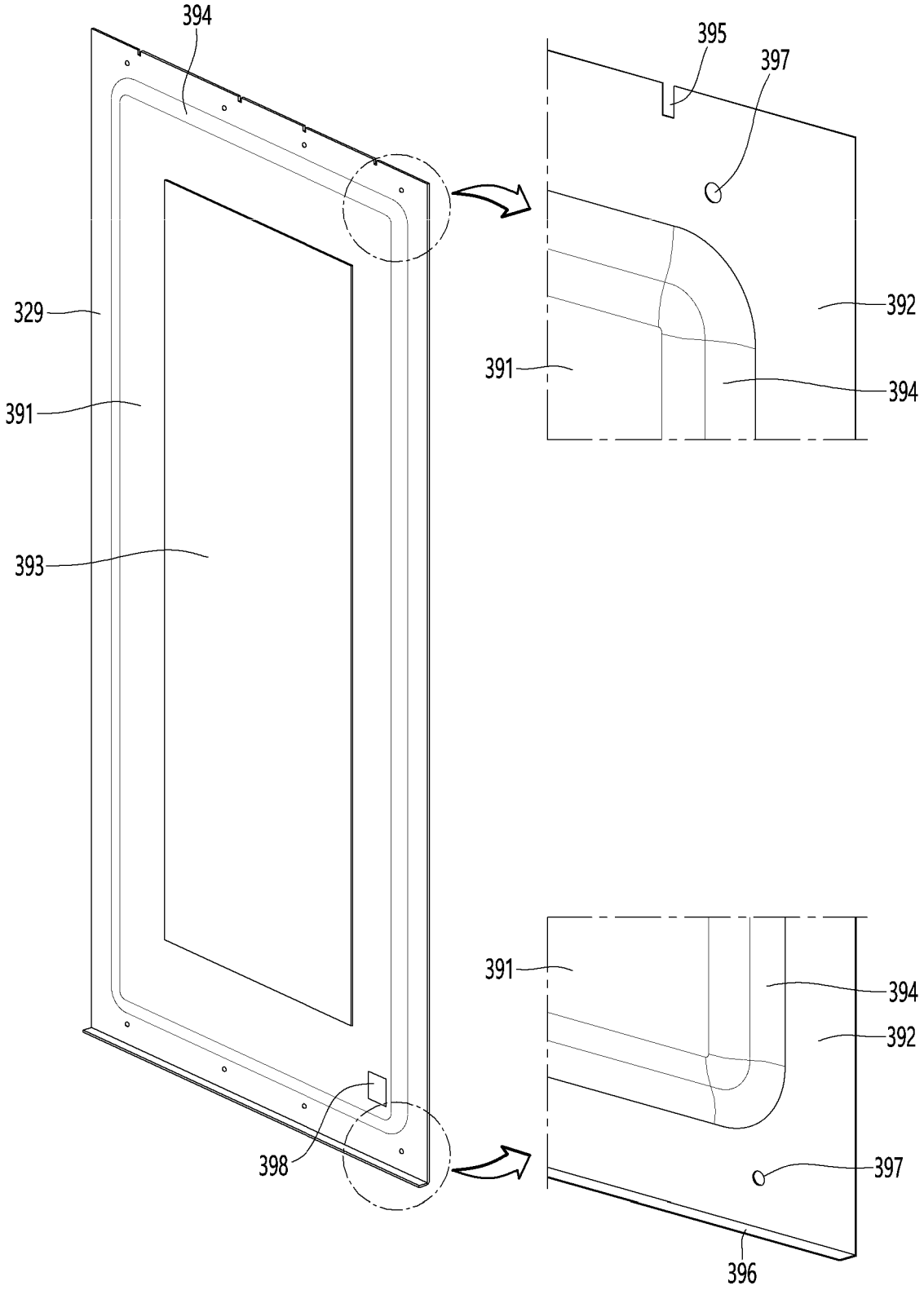
FIG. 11 is a perspective view illustrating a back cover that is one component of the panel assembly.

FIG. 11 is a perspective view illustrating the back cover that is one component of the panel assembly.

As illustrated in the drawing, the back cover 39 may be provided in a rectangular plate shape to form the rear surface of the panel assembly 30. The back cover 39 may be made of a metal material such as steel or aluminum, and the overall shape may be formed through forming processing.

The back cover 39 may include a cover protrusion 391 protruding forward as a whole and a cover circumferential portion 392 disposed along a circumference of the cover protrusion 391.

The cover protrusion 391 may define most of the area of the back cover 39 except for the cover circumferential portion 392 and may protrude forward to support the light guide plate 33 from the rear. Here, a protruding front surface of the cover protrusion 391 may be provided in a planar shape having the same height to support the most of the area of the light guide plate 33. In addition, the cover protrusion 391 may protrude when the back cover 39 is molded and may be provided in a shape that is recessed forward when viewed from the rear.

Thus, in a state in which the panel assembly 30 is mounted on the door body 40, a space may be defined between the rear surface of the panel assembly 30 and the front surface of the door body 40. That is, when heat generated during the operation of the lighting device 36 conducted along the rear surface of the panel assembly 30, i.e., along the back cover 39, is transferred through the back cover 39, a space in which heat is dissipated through the rear surface of the panel assembly 30 may be defined.

In addition, a buffer member 393 may be further provided on the cover protrusion 391. The buffer member 393 may be made of an elastically deformable material and also may be provided in a sheet shape and be attached to the cover protrusion 391. For example, the buffer member 393 may be made of a foaming material or a foam material and may be in close contact with the light guide plate 33 to support the light guide plate 33.

Even if an impact is applied when the door 20 is opened and closed by the buffer member 393, the light guide plate 33 may be prevented from being shaken, and the impact transmitted to the light guide plate 33 may be alleviated to reduce the impact to the light guide plate 33 to protect the light guide plate 33. Also, even when the light guide plate 33 is deformed while being pressed or expanded by heat, the space in which the light guide plate 33 is deformable may be provided.

In addition, a wire entrance 398 through which the wire 381 connected to the lighting device 36 is accessible may be defined in one edge of the cover protrusion 391.

The cover circumferential portion 392 may be disposed along a circumference of the cover protrusion 391. The cover circumferential portion 392 may provide a circumferential surface of the back cover 39, i.e., upper and lower ends and left and right both ends of the back cover 39.

A width of the cover circumferential portion 392 may be at least greater than a width of the second surface and a length of each of the upper bracket front surface portion 341 and the lower bracket front surface portion 351. Thus, the left and right side ends of the cover circumferential portion 392 are supported on the second surface 322*b* of the support member 32, and the upper and lower ends are respectively coupled to the upper bracket 34 and the lower bracket 35.

The cover circumferential portion 392 and the cover protrusion 391 may be connected by a cover connecting portion 394. The cover connecting portion 394 may be disposed to be inclined or rounded toward the front side as it goes from the cover circumferential portion 392 to the cover protrusion 391. A load applied to the cover protrusion 391 by the cover connecting portion 394 may be distributed.

A cover screw hole 397 may be defined in each of the upper end and lower end of the cover circumferential portion 392. The cover screw hole 397 may be a hole to which the screw 399 for mounting the back cover 39 is coupled, and a plurality of the cover screw holes 397 may be defined at regular intervals along upper and lower ends of the cover circumferential portion 392. In addition, the cover screw hole 397 may be defined at a position corresponding to each of the bracket screw holes 346 and 356 defined in the upper bracket 34 and the lower bracket 35.

In addition, a protrusion opening may be defined in the upper end of the cover circumferential portion 392, i.e., an upper end of the back cover 39. The protrusion opening 395 may be defined to allow the mounting protrusion 343 protruding from the upper bracket 34 to pass therethrough so as to mount the panel assembly 30. The protrusion opening may be defined to be pressed downward from the upper end of the back cover 39 and may be cut so that the mounting protrusion 343 passes therethrough. The protrusion openings 395 may be provided in corresponding numbers at positions corresponding to the mounting protrusion 343, and a plurality of protrusion openings 395 may be disposed at regular intervals along the upper end of the back cover 39.

In addition, a cover bent portion 396 may be disposed at a lower end of the cover circumferential portion 392, i.e., at the lower end of the back cover 39. The cover bent part 396 may be inserted into the lower cap decor 45 and may be in contact with the light supporter 37 supporting the lighting device 36. In addition, the heat of the lighting device 36 transferred through the light supporter 37 may be transferred to the entire back cover 39.

The cover bent portion 396 may extend vertically forward from the lower end of the cover circumferential portion 392 and may extend from a left end to a right end of the back cover 39. In addition, an extending length of the cover bent part 396 may extend to a length capable of being in contact with a bottom surface of the light supporter 37.

Figure 12:
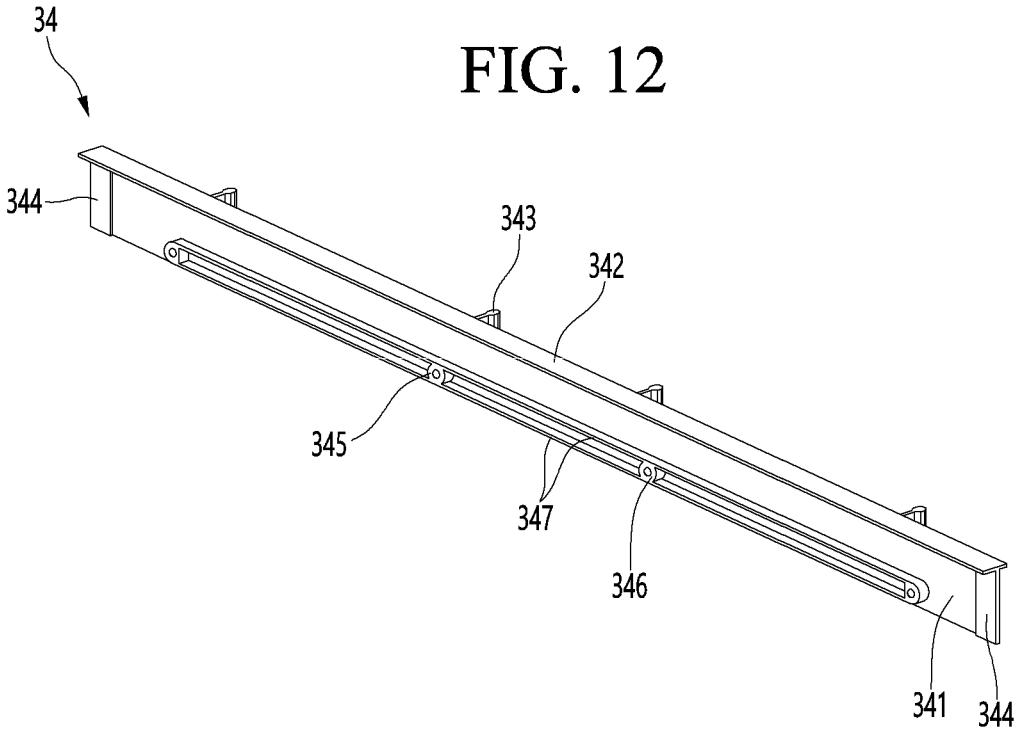
FIG. 12 is a front perspective view illustrating an upper bracket that is one component of the panel assembly.
Figure 13:
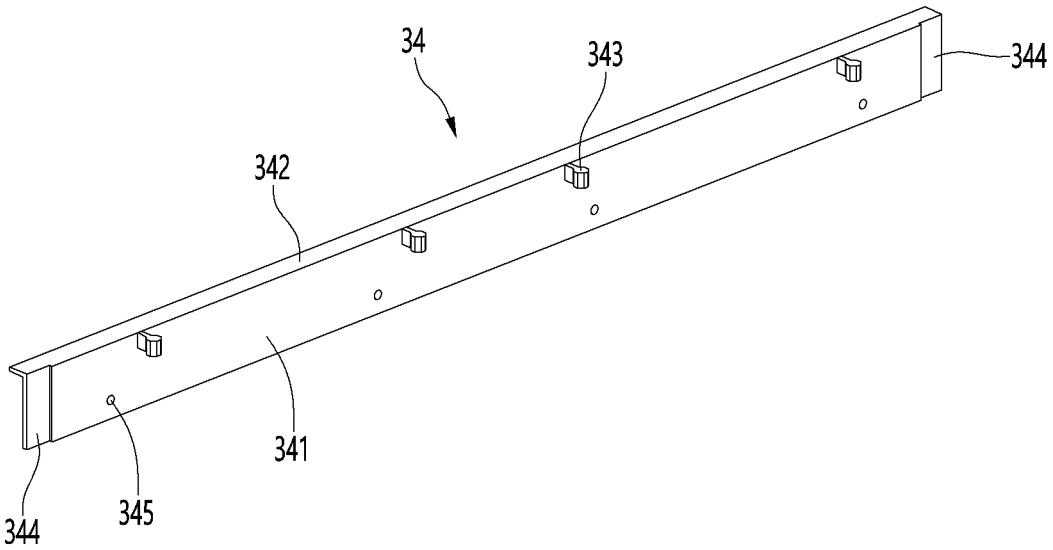
FIG. 13 is a rear perspective view of the upper bracket.
Figure 14:
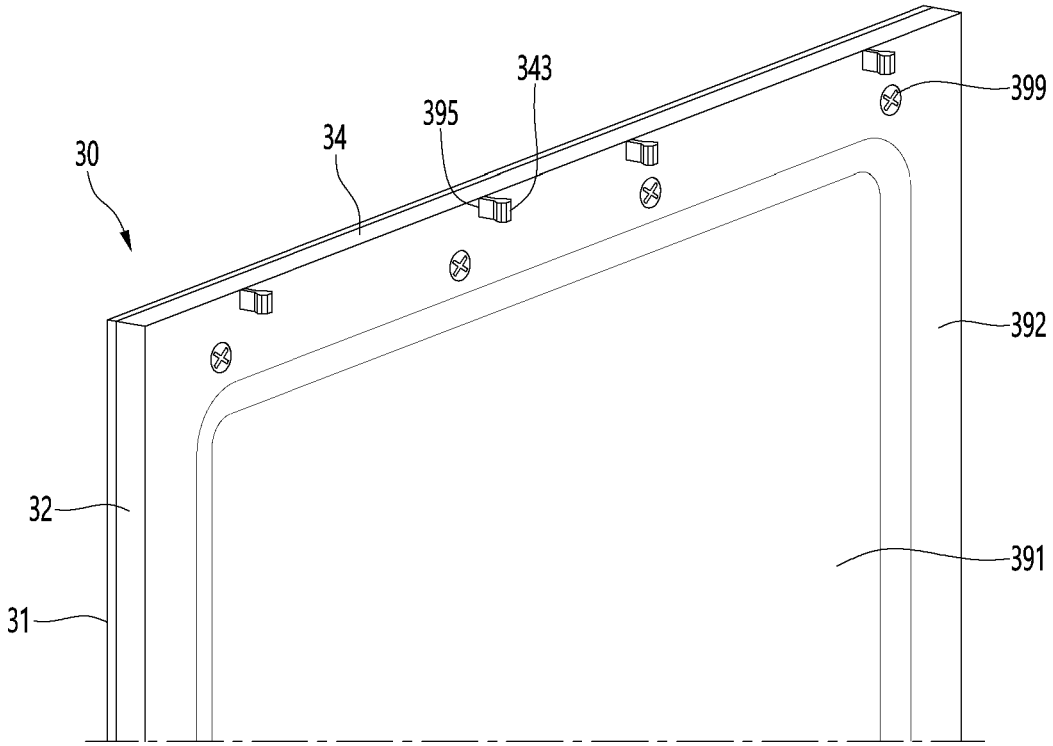
FIG. 14 is a partial enlarged view illustrating a shape of an upper portion of the panel assembly that is in a state in which the upper bracket is coupled.

FIG. 12 is a front perspective view illustrating the upper bracket that is one component of the panel assembly. FIG. 13 is a rear perspective view of the upper bracket. FIG. 14 is a partial enlarged view illustrating a shape of an upper portion of the panel assembly that is in a state in which the upper bracket is coupled.

As illustrated in the drawings, the upper bracket 34 may have a length corresponding to the right and left direction length of the panel assembly 30. In addition, the upper bracket 34 may include an upper bracket front surface portion 341 and an upper bracket top surface portion 342 as a whole.

The upper bracket front surface portion 341 may define a shape of a front surface of the upper bracket 34, may be disposed in parallel with the panel 31 and the light guide plate 33, and may extend in the vertical direction.

In addition, an upper side portion disposed to be stepped forward may be disposed on each of both left and right ends of the upper bracket front surface portion 341. The upper side portion 344 may be provided to have a height difference with respect to the front surface portion of the upper bracket and may be disposed in front of the upper bracket front surface portion 341.

The upper side portion 344 may have a thickness corresponding to a width of the bracket insertion space 325 and may be slidably inserted upward from a lower portion of the bracket insertion space 325.

A mounting protrusion 343 protruding backward may be disposed on a rear surface of the upper bracket front surface portion 341. The mounting protrusion 343 may be configured to mount the panel assembly 30 and may protrude from the upper bracket front surface portion 341 by a predetermined length to be coupled to the protrusion mounting part 431 of the upper cap deco 43.

In addition, a plurality of mounting protrusions 343 may be disposed at regular intervals along the upper bracket 34 and may be disposed at positions corresponding to the protrusion openings 395. In addition, the mounting protrusion 343 may protrude from an upper end of the rear surface of the upper bracket front surface portion 341. Thus, when the back cover 39 is mounted, the mounting protrusion 343 may protrude through the protrusion opening 395 of the back cover 39.

A plurality of lower bracket bosses 346 may be disposed on a front surface of the upper bracket front surface portion 341. The upper bracket bosses 346 may be used to couple the screws 399 thereto, and a lower bracket screw hole 345 to which the screw 399 is coupled may be formed at the center of the upper bracket boss 356. The upper bracket screw hole 345 may be defined through the upper bracket front surface portion 341 and may be defined at a position corresponding to the cover screw hole 397. Thus, when the back cover 39 is mounted, the screws 399 may be coupled to sequentially pass through the cover screw hole 397 and the upper bracket screw hole 345.

The upper bracket boss 346 may protrude forward and may protrude to be in contact with the rear surface of the light guide plate 33. Thus, when the upper bracket 34 is mounted, a protruding end of the upper bracket boss 346 may support the light guide plate 33 from the rear. That is, when the panel assembly 30 is assembled, the upper bracket 34 may support the upper end of the light guide plate 33 from the rear.

A support rib 347 for connecting the plurality of upper bracket bosses 346 may be disposed on the front surface of the upper bracket front surface portion 341. One pair of the support ribs 347 may be disposed in a vertical direction, and the plurality of the upper bracket bosses 346 may be disposed between a pair of the support ribs 347.

In detail, the support rib 347 at an upper portion of the pair of the support ribs 347 may extend to connect upper ends of the plurality of upper bracket bosses 346, and the support rib 347 at a lower portion of one pair of the support ribs 347 may extend to connect lower ends of the plurality of upper bracket bosses 346.

The support rib 347 may protrude with the same height as a protruding height of the upper bracket boss 346. Thus, when the panel assembly 30 is assembled, the support rib 358 may support the light guide plate 33 from the rear together with the upper bracket boss 346.

The upper bracket top surface portion 342 may be disposed on an upper end of the upper bracket front surface portion 341. The upper bracket top surface portion 342 may extend in a direction perpendicular to the upper bracket front surface portion 341.

In detail, the upper bracket top surface portion 342 may extend forward from the upper end of the upper bracket front surface portion 341. In addition, a front end of the upper bracket top surface portion 342 may extend to be in contact with the front surface portion 321 of the support member 32. In addition, both left and right ends of the upper bracket top surface portion 342 may be seated on the stepped upper end of the upper end of the side surface portion 322 of the support member 32.

Thus, the upper bracket 34 may be fixedly coupled to the upper end of the support member 32 and may be in the state of being fixed to the back cover 39 by the screw 399, and thus may restrain upward movement of the light guide plate 33 and may form the shape of a top surface of the panel assembly 30.

Figure 15:
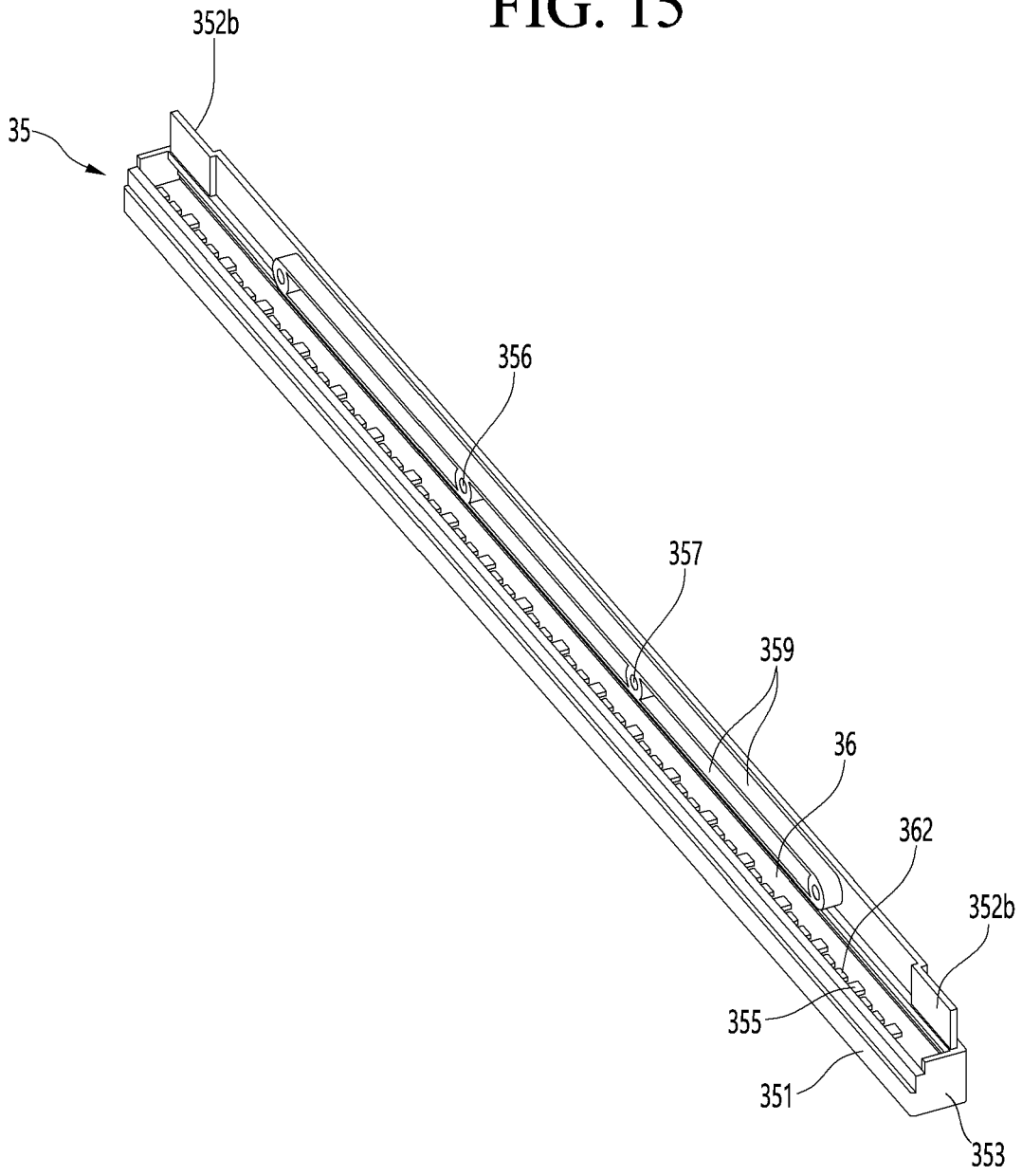
FIG. 15 is a perspective view in which a lower bracket, a lighting device, and a right supporter, which are components of the panel assembly, are coupled.
Figure 16:
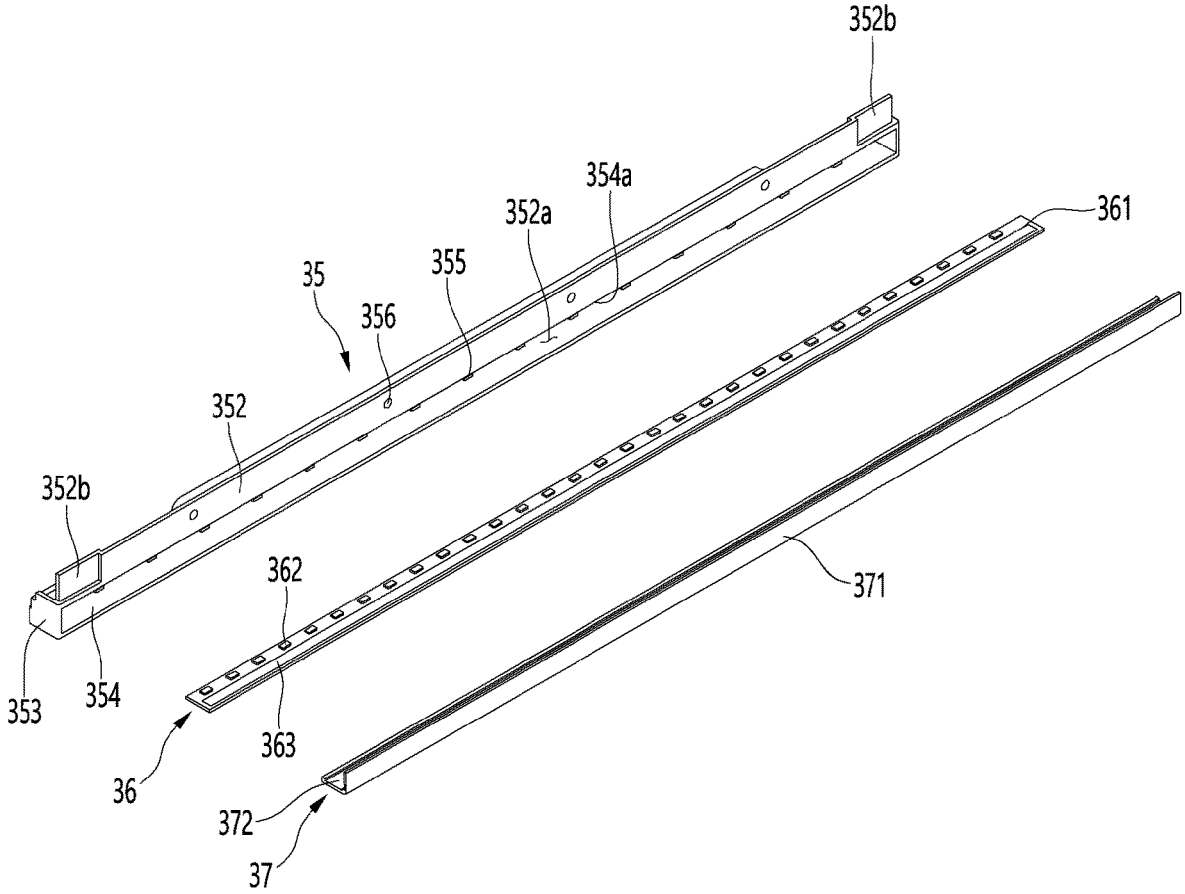
FIG. 16 is an exploded perspective view showing a coupling structure of the lower bracket, the lighting device, and the right supporter viewed from the rear.
Figure 17:
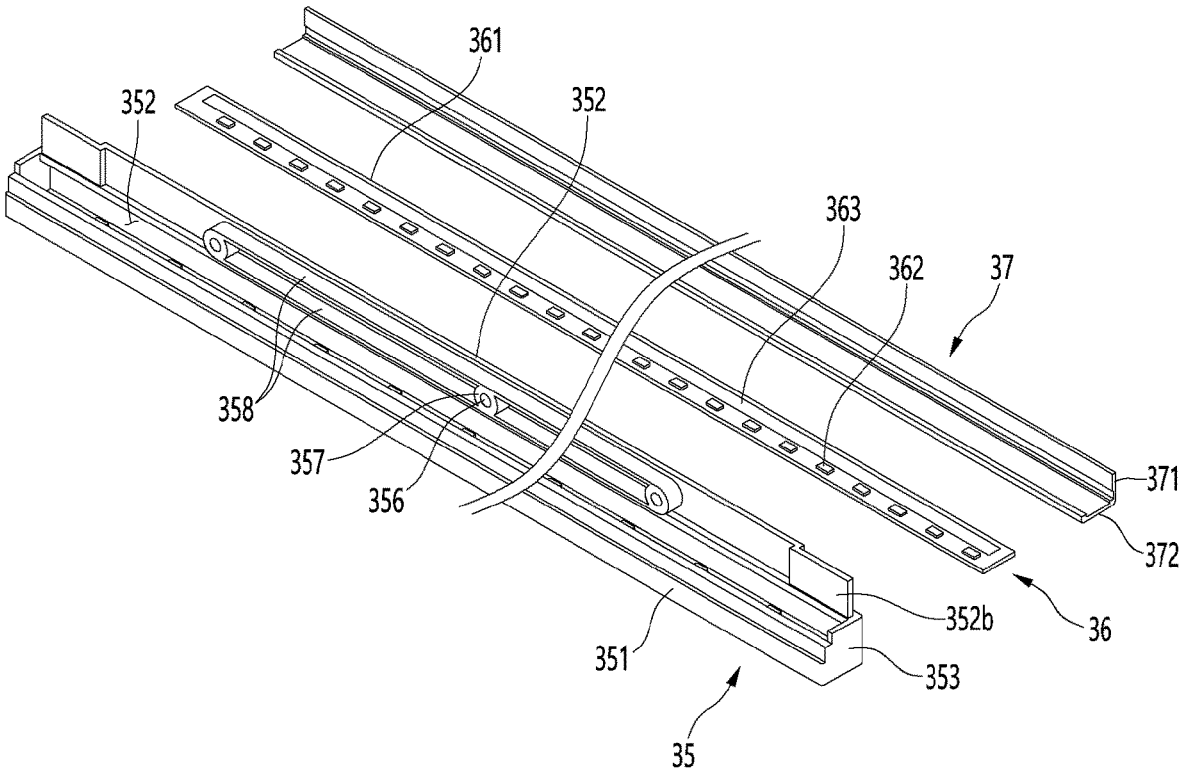
FIG. 17 is an exploded perspective view showing a coupling structure of the lower bracket, the lighting device, and the right supporter viewed from the rear.
Figure 18:
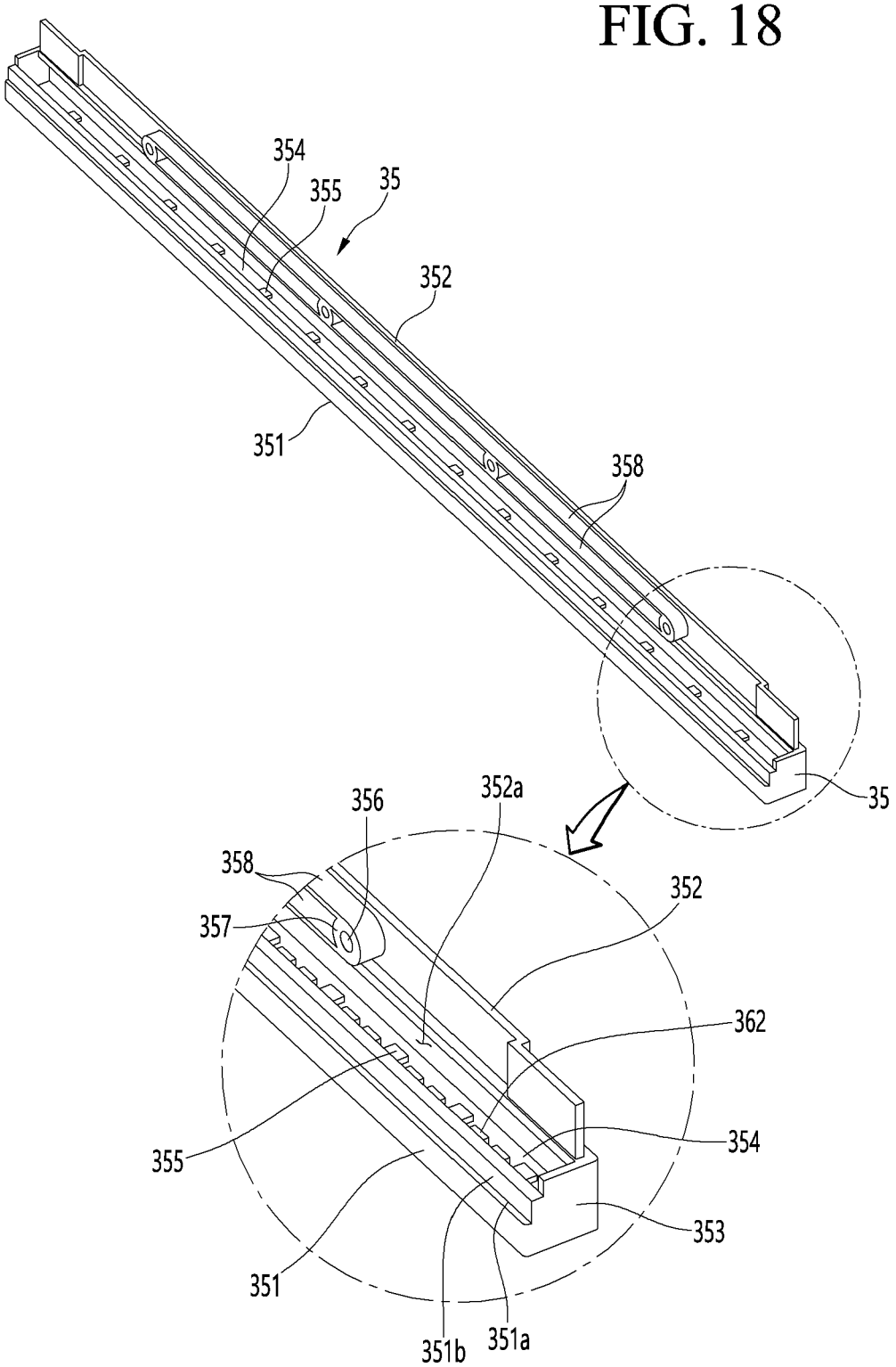
FIG. 18 is a front perspective view of the lower bracket.
Figure 19:
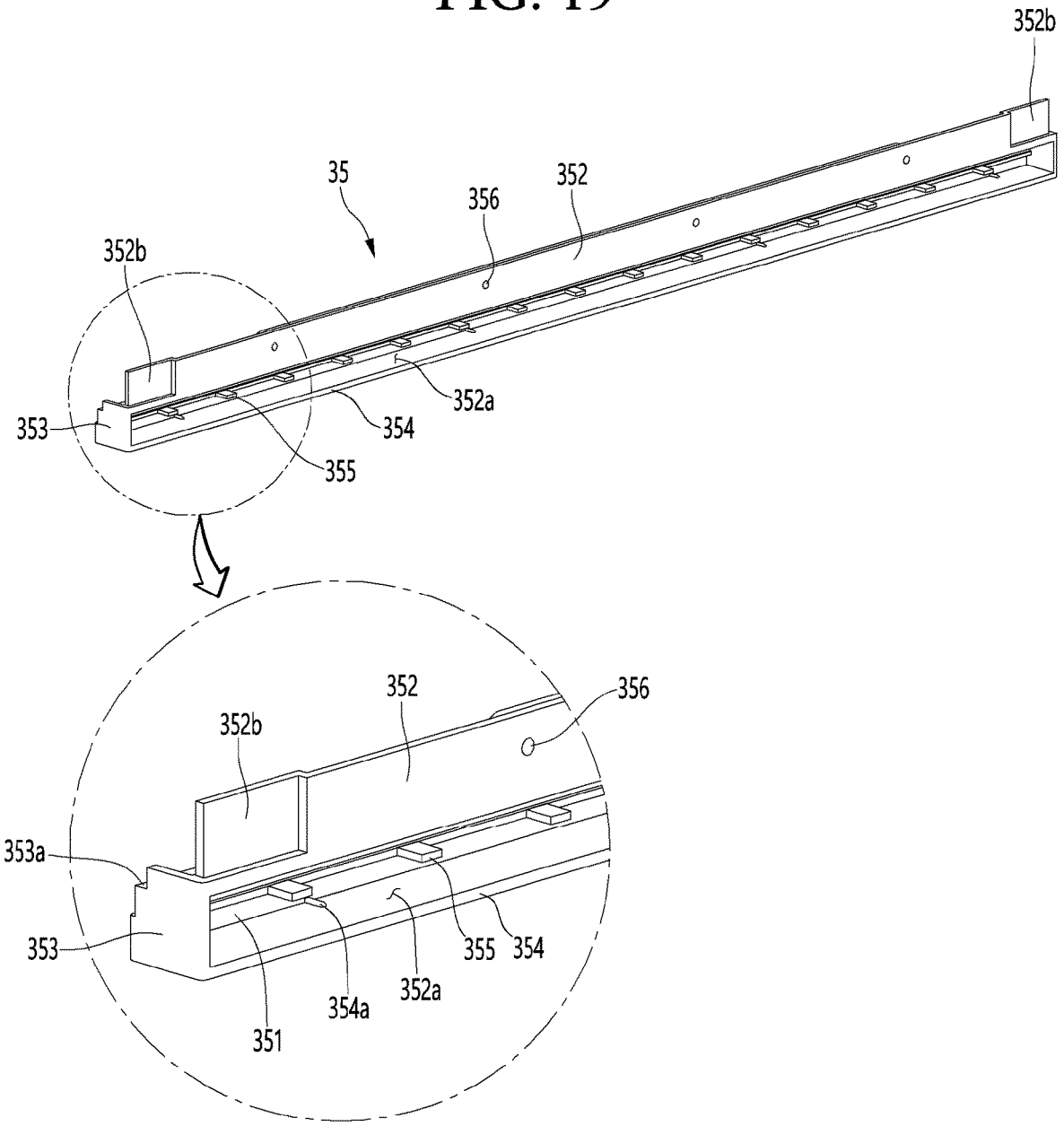
FIG. 19 is a rear perspective view of the lower bracket.

FIG. 15 is a perspective view in which the lower bracket, the lighting device, and the right supporter, which are components of the panel assembly, are coupled. FIG. 16 is an exploded perspective view showing a coupling structure of the lower bracket, the lighting device, and the right supporter viewed from the rear. FIG. 17 is an exploded perspective view showing a coupling structure of the lower bracket, the lighting device, and the right supporter viewed from the rear. FIG. 18 is a front perspective view of the lower bracket. FIG. 19 is a rear perspective view of the lower bracket.

As illustrated in the drawings, the lower bracket 35 may have a corresponding to the right and left direction length of the panel assembly 30. The lower bracket 35 may broadly include the lower bracket front surface portion 351, a lower bracket rear surface portion 352, a lower bracket side surface portion 353, and a lower bracket bottom surface portion 354.

The lower bracket front surface portion 351 form a shape of the front surface of the lower bracket 35 and may support the panel 31. A portion of the lower bracket front surface portion 351 may protrude below the panel 31 and may be inserted into the lower end of the door body 40, that is, the lower cap decoration 45 to fix the lower bracket 35.

The lower bracket front surface portion 351 may include a bracket stepped portion. The bracket stepped portion may include a first stepped portion 351*a* for supporting a lower end of the panel 31 and a second stepped portion 351*b* for supporting the panel 31 from the rear.

The first stepped portion 351*a* may be stepped rearward on the front surface of the lower bracket front surface portion 351, and the second stepped portion 351*b* may extend upward from the rear end of the first stepped portion 351*a*. In the state in which the panel 31 is mounted, the sealant 313 may be applied on the second stepped portion 351*b*, and thus the panel 31 may be firmly fixed.

The upper end of the second stepped portion 351*b* may be coupled to the lower end of the support member 32, and thus the front surface of the second stepped portion 351*b* and the front surface portion 321 of the support member 32 may be positioned on the same plane.

The second stepped portion 351*b* may support the panel 31, and simultaneously, may prevent the lighting device 36 or a lighting spot (which may also be referred to as light formation or a hot spot) generated by the lighting device 36 from being exposed.

That is, the second stepped portion 351*b* may protrude above an upper end of a light source of the lighting device 36 and may protrude with a set height to prevent the lighting device 36 from being exposed forward. The second stepped portion 351*b* may hide a region generated due to intensive light irradiation at the lower end of the light guide plate 33 and the lower end of the panel 31, which are very adjacent to the lighting device 36, to prevent a lighting spot from being formed on the panel 31. The second stepped portion 351*b* may be formed to be transparent or translucent, and as necessary, may have a specific color. Thus, the second stepped portion 351*b* may also be referred to as a cover portion.

A guide protrusion 351*c* protruding backward may be disposed on an inner surface of the lower bracket 35, and more particularly, on the lower bracket front surface portion 351. The guide protrusion 351*c* may be provided at the same height as the light guide plate support 355. In addition, the guide protrusion 351*c* may protrude backward between the light guide plate supports 355.

A protruding rear end of the guide protrusion 351*c* may be in contact with a front surface of the circumferential surface of the light source 362. When the lighting device 36 is mounted on the lower bracket 35, the guide protrusion 351*c* may support the lighting device 36 while being in contact with the side surface of the light source 362. Thus, when the lighting device 36 is mounted so that the guide protrusion 351*c* and the light source 362 are in contact with each other, the light source 362 may be vertically aligned below the light guide plate 33.

In addition, the lighting device 36 may be restricted by the light supporter 37 and the back cover 39 in a state in which the lighting device 36 is mounted at an accurate position. Thus, the light source 362 may be maintained in the aligned state, and the light emitted from the light source 362 may be irradiated to the lower end of the light guide plate 33 at the accurate position.

The lower bracket side surface portion 353 may form a side surface of the lower bracket 35 and may protrude above the lower bracket front surface portion 351. The lower bracket side surface portion 353 may protrude above the second stepped portion 351*b*, and thus a stepped portion of a lower end of the side surface of the support member 32 may be coupled to engage each other with the lower bracket front surface portion 351 and the lower bracket side surface portion 353.

The lower bracket rear surface portion 352 may be formed on a rear end of the lower bracket side surface portion 353. The lower bracket rear surface portion 352 may form a rear surface of the lower bracket 35 and may fixedly mount the lower bracket 35 on the support member 32. The lower bracket rear surface portion 352 may be formed in parallel to the panel 31 and the light guide plate 33 and may extend in a vertical direction. A rear surface portion of the lower bracket 35 may protrude above the lower bracket front surface portion 351 and the lower bracket side surface portion 353.

A lower side portion 352*b* stepped forward may be disposed on each of right and left side ends of the lower bracket rear surface portion 352. The lower side portion 352*b* may be stepped with the lower bracket rear surface portion 352 and may be positioned in the front of the lower bracket front surface portion 351.

The lower side portion 352*b* may be formed with a thickness corresponding to the width of the bracket insertion space 325 and may be slidably inserted upward from a lower portion of the bracket insertion space 325.

A plurality of lower bracket bosses 357 may be formed on the front surface of the lower bracket rear surface portion 352. The lower bracket bosses 357 may be used to couple the screws 399 thereto, and a lower bracket screw hole 356 to which the screw 399 is coupled may be formed at the center of the lower bracket boss 357. The lower bracket screw hole 356 may be formed through the lower bracket rear surface portion 352 and may be formed at a position corresponding to the cover screw hole 397. Thus, when the back cover 39 is mounted, the screws 399 may be coupled to sequentially pass through the cover screw hole 397 and the lower bracket screw hole 356.

The lower bracket boss 357 may protrude forward and may protrude to be in contact with the rear surface of the light guide plate 33. Thus, when the lower bracket 35 is mounted, a protruding end of the lower bracket boss 357 may support the light guide plate 33 from the rear. That is, when the panel assembly 30 is assembled, the lower bracket 35 may support the upper end of the light guide plate 33 from the rear.

A support rib 358 for connecting the plurality of lower bracket bosses 357 may be formed on the front surface of the lower bracket rear surface portion 352. One pair of the support ribs 358 may be disposed in a vertical direction, and the plurality of the lower bracket bosses 357 may be disposed between a pair of the support ribs 358.

In detail, the support rib 358 at an upper portion of a pair of the support ribs 358 may extend to connect upper ends of the plurality of lower bracket bosses 357, and the support rib 358 at a lower portion of one pair of the support ribs 358 may extend to connect lower ends of the plurality of lower bracket bosses 357.

The support rib 358 may protrude with the same height as a protruding height of the lower bracket boss 357. Thus, when the panel assembly 30 is assembled, the support rib 358 may support the light guide plate 33 from the rear with the lower bracket boss 357.

Thus, the lower bracket 35 may be fixedly coupled to the upper end of the support member 32 and may be in the state of being fixed to the back cover 39 by the screw 399, and thus may restrain downward movement of the light guide plate 33 and may form the shape of a bottom surface of the panel assembly 30.

A bracket opening may be formed in the lower bracket rear surface portion 352. The bracket opening 352*a* may extend from a left end of the lower bracket rear surface portion 352 to a right side end and may be disposed at a position facing the lower bracket front surface portion 351.

The bracket opening 352*a* may be positioned below the support rib 358. The bracket opening 352*a* may be formed to be opened in a rear surface of a space in which the lighting device 36 is mounted. The lower end of the bracket opening 352*a* may be positioned at the lower bracket bottom surface portion 354. Thus, the lighting device 36 may enter and exit through the bracket opening 352*a* and the right supporter 37 for supporting the lighting device 36 may also enter and exit therewith. The bracket opening 352*a* may be shielded by the back cover 39.

The lower bracket bottom surface portion 354 may form a bottom surface of the lower bracket 35 and may be connected to a lower end of the lower bracket front surface portion 351, a lower end of the lower bracket side surface portion 353, and a lower end of the lower bracket rear surface portion 352. The lower bracket bottom surface portion 354 may form a bottom surface of a space in which the lighting device 36 is mounted.

A bracket rib 354*a* supporting the lighting device 36 or the light supporter 37 from below may be disposed on the lower bracket bottom surface portion 354. The bracket rib 354*a* may extend backward from the lower bracket front surface portion 351 and may protrude upward to support the light supporter 37 on which the lighting device 36 is mounted.

A light guide plate support 355 protruding rearward may be formed on the lower bracket front surface portion 351. The plurality of light guide plate supports 355 may protrude rearward at a constant interval along the lower bracket front surface portion 351.

In this case, the light guide plate support 355 may extend to restrain the lighting device 36 from above. The light guide plate support 355 and the lower bracket bottom surface portion 354 may restrain the lighting device 36 from above and below to restrain upward and downward movement of the lighting device 36.

A top surface of the light guide plate support 355 may protrude to support a lower end of the light guide plate 33 and may protrude rearward at a height corresponding to the first stepped portion 351*a* of the bracket stepped portion.

The lighting device 36 may be provided within the lower bracket 35. The lighting device 36 may include a substrate 361 and the light source 362. The substrate 361 may be formed in a plate shape to be accommodated within the lower bracket 35 and may extend from one end of the lower bracket 35 to the other end. The plurality of light sources 362 may be arranged at a constant interval on the substrate 361.

The light source 362 may be disposed to emit light toward the lower end of the light guide plate 33. The light source 362 may be disposed to emit light toward the lower end of the light guide plate 33. The left side end and the right side end of the substrate 361 may be in contact with the lower bracket side surface portion 353 within the lower bracket 35 and may restrain right and left movement.

The light source 362 may be disposed in a forward biased position based on the center of the substrate 361. In this case, the light source 362 may be positioned below the lower end of the light guide plate 33 in a vertical direction, that is, may be positioned to face the lower end of the light guide plate 33.

A circuit 363 of the substrate 361 may be concentrated in a position biased to the rear based on the center of the substrate 361. The circuit 363 may be configured to operate the lighting device 36 and be disposed at a position biased to the rear side so as to face the light guide plate 33.

An example of the light source 362 may include an LED. The light source 362 may include an RGB LED for emitting light with various colors under control of the controller 13. That is, the light source 362 may emit light with various colors under control of the controller 13, and thus the panel 31 may glow with color set by the controller 13. According to color of the panel 31, a color of the outer appearance of the front surface of the refrigerator 1 may be determined.

The light source 362 may include an LED for emitting light with specific color other than the RGB LED and may include a combination of a plurality of LEDs for emitting light with different colors. For example, the plurality of light sources 362 may include red, green, and blue LEDs and may sequentially and repeatedly arranged. Under control of the controller 13, operations of the light sources 362 may be combined to cause the panel 31 to glow with desired color.

The light sources 362 may be mounted at a constant interval on the substrate 361 and an appropriate number of light sources 362 may be arranged to cause the panel 31 to glow with set brightness. For example, the light sources 362 may be arranged at an interval of 6.3 mm to 7.0 mm, brightness thereof may reach a target brightness of the panel 31, and an entire surface of the panel 31 may glow with uniform brightness equal to or greater than 80%. An interval between the light sources 362 may be smaller than the right and left width of the light guide plate support 355, and thus the light guide plate support 355 may be disposed between the light sources 362.

Elements 364 protruding downward may be further provided on the bottom surface of the substrate 361.

The right supporter 37 may be provided within the lower bracket 35. The right supporter 37 may support the lighting device 36 within the lower bracket 35. The right supporter 37 may dissipate heat generated by the lighting device 36 by conduction.

Figure 20:
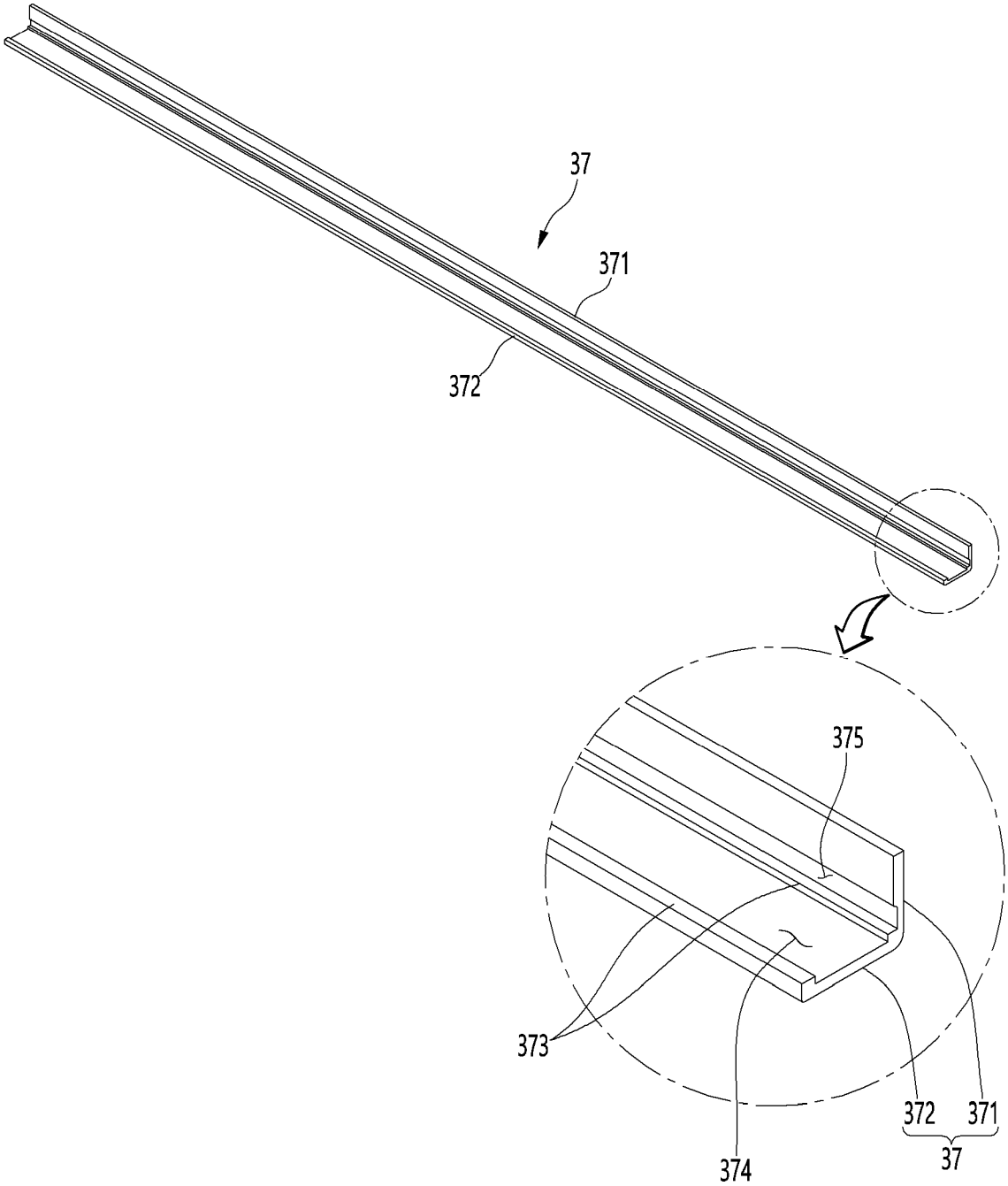
FIG. 20 is a perspective of the light supporter.

FIG. 20 is a perspective of the light supporter.

As illustrated in the drawing, the light supporter 37 may be made of a metal material. For example, the light supporter 37 may be made of an aluminum material having high thermal conductivity. The right supporter 37 may be formed of a metal material and may be molded by extrusion to have the same cross-sectional structure in a longitudinal direction, and may be formed with a size to enter and exit through the bracket opening 352*a*.

The right supporter 37 may include a first supporting portion 372 for supporting the lighting device 36 and a second supporting portion 371 in contact with the back cover 39.

The first supporting portion 372 may be disposed on the lower bracket bottom surface portion 354 within the lower bracket 35. Here, a bottom surface of the first supporting portion 372 may be disposed parallel to the lower bracket bottom surface portion 354 and may have a width corresponding to the lower bracket bottom surface portion 354. A front end of the first supporting portion 372 may extend up to a position corresponding to a front end of the substrate and may be in contact with the lower bracket front surface portion 351.

In addition, the first supporting portion 372 may be supported from the lower side by the bracket rib 354*a*. A substrate support 373 supporting front and rear ends of the substrate 361 may be disposed on front and rear ends of the first supporting portion 372. The substrate support 373 may be disposed along the front and rear ends of the first supporting portion 372 to protrude upward. Thus, the first supporting portion 372 may have a structure that is directly supported along the substrate 361, and heat generated during an operation of the lighting device 36 is transmitted to the light supporter 37 through the substrate supporting portion 373.

A supporter recess 374 may be formed on the first supporting portion 372. The supporter recess 374 may be recessed between one pair of the substrate supports 373 and may provide a space in which devices of the bottom surface of the substrate 361 are accommodated when the substrate 361 is supported by the first supporting portion 372.

The second supporting portion 371 may extend upward from the rear end of the first supporting portion 372. The second supporting portion 371 may extend perpendicularly to the first supporting portion 372 and the lower bracket bottom surface portion 354. The second supporting portion 371 may shield at least a portion of the bracket opening 352*a* while the light supporter 37 is mounted on the lower bracket 35. The second supporting portion 371 may have a corresponding size and shape to shield the bracket opening 352*a*.

A substrate accommodation groove 375 may be formed on the lower end of the second supporting portion 371. The substrate accommodation groove 375 may be defined along a longitudinal direction of the second supporting portion 371 and may be recessed to accommodate the rear end of the substrate 361. In the state in which the substrate 361 is mounted on the right supporter 37, the rear end of the substrate 361 may be in close contact with an internal side of the substrate accommodation groove 375.

The second supporting portion 371 may extend upward and be exposed to the outside through the bracket opening 352*a*. A rear surface of the second supporting portion 371 may be provided in a flat shape, and when the back cover 39 is mounted, the second supporting portion 371 may be in surface contact with the back cover 39. Thus, the heat of the lighting device 36 conducted to the light supporter 37 may be transferred to the back cover 39 and may be dissipated through the back cover 39.

The lighting device 36 and the light supporter 37 may be accessible through the bracket opening 352*a* while the lower bracket 35 is mounted. Thus, when only the back cover 39 that shields the bracket opening 352*a* is removed, the lighting device and the light supporter 37 may be easily assembled and disassembled.

Hereinafter, in the state in which the panel assembly 30 is assembled, the coupling state of the lower end of the panel assembly 30 in addition to the inside of the lower bracket 35 will be described in more detail with reference to the drawings.

Figure 21:
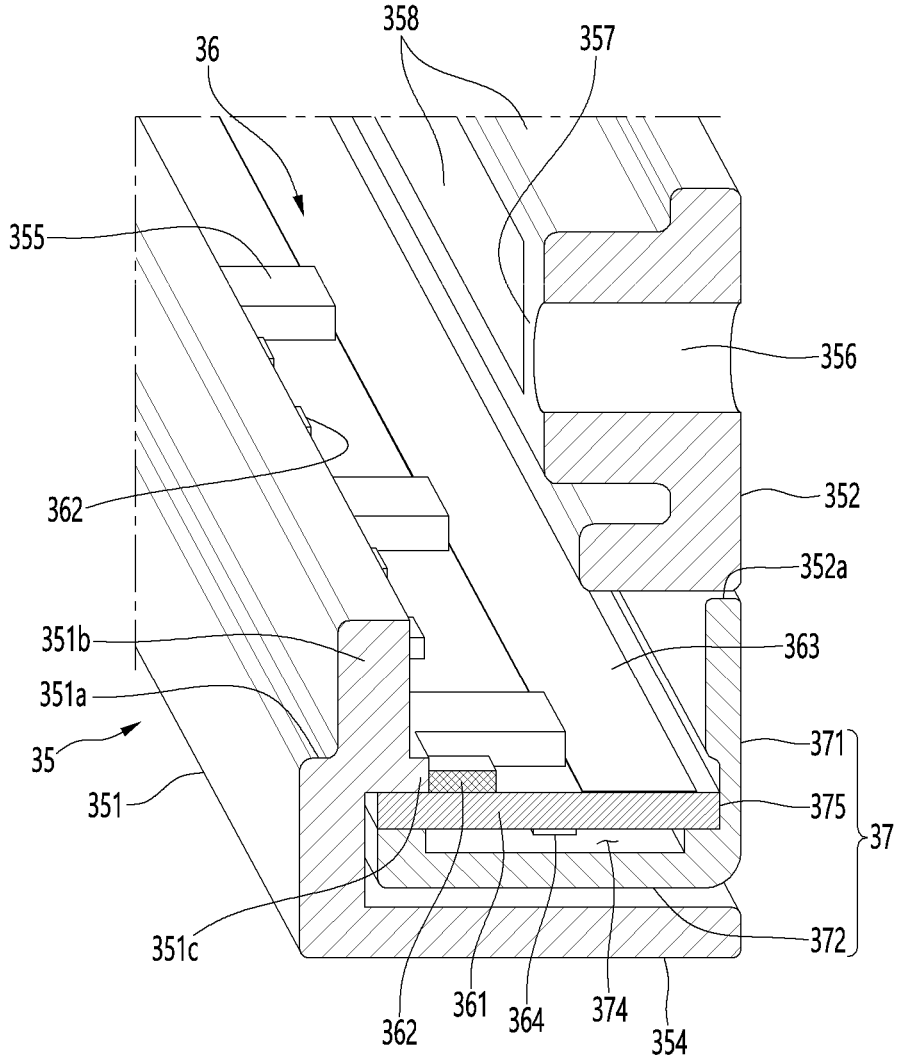
FIG. 21 is a cutaway perspective view taken along line XXI-XXI' of FIG. 15.
Figure 22:
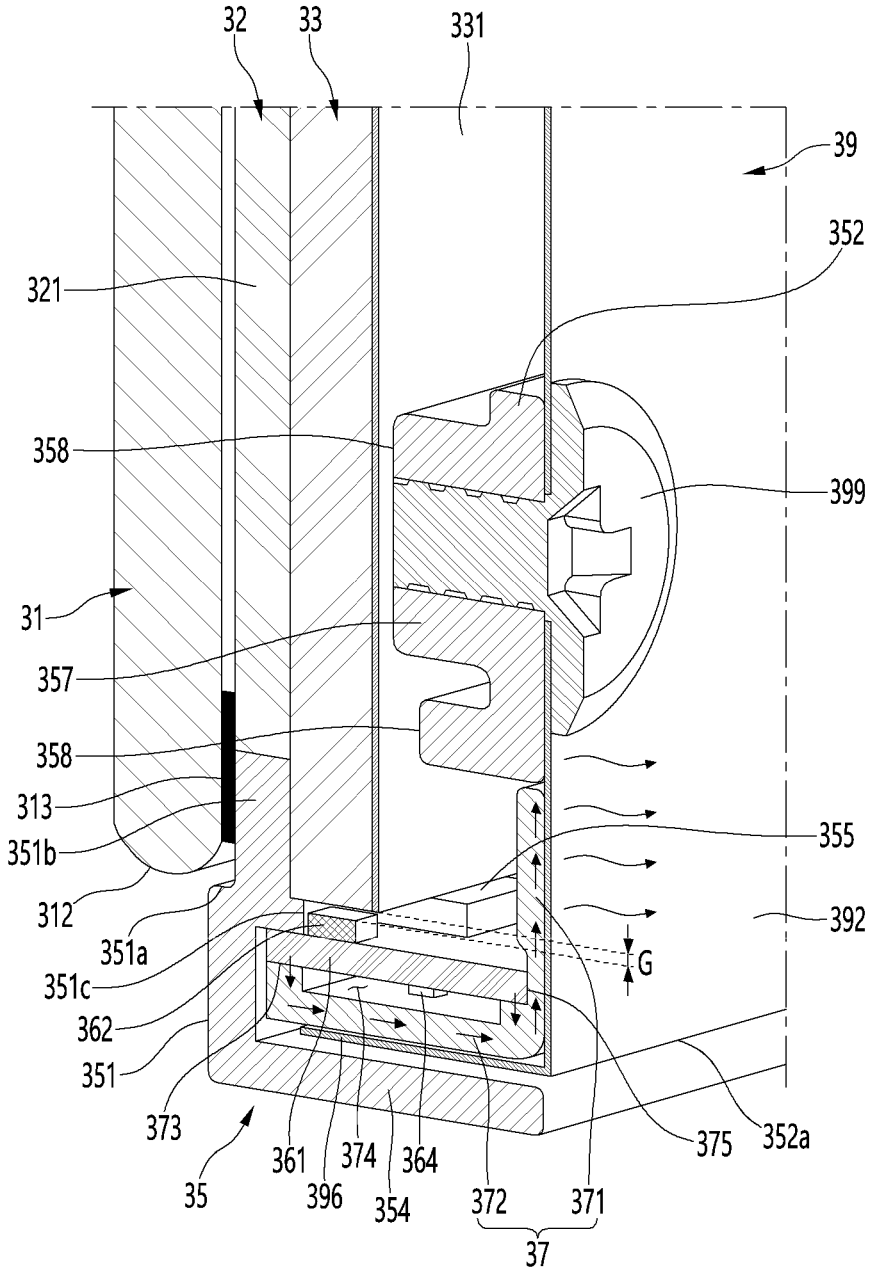
FIG. 22 is a cutaway perspective view taken along line XXII-XXII' of FIG. 4.

FIG. 21 is a cutaway perspective view taken along line XXI-XXI' of FIG. 15. Also, FIG. 22 is a cutaway perspective view taken along line XXII-XXII' of FIG. 4.

As illustrated in the drawings, in the state in which the panel assembly 30 is assembled, the panel 31 may adhere to the front surface of the support member 32 by the sealant 313, and the light guide plate 33 may be fixedly mounted so as to be in contact with the rear surface of the support member 32. The lower bracket 35 may be coupled to the lower end of the support member 32. The back cover 39 may be coupled to the lower bracket by a screw 399 so that the back cover 39 defines a rear surface of the panel assembly 30.

The lighting device 36 may be supported by the light supporter 37 inside the lower bracket 35. The lighting device 36 may be mounted inside the lower bracket 35 in the state of being coupled to the light supporter 37 and thus be restricted inside the lower bracket 35. Thus, the mounted state of the lighting device 36 may be maintained even in the repeated opening/closing operation.

In detail, in the lighting device 36, the front end of the substrate 361 may be in contact with the lower bracket front surface portion 351, and the rear end of the substrate 361 may be in contact with the substrate accommodation groove 375 of the second supporting portion 371 so as to be restricted in movement in a front and rear direction.

The bottom surface of the substrate 361 may be in contact with the substrate support 373 of the first supporting portion 372, and the top surface of the substrate 361 may be in contact with the bottom surface of the light guide plate support 355 protruding backward so as to be restricted in movement in a vertical direction.

A plurality of light guide plate supports 355 may be disposed at regular intervals and may protrude from a height at which the lighting device 36 is in contact with the top surface of the substrate 361. The light guide plate supports 355 may be disposed between a plurality of light sources 362 provided in the lighting device 36. Thus, the entire top surface of the substrate 361 may be restrained by the plurality of light guide plate supports 355.

Both left and right side surfaces of the substrate 361 may be in contact with the lower bracket side surface 353 inside the lower bracket 35 so that the movement in the left and right direction is restricted.

As described above, in the state in which the panel assembly 30 is assembled, the lighting device 36 may be prevented from moving in any direction because the movement is restricted in all directions, i.e., in front, rear, up and down, and left and right directions, and thus, the initial mounted position thereof may be maintained.

Thus, the light source of the lighting device 36 may also be maintained at a set position, and light may be irradiated from the lower end of the light guide plate 33 toward the light guide plate 33. The light of the light source 362 may be always irradiated at a certain position, and thus, the light source 362 may be ensured so that the panel 31 glow with constant brightness.

In addition, the lower end of the light guide plate 33 may be supported by the light guide plate support 355. The light guide plate 33 may be slidably inserted into the side surface portion 322 of the support member 32 to maintain a state of being in contact with the light guide plate support 355 due to its own weight in the panel assembly 30.

The top surface of the light guide plate support 355 may be disposed to be higher than the top surface of the light source 362, and thus, even during the opening and closing operation of the door 20 of the light guide plate 33 and the expansion and contraction of the light guide plate 33, the top surface of the light guide plate support 355 may not be in contact with the light source 362. That is, a set interval G may be maintained between the lower end of the light guide plate 33 and the light source 362. In this case, the set interval G may be designed in consideration of an angle of the light irradiated from the light source 362 and may be defined to be, for example, about 0.4 mm.

As described above, the lighting device 36 may be maintained in the fixed state, and a distance between the light guide plate 33 and the light source 362 may also be maintained at a set distance, and thus, the light irradiated from the light source 362 may be incident into the light guide plate 33 at a designed angle. Thus, the light irradiated from the light source 362 may be effectively irradiated toward the light guide plate 33, and the light reflected through the light guide plate 33 may allow the panel 31 to glow with set brightness.

In the state in which the panel assembly 30 is assembled, the back cover 39 may be coupled to the lower bracket 35 by fastening the screws 399. In this case, the cover bent portion 396 of the lower end of the back cover 39 may be inserted into the bracket opening 352*a*.

In detail, the cover bent portion 396 may be inserted between the bottom surface of the light supporter 37 and the bottom surface of the lower bracket 354. Here, a thickness of the cover bent portion 396 may be provided to correspond to a height of the bracket rib 354*a*.

Thus, in the state in which the back cover 39 is mounted, the cover bent portion 396 may surface-contact the entire bottom surface of the first supporting portion 372, and the lower end of the cover circumferential portion 392 of the back cover 39 may surface-contact the entire rear surface of the second supporting portion 371.

Thus, the back cover 39 may be in contact with the light supporter 37 on the maximum area, and the heat conducted from the lighting device 36 to the light supporter 37 may be effectively conducted to the back cover 39.

That is, the heat generated during the operation of the lighting device 36 may be conducted to the light supporter 37 through the substrate support 373, and the heat conducted to the light supporter 37 may be conducted to the back cover 39 that is in contact with each of the first supporting portion 372 and the second supporting portion 371. Here, the heat conduction to the back cover 39 that is in contact with the entire rear surface and the bottom surface of the light supporter 37 may be effectively performed, and the heat conducted to the back cover 39 may be dissipated through the back cover 39 defining the entire rear surface of the panel assembly 30.

Particularly, the back cover 39 may not be exposed to a side of the user, and due to the recessed shape of the cover protrusion 391 of the back cover 39, a space may be defined between the rear surface of the panel assembly 30 and the front surface of the body plate 41 to realize more effective heat dissipation.

Hereinafter, a process of assembling the panel assembly 30 having the above structure will be described in more detail with reference to the drawings.

Figure 23:
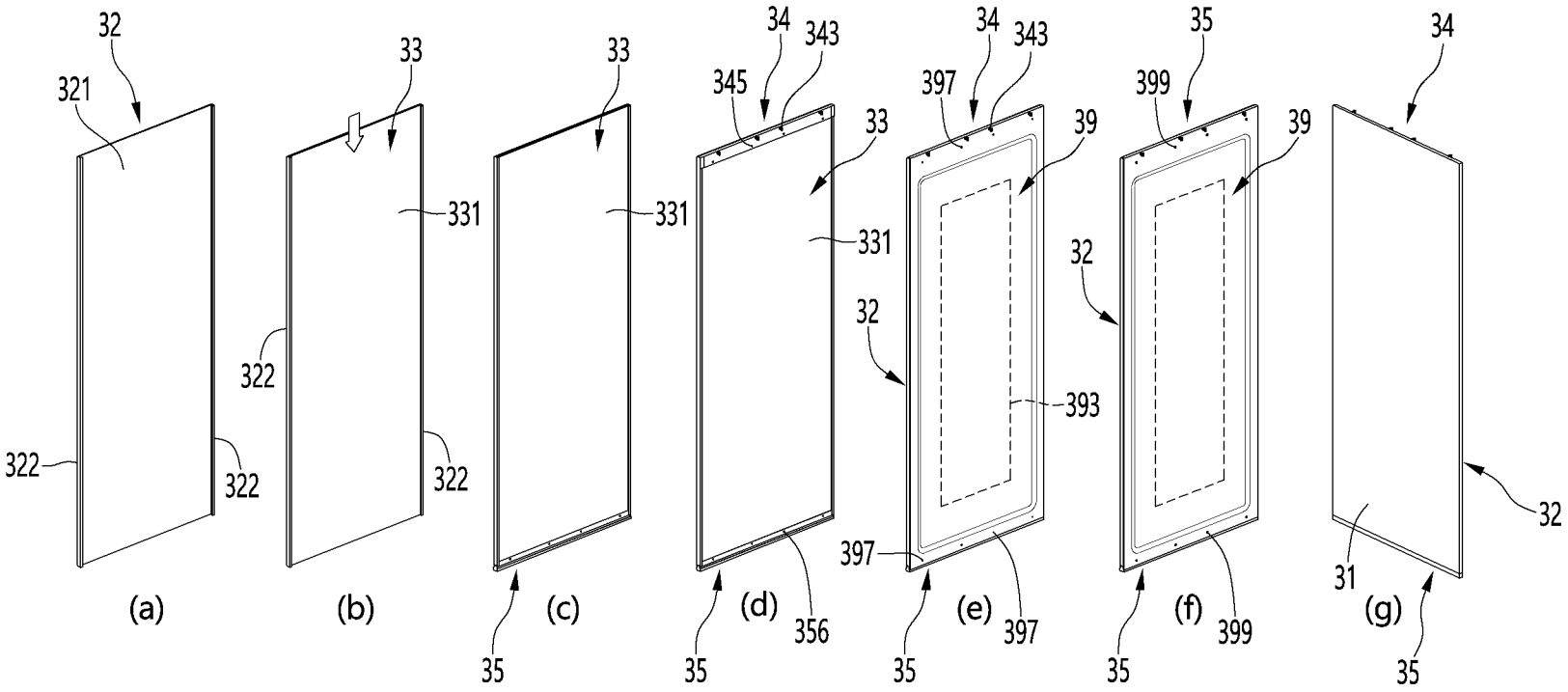
FIG. 23 is a view sequentially illustrating a process of assembling the panel assembly.

FIG. 23 is a view sequentially illustrating a process of assembling the panel assembly.

As illustrated in the drawings, the support member 32 is molded first to assemble the panel assembly 30. For example, the support member 32 may be extrusion-molded and may be made of a transparent or translucent material capable of transmitting light. In addition, the support member 32 may be disposed so that the front surface portion 321 faces forward. [(a) of FIG. 23]

In the state in which the support member 32 is disposed, the light guide plate 33 may be mounted to the support member 32. The light guide plate 33 may be mounted on the support member 32 in a state in which a reflective layer 331 is disposed on a rear surface of the light guide plate 33, and a reflective member 332 is disposed on a top surface and both left and right sides of a circumferential surface except for a bottom surface of the light guide plate 33.

In this case, both left and right ends of the light guide plate 33 may be fixed to the side surface portions 322 disposed on both the left and right sides of the support member 32, respectively. That is, the light guide plate 33 may be inserted into the light guide plate insertion space 324 defined in the side surface portion 322. The light guide plate 33 may move in the vertical direction, and both the left and right ends of the light guide plate 33 may be slidably inserted into the light guide plate insertion space 324 to restrict the light guide plate 33.

In this case, the front surface of the light guide plate 33 may be in contact with the rear surface of the front surface portion 321. [(b) of FIG. 23]

In the state in which the light guide plate 33 is mounted on the support member 32, a lower bracket 35 may be mounted on a lower end of the support member 32. The lower bracket 35 may be assembled with the lighting device 36 and the light supporter 37 mounted therein. Alternatively, if necessary, the lighting device 36 and the light supporter 37 may be assembled to the lower bracket 35 while the lower bracket 35 is mounted on the support member 32.

The lower bracket 35 may be coupled to the lower end of the support member 32, and lower side portions 352*b* disposed at both the left and right ends of the lower bracket rear surface portion 352 may be inserted into the bracket insertion space 325. In addition, the side surface portion 322 of the lower bracket 35 and the front surface portion 321 of the lower bracket 35 may be coupled to the stepped shape of the side surface portion 322 and the front surface portion 321 of the support member 32 and thus may be primarily fixed.

Particularly, when the lower bracket 35 is mounted, the front surface portion 321 of the support member 32 and the front surface portion 351 of the lower bracket may be disposed on the same plane. In addition, the side surface portion 322 of the support member 32 may be disposed on the same plane as the lower bracket side surface portion 353.

In a state in which the lighting device 36 and the light supporter 37 are mounted inside the lower bracket 35, the lighting device 36 may be disposed at a set position, and the light source 362 may be disposed at a position facing the lower end of the light guide plate 33.

In a state in which the lighting device 36 and the light supporter 37 are mounted inside the lower bracket 35, the lower end of the light guide plate 33 may be seated on the light guide plate support 355, and the lower end of the light guide plate 33 and the light source 362 may be maintained at a set interval. [(c) of FIG. 23]

The upper bracket 34 may be mounted on the upper end of the support member 32. The upper bracket 34 may be inserted into the bracket insertion space 325 in which upper side portions 344 disposed at both ends of the front side of the bracket 321 are opened to a lower side of the support member 32.

In addition, in a state in which the upper bracket 34 is coupled to the upper end of the support member 32, both left and right ends of the upper bracket top surface portion 342 may be coupled to an upper end of the side surface portion 322 of the stepped support member 32. The upper bracket 34 may have a structure that is inserted into the upper end of the support member 32 so as to be primarily fixed. In addition, the upper bracket 34 may define a top surface of the panel assembly 30 in a state of being mounted on the support member 32.

The upper bracket 34 and the lower bracket 35 may be mounted regardless of an order thereof, but, due to the characteristic in structure in which the light guide plate 33 is supported by the lower bracket 35, the lower bracket 35 may be mounted first. [(d) of FIG. 23]

In a state in which the upper bracket 34 and the lower bracket 35 are inserted into the support member 32 so as to be primarily fixed, the back cover 39 may be mounted. The back cover 39 may be in contact with the upper bracket 34, the lower bracket 35, and the side surface portions 322 disposed on both the left and right sides of the support member 32 to define the rear surface of the panel assembly 30.

When the back cover 39 is mounted, the cover protrusion 391 of the back cover 39 may protrude toward the light guide plate 33, and the buffer member 393 disposed on the cover protrusion 391 may be in contact with the rear surface of the light guide plate 33, i.e., the reflective layer 331.

When the back cover 39 is mounted, left and right both ends of the cover circumferential portion 392 of the back cover 39 may be in contact with the side surface portion 322 of the support member 32. In detail, both left and right ends of the back cover 39 may be supported on a second surface 322*b* of the back cover 39.

In addition, an upper end of the cover circumferential portion 392 of the back cover 39 may be in contact with a rear surface of the upper bracket 34, and a lower end of the cover circumferential portion 392 may be in contact with a rear surface of the lower bracket 35. Here, the cover screw holes 397 of the back cover 39 may be aligned with bracket screw holes 345 and 356 defined in the upper bracket 34 and the lower bracket 35.

In addition, when the back cover 39 is mounted, the cover bent portion 396 disposed at a lower end of the back cover 39 may be inserted into the bracket opening 352*a* and be inserted between a bottom surface of the light supporter 37 and the lower bracket bottom surface portion 354. In addition, the back cover 39 may shield the bracket opening 352*a* and be in contact with a second supporting portion 371 of the light supporter 37. [(e) of FIG. 23]

In a state in which the back cover 39 is disposed, an operator may fix the back cover 39 by coupling the screw 399. The screw 399 may be coupled along the upper bracket 34 and the lower bracket 35 to restrict upper and lower ends of the back cover 39.

In detail, a plurality of screws 399 may be coupled to sequentially pass through the cover screw holes 397 and the bracket screw holes 345 and 356. Through the coupling of the screw 399, the upper bracket 34 and the lower bracket 35 may be firmly coupled to the back cover 39 and thus may be firmly coupled or maintained with respect to the support member 32, the upper bracket 34, and the lower bracket 35.

Due to the coupling of the screw 399, the support ribs 347 and 359 may press the light guide plate 33 from the rear. That is, the upper bracket 34 and the lower bracket 35 may press and support the light guide plate 33 from the rear to prevent the light guide plate 33 from moving in the front and rear direction.

In addition, when the screw 399 is coupled, the buffer member 393 attached to the back cover 39 may also support the light guide plate 33 from the rear and may stably press and support most of the area including the center of the light guide plate 33 in the state of being in surface contact with the light guide plate 33. Thus, an impact applied to the light guide plate 33 when the door 20 is opened and closed may be alleviated, and the light guide plate 33 may be pressed and supported from the rear to more effectively prevent the light guide plate 33 from moving in the front and rear direction.

In addition, when the back cover 39 is completely fixed and mounted, the back cover 39 may be in surface contact with the rear surface of the light supporter 37, i.e., the second supporting portion 371, and thus, the heat of the lighting device 36 may be in a state capable of being dissipated through the back cover 39. [(f) of FIG. 23]

In a state in which the back cover 39 is completely fixed and mounted, the panel 31 may be finally mounted on the front surface of the support member 32, that is, the front surface portion 321. The panel 31 may be supported by the front surface portion 321 and a portion of the front surface of the lower bracket 35. In addition, the panel 31 may have a structure in which a rear surface thereof is attached to the support member and the lower bracket 35 so that the entire front surface thereof is exposed.

For this, the sealant 313 may be applied around the rear surface of the panel 31, and the panel 31 may adhere to the support member 32 and the lower bracket 35 by the sealant 313. Of course, if necessary, the sealant 313 may be applied to the entire surface of the panel 31 instead of the circumferential surface or may be partially provided at a plurality of points.

The sealant 313 may be formed of a transparent or translucent material, and thus, the light reflected forward from the light guide plate 33 may pass through the sealant 313 to be illuminated to an end of the panel 31.

When the bonding of the panel 31 is completed, the assembly of the panel assembly 30 is completed. Since the panel is mounted in the last stage of the assembly process, the heavy panel 31 may be more easily managed. In addition, since movement and processing of the panel 31 may be minimized to prevent the panel 31 from being damaged. In addition, since the panel 31 is assembled last, handling of other components under the assembly may be easy. [(g) of FIG. 23]

If the disassembly of the panel assembly 30 is required, it may be disassembled in a reverse order of the above-described process.

In addition, replacement or maintenance of the lighting device 36 may be required during the operation of the panel assembly 30. Hereinafter, a structure for the maintenance of the lighting device 36 will be described.

Figure 24:
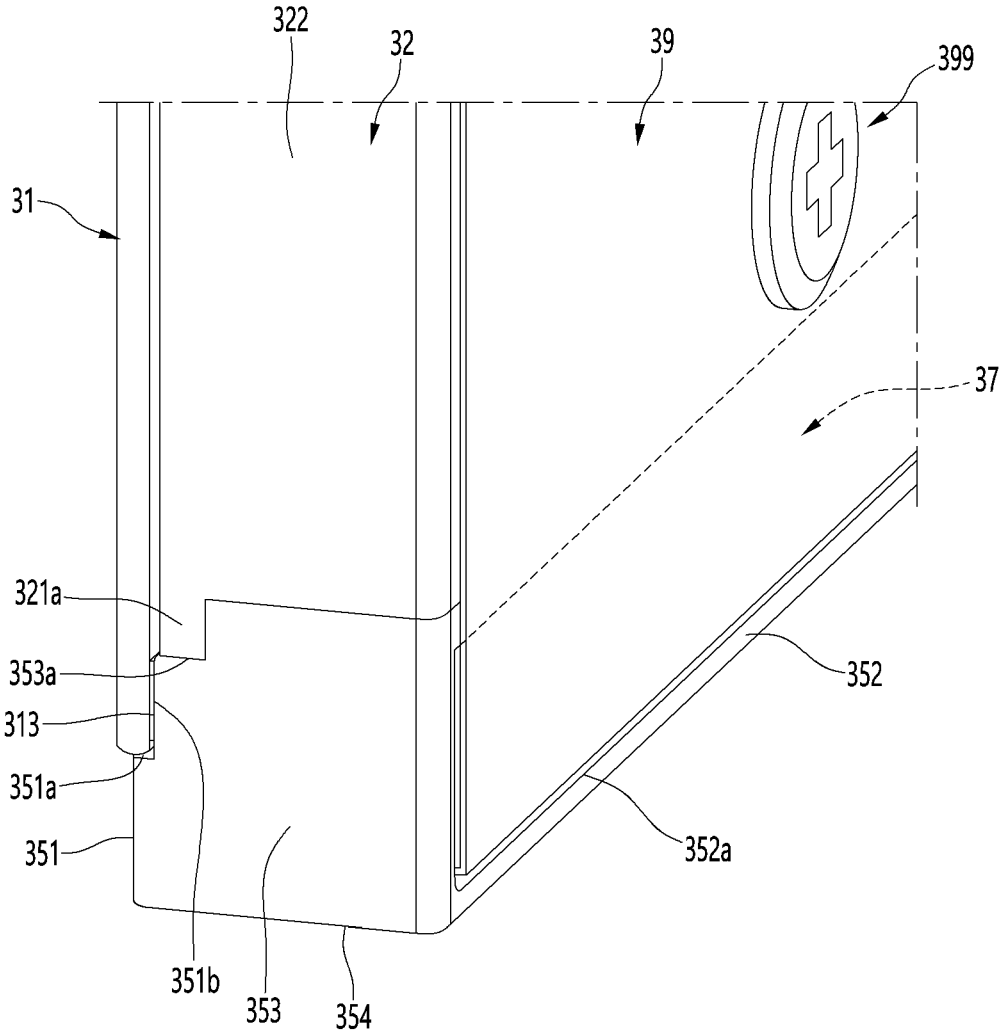
FIG. 24 is a partial perspective view illustrating a coupling structure of the light supporter and the back cover.
Figure 25:
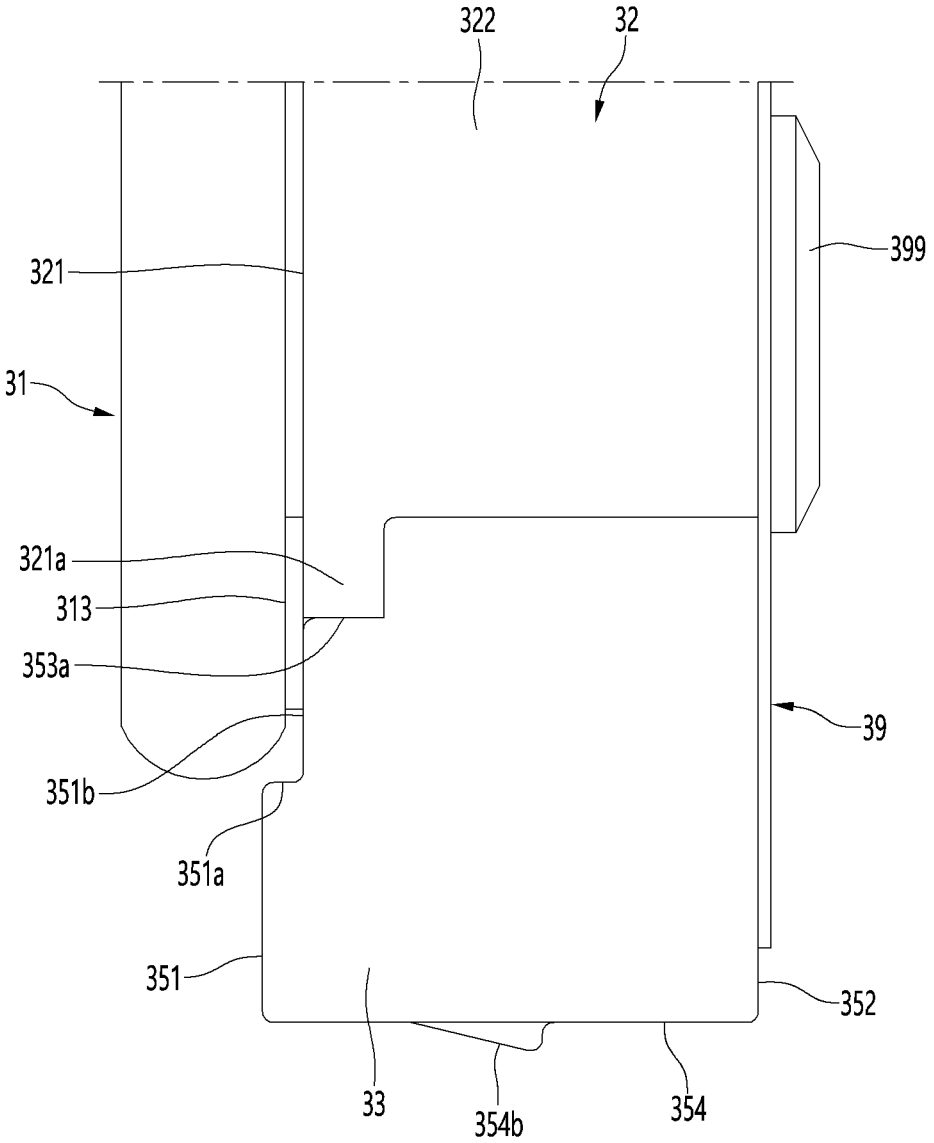
FIG. 25 is a partial side view illustrating a structure of a lower end of the side surface of the panel assembly.
Figure 26:
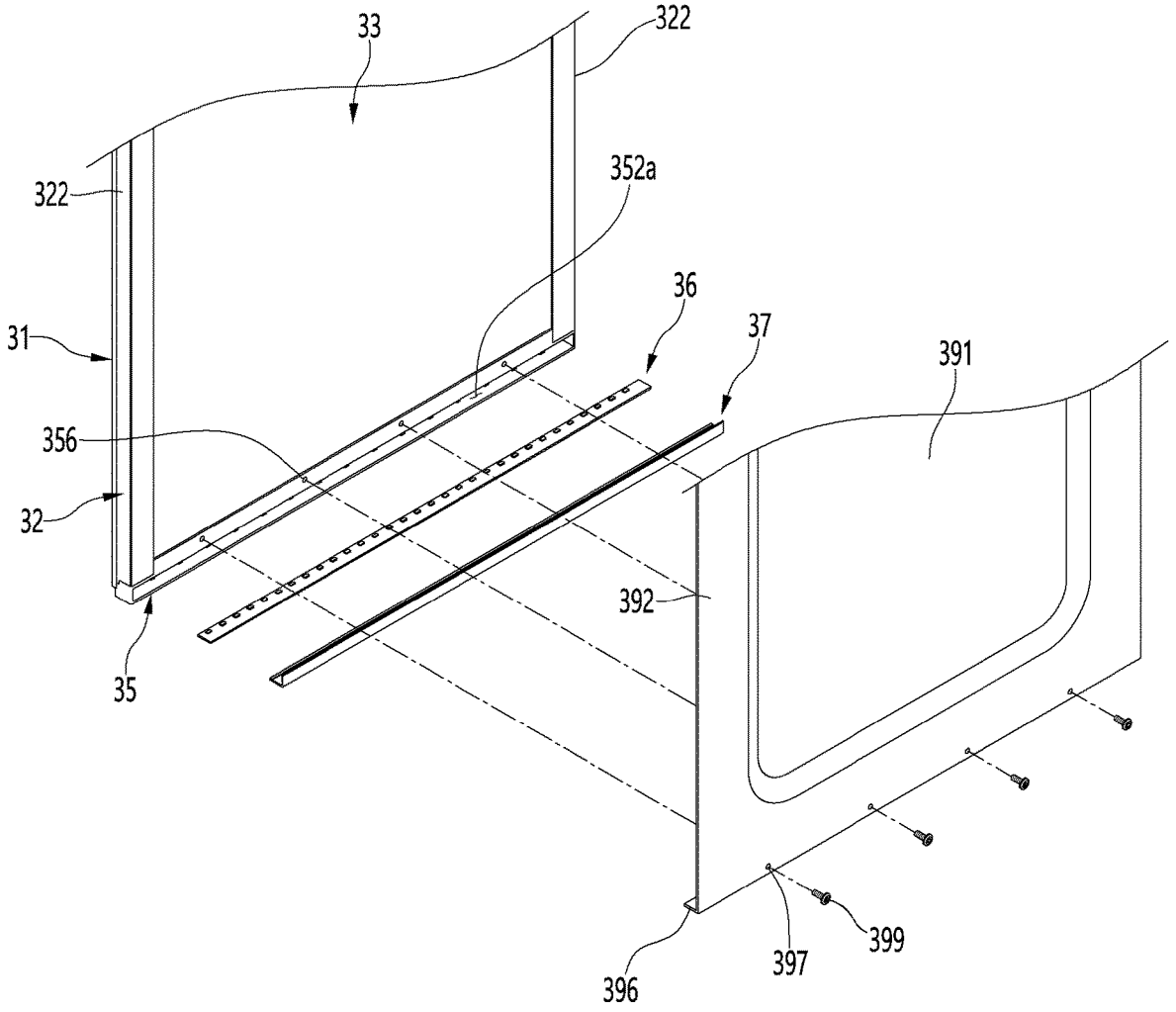
FIG. 26 is an exploded perspective view illustrating processes of assembling and disassembling the lighting device of the panel assembly.

FIG. 24 is a partial perspective view illustrating a coupling structure of the light supporter and the back cover. FIG. 25 is a partial side view illustrating a structure of a lower end of the side surface of the panel assembly. FIG. 26 is an exploded perspective view illustrating processes of assembling and disassembling the lighting device of the panel assembly.

As illustrated in the drawings, in a state in which the panel assembly is assembled, the front panel may be mounted on a front surface of the support member, and the lower bracket may be provided on a lower end of the support member.

In this case, the left and right side surfaces of the lower bracket 35 may be coupled to the lower end of the side surface portion 322 of the stepped support member 32. That is, a lower stepped portion 321*a* of the lower end of the support member 32 and a lower bracket stepped portion 353*a* of the lower bracket 35 may be coupled to each other. Therefore, the lower bracket 35 and the support member 32 may be firmly coupled to each other to ensure that the lower bracket 35 and the lighting device 36 inside the lower bracket 35 are aligned in place.

In addition, in the state in which the back cover 39 is mounted, the back cover 39 may shield the bracket opening 352*a*. Also, the back cover 39 may be in contact with the light supporter 37 so that heat generated during the operation of the lighting device 36 is transferred to the back cover 39 through the light supporter 37, and thus, the heat may be dissipated through the back cover 39.

The back cover 39 may define the entire rear surface of the panel assembly 30 and be made of a metal material to effectively dissipate the heat conducted from the lighting device 36. Particularly, when the door 20 is vertically disposed, and a handle of the lower door 20 is disposed on an upper end of the door 20, the handle and the lighting device 36 may be adjacent to each other. However, the heat generated in the lighting device 36 may be dissipated through the back cover 39, and thus, the user may not feel the heat even when the user operates the lower door 20.

When some of the plurality of light sources 362 provided in the lighting device 36 are damaged while the refrigerator 1 is in use, brightness of the panel 31 may be abnormal. Therefore, an immediate action of the lighting device 36 may be required.

For the maintenance of the lighting device 36, the operator may separate the panel assembly 30 from the door body 40 and then loosens the screw 399 to separate the back cover 39.

When the back cover 39 is separated, the bracket opening 352*a* may be exposed, and the light supporter 37 inside the bracket opening 352*a* may also be exposed. The operator may take out the light supporter 37 and the lighting device 36 through the bracket opening 352*a* and may perform the maintenance of the lighting device 36. If necessary, it may be replaced with a new lighting device 36, and after the work is completed, the lighting device 36 and the light supporter 37 may be mounted again to the lower bracket 35, and the back cover 39 may be mounted and fixed again.

As described above, the lighting device 36 may be easily replaced through the simple separation of the back cover 39, and if necessary, the light guide plate 33 may also be replaced by simply separating the upper bracket 34 and the lower bracket 35 after separating the back cover 39.

Hereinafter, the operations of the refrigerator 1 and the panel assembly 30 having the above structures will be described in more detail with reference to the drawings.

Figure 27:
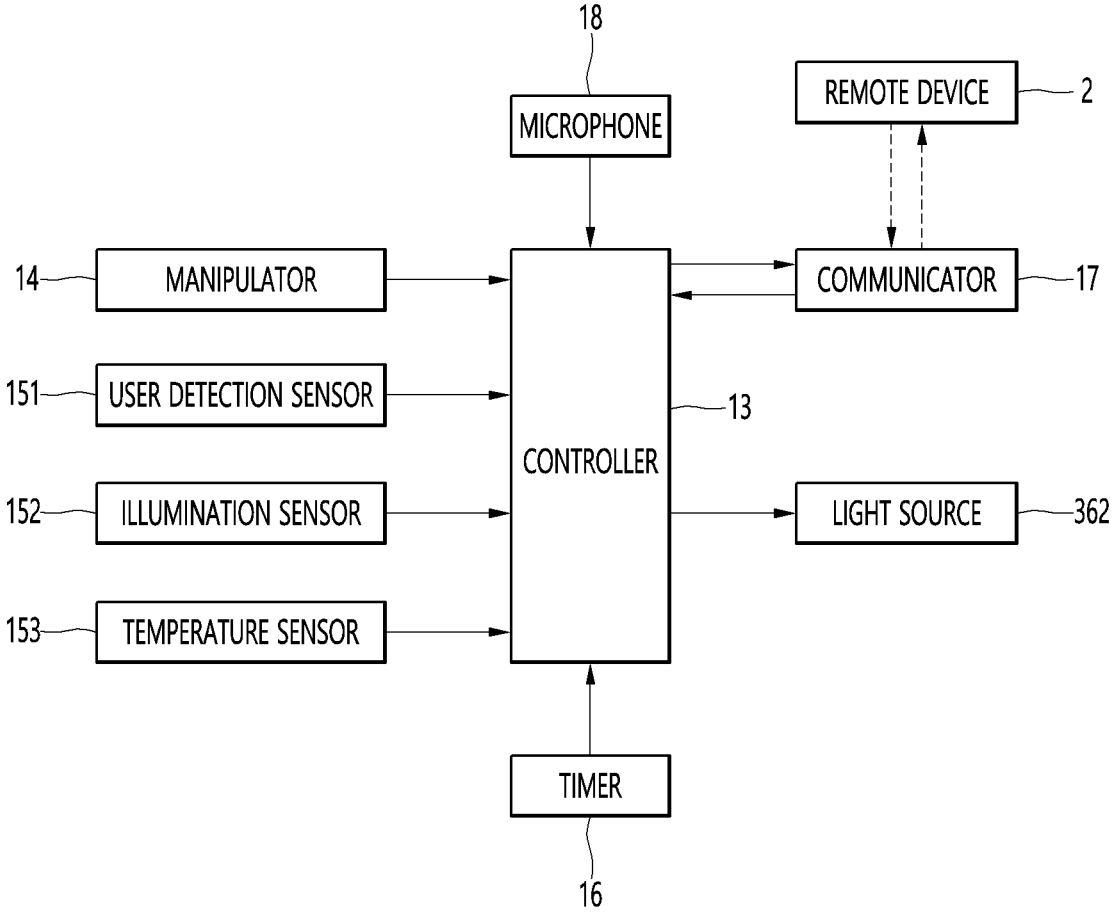
FIG. 27 is a block diagram illustrating a flow of a control signal of the refrigerator.
Figure 28:
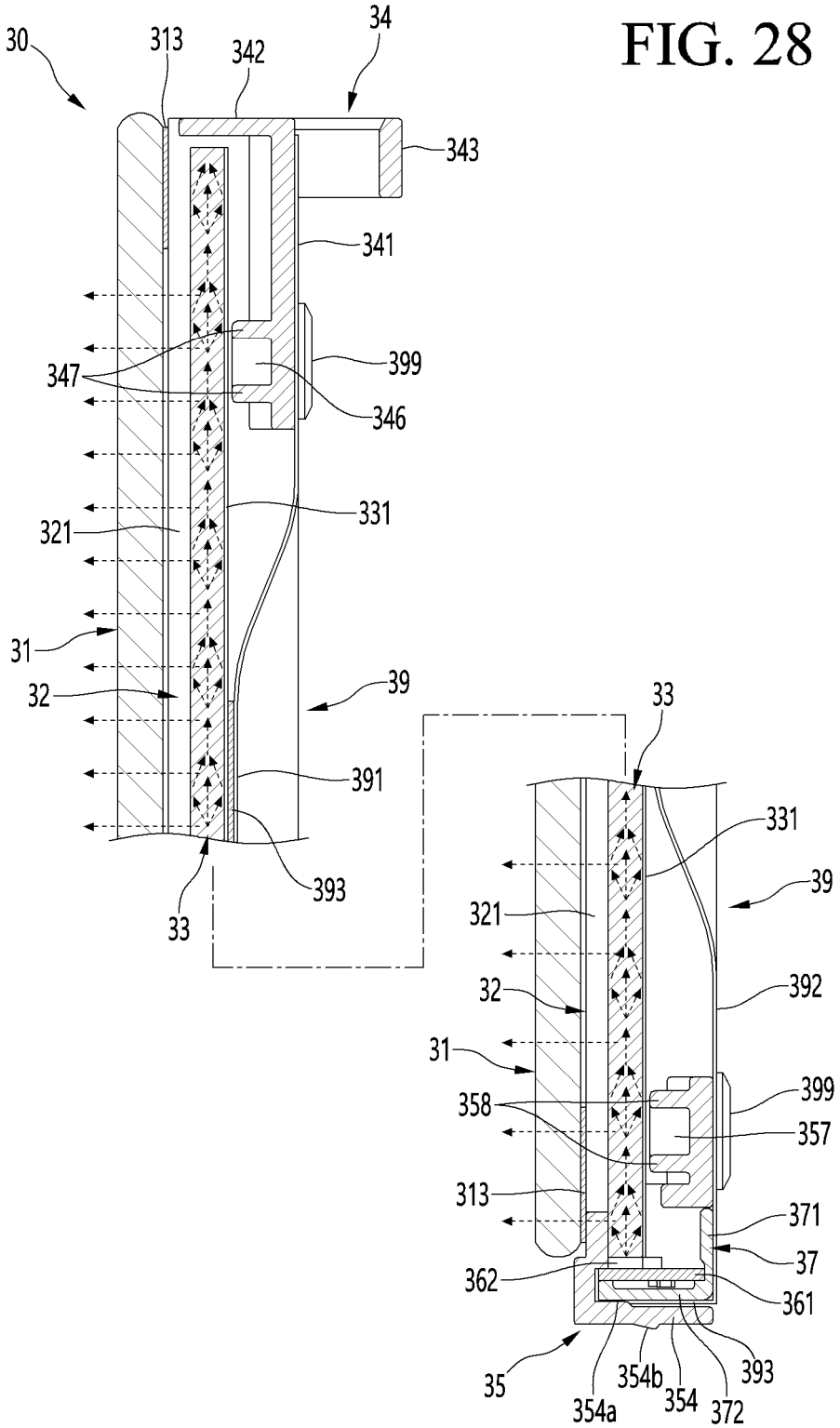
FIG. 28 is a vertical cross-sectional view illustrating an emission state of the panel assembly.
Figure 29:
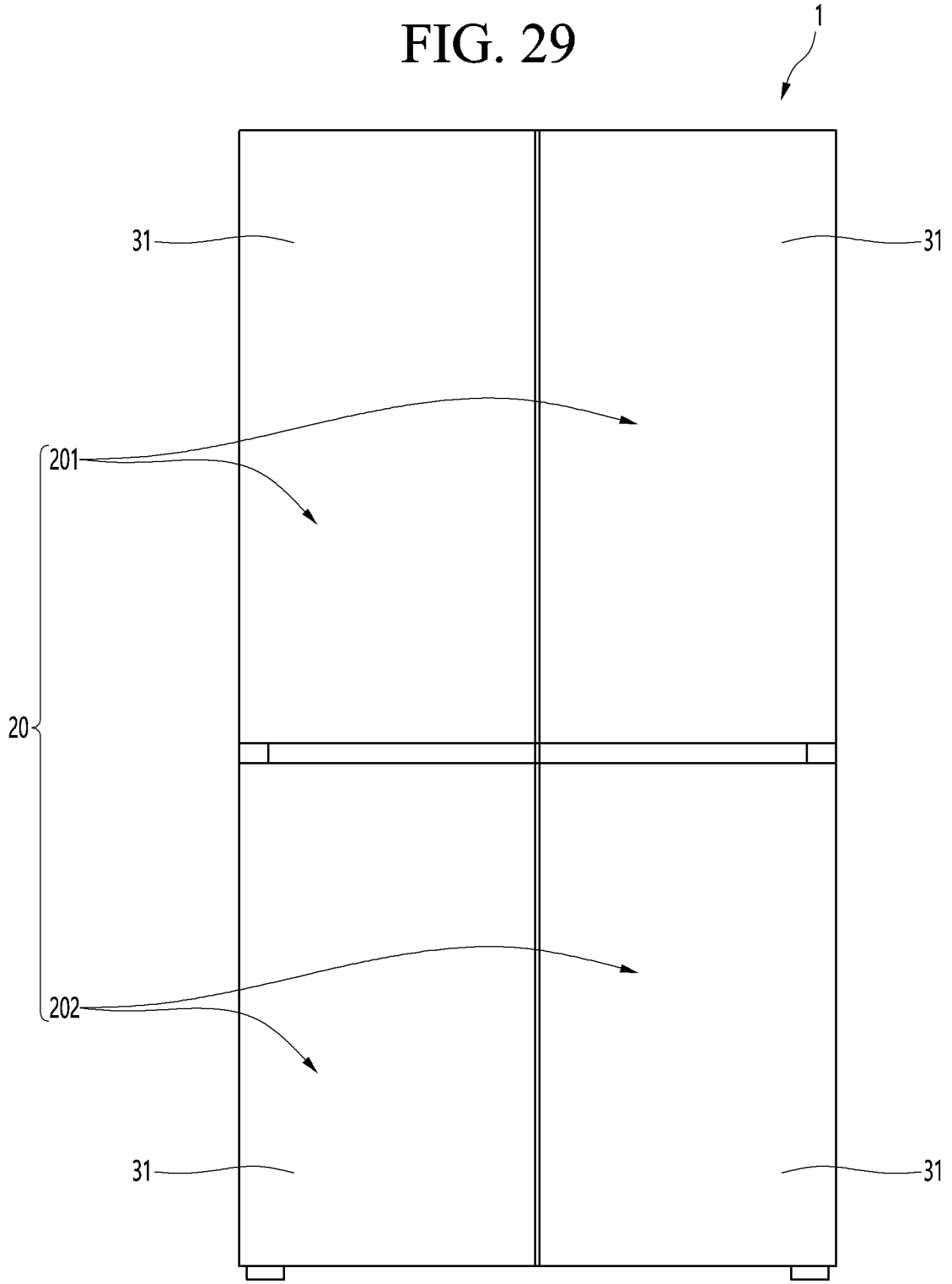
FIG. 29 is a front view illustrating an outer appearance of a front surface of a refrigerator in a state in which the lighting device of the refrigerator is turned off.

FIG. 27 is a block diagram illustrating a flow of a control signal of the refrigerator. FIG. 28 is a vertical cross-sectional view illustrating an emission state of the panel assembly. FIG. 29 is a front view illustrating an outer appearance of the front surface of the refrigerator in a state in which the lighting device of the refrigerator is turned off. FIGS. 30 to 33 are front views illustrating the outer appearance of the front surface of the refrigerator in a state in which the lighting device of the refrigerator is turned on.

As illustrated in the drawings, in the refrigerator 1 according to an embodiment of the present disclosure, a front surface of the door 20 may glow via an operation of the lighting device 36. The front surface of the door 20 may be turned on or off and may glow with any one of a plurality of colors under control of the controller 13.

The operation of the lighting device 36 may be performed by manipulation of a manipulator 14 of a user. The manipulator 14 may be disposed at one side of the refrigerator 1, and for example, may be disposed at one side of the cabinet 10. Needless to say, as necessary, the manipulator 14 may be included in the door 20 or manipulation may be input by touching and manipulating the panel 31. That is, the user may directly manipulate the manipulator 14 to set an operation of the lighting device 36 and may turn on or off the lighting device 36.

The user may set the overall operation state of the lighting device 36, such as an operation time and an operation condition of the lighting device 36 and emission color of the light source 362 through manipulation of the manipulator 14. As necessary, the manipulator 14 may be configured as a display for information display and manipulation.

The lighting device 36 may also be manipulated and set through a remote device 2 spaced apart from the refrigerator 1. The refrigerator 1 may communicate with the remote device 2 through a communicator 17 connected to a controller 13, and the user may manipulate an operation of the lighting device 36 through the remote device 2.

The communicator 17 may communicate with the remote device 2 using various methods. The communicator 17 may communicate with the remote device 2 using various methods. The remote device 2 may be various devices that are capable of communicating, such as a dedicated terminal, a mobile phone, a tablet, a portable PC, a desktop PC, a remote control, or a Bluetooth speaker.

The user may manipulate and set the overall operation state of the lighting device 36, such as an operation time and an operation condition of the lighting device 36 and emission color through manipulation of the remote device 2. For example, the lighting device 36 may be simply manipulated and set through an application or a dedicated program installed in a portable phone of the user.

The lighting device 36 may also be operated by a sensor. The sensor may be, for example, a user detection sensor 151 for detecting proximity of the user. For example, the user detection sensor 151 may use various devices for detecting user approaching near the refrigerator, such as an infrared sensor, an ultrasonic sensor, or a laser sensor.

The sensors 15 may be disposed at various positions for detecting proximity of the user, such as one side of the cabinet or one side of the door 20, and may be disposed at various positions for detecting proximity of the user. A plurality of sensors may be disposed at different positions.

Thus, when the user approaches the refrigerator 1 by a set distance for use of the refrigerator 1, the user detection sensor 151 may detect this and may transfer a signal to the controller 13 to turn on the lighting device 36. When the user moves away from the refrigerator 1, the user detection sensor 151 may detect this and may transfer a signal to the controller 13 to turn off the lighting device 35.

In detail, when the user detection sensor 151 detects that the user is very close to the refrigerator 1, the lighting device 36 may be turned off or the brightness may be gradually dimmed to prevent glare of the user. When the user moves away from the refrigerator 1 again, the lighting device 35 may be turned on again or may return to an original brightness.

The sensor may be an illumination sensor 152. The illumination sensor 152 may detect illumination of an indoor space and may be disposed at the same position as a position at which the user detection sensor 151 is disposed.

The lighting device 36 may be operated according to a detected illumination of the illumination sensor 152. For example, when the detected illumination of the illumination sensor 152 is equal to or less than a set illumination and the lighting device 36 is dimmed, the controller 13 may turn on the lighting device 36, and when the detected illumination of the illumination sensor 152 is equal to or greater than the set illumination and the lighting device 36 becomes brighter, the controller 13 may turn off the lighting device 36.

The sensor may include both the illumination sensor 152 and the user detection sensor 151, and the illumination sensor 152 and the user detection sensor 151 may be operated in a complex way to cause the controller 13 to turn off the lighting device 36.

For example, in the state in which the illumination sensor 152 is detected to be equal to or greater than the set illumination, the lighting device 36 may be maintained in an off state irrespective of whether the user detection sensor 151 detects this. In the state in which the illumination sensor 152 is detected to be equal to or less than the set illumination, when the user detection sensor 151 detects proximity of the user, the lighting device 36 may be turned on.

The sensor may be an inside temperature sensor 153. The controller 13 may be connected to the inside temperature sensor 153. The inside temperature sensor 153 may detect a temperature inside the refrigerator and may transfer the detected temperature to the controller 13, and the controller 13 may cause the light source 362 to glow with set color according to the temperature inside the refrigerator and may intuitively display the temperature and state inside the refrigerator through front color of the door 20.

The lighting device 36 may include the state in which brightness is adjusted in addition to an on state and an off state. That is, according to an operation state of the refrigerator 1, the controller 13 may adjust the operation state of the refrigerator 1 by changing brightness of the lighting device 36.

The controller 13 may be connected to a microphone 18. Thus, the light source 362 may glow with set color according to a voice signal received from the microphone 18, and an input state of the voice signal or a setting state of a function may also be displayed through the front color of the door 20.

For example, when receiving a temperature control signal of the user through the microphone 18, the controller 13 may adjust a set temperature inside the refrigerator, and may operate the lighting device 36 to change color of the front surface of the door 20 to color corresponding to the corresponding temperature. In another example, when music is input through the microphone 18, the lighting device 36 may also be controlled to change the front color of the door 20 in response to play of music, and the front surface of the refrigerator the door 20 may be continuously changed in color with an equalizer while interacting with the played music.

The lighting device 36 may be turned off at a time set by a timer 16. That is, the lighting device 36 may be turned on according to a time when the user is mainly active and may be maintained off outside the set time range. The lighting device may be turned off during the day and on during night irrespective of actual illumination.

Irrespective of an operation state of the refrigerator 1, the brightness and color of the front surface of the door 20 may be adjusted only according to user settings.

The operation state of the lighting device operated by the controller is now described. As shown in FIG. 28, when the lighting device 36 is turned on according to an instruction of the controller 13, light emitted from the light source 362 may be emitted toward the lower end of the light guide plate 33. In this case, the light emitted from the light source 362 may be irradiated with a color selected by the controller 13. That is, the light source 362 may be the RGB LED to emit light having a color determined by the controller 13 so that the surface of the panel 31 glows in a specific color.

The light incident through the lower end of the light guide plate 33 may be diffused and reflected along the light guide plate 33 and then may move along the light guide plate 33. In this case, the light guided by the light guide plate 33 may be reflected forward by the reflective layer 331 to pass through the panel 31 so as to be transmitted to the outside. The light may be also reflected from a circumferential surface of the light guide plate 33 by the reflective member 332 disposed on a circumference of the light guide plate 33, and thus, reflection efficiency inside the light guide plate 33 may be maximized.

All of the light guided through the light guide plate 33 may be irradiated forward by the reflection of the reflective layer 331 and the reflective member 332 so that the entire panel 31 glows brightly, and the front surface of the door 20 may also glow with set brightness or a color.

The lighting device 36 may be disposed on the lower end of the panel assembly 30, and the light source 362 may emit light upward. The lighting device 36 may be fixed to be prevented from being moved inside the lower bracket 35. Thus, even if the door 20 is repeatedly opened and closed, the lighting device 36 may be maintained at an exact position, and the panel 31 may be ensured to glow with set brightness by directing light emitted from the light source 362 toward the lower end of the light guide plate 33.

In particular, the light guide plate 33 may be supported from below by its own weight, and thus the set interval G may be maintained between the lower end of the light guide plate 33 and the upper end of the light source 362. Thus, light emitted from the light source 362 may be effectively incident on the lower end of the light guide plate 33, and the brightness of the panel 31 may be ensured and the panel 31 may glow with uniform brightness.

The lighting device 36 may be positioned below the upper end of the lower bracket 35. Thus, viewed from the front, the lighting device 36 may be prevented from being exposed, and a lighting spot (a hot spot) may be prevented from being formed adjacent to the light source 362, thereby improving the quality of an outer appearance of the front surface of the door 20 and preventing glare of the user.

The lighting device 36 may be turned on to cause the front surface of the door 20 to glow brightly, and the front surface of the door 20 may glow with set color by light emitted from the plurality of light sources 362. In this case, the front color of the door 20 may be different color or brightness from in the state in which the lighting device 36 is turned off.

For example, in a state in which the lighting device 36 is turned off, as illustrated in FIG. 29, the front surface of the door may not glow, and an original color of the panel assembly 30 may be appeared.

That is, the front color of the door 20 may be seen as color of the panel 31, and the texture and pattern formed on the panel 31 may be seen. In this case, the color of the panel 31 may be color with a brightness greater than 0 and may be formed in a color other than black. The color of the front surface of the door 20 in the state in which the lighting device 36 is turned may also be referred to as a first color.

Thus, the front surface of the door 20 may be seen with color of the panel 31, and in this case, components inside the panel assembly 30 may be seen through the panel 31 and may not be seen to the outside by the color of the panel 31.

In this state, the lighting device 36 may be turned on, and when the lighting device 36 is turned on, the front surface of the door 20 may glow with color set by the controller 13.

Figure 30:
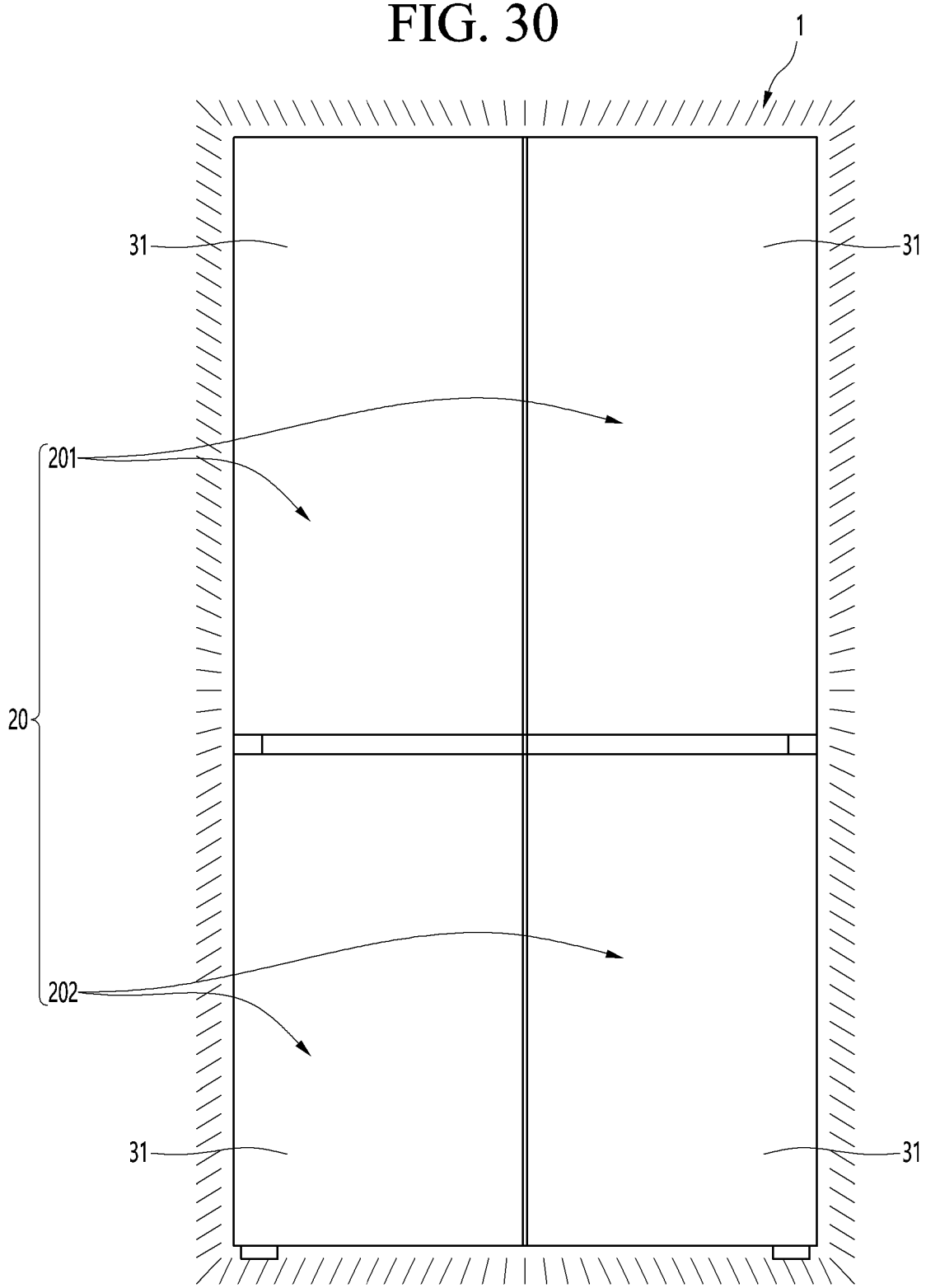

For example, as illustrated in FIG. 30, the controller 13 may instruct the front surface of the door 20 to glow with a second color different from the first color, and the lighting device 36 may cause the light source 362 to glow with the second color according to the instruction of the controller 13.

When the light source 362 glows with the second color, light of the second color may be transmitted through the front surface of the panel 31 by light reflected by the light guide plate 33, and the front surface of the door 20, that is, the outer appearance of the front surface of the refrigerator 1 may have the second color.

In the state in which the outer appearance of the front surface of the refrigerator 1 glows with the second color, when the controller 13 instructs change in color of the front surface of the refrigerator 1, and the front surface of the door 20 may glow with color that is reset by the controller 13.

Figure 31:
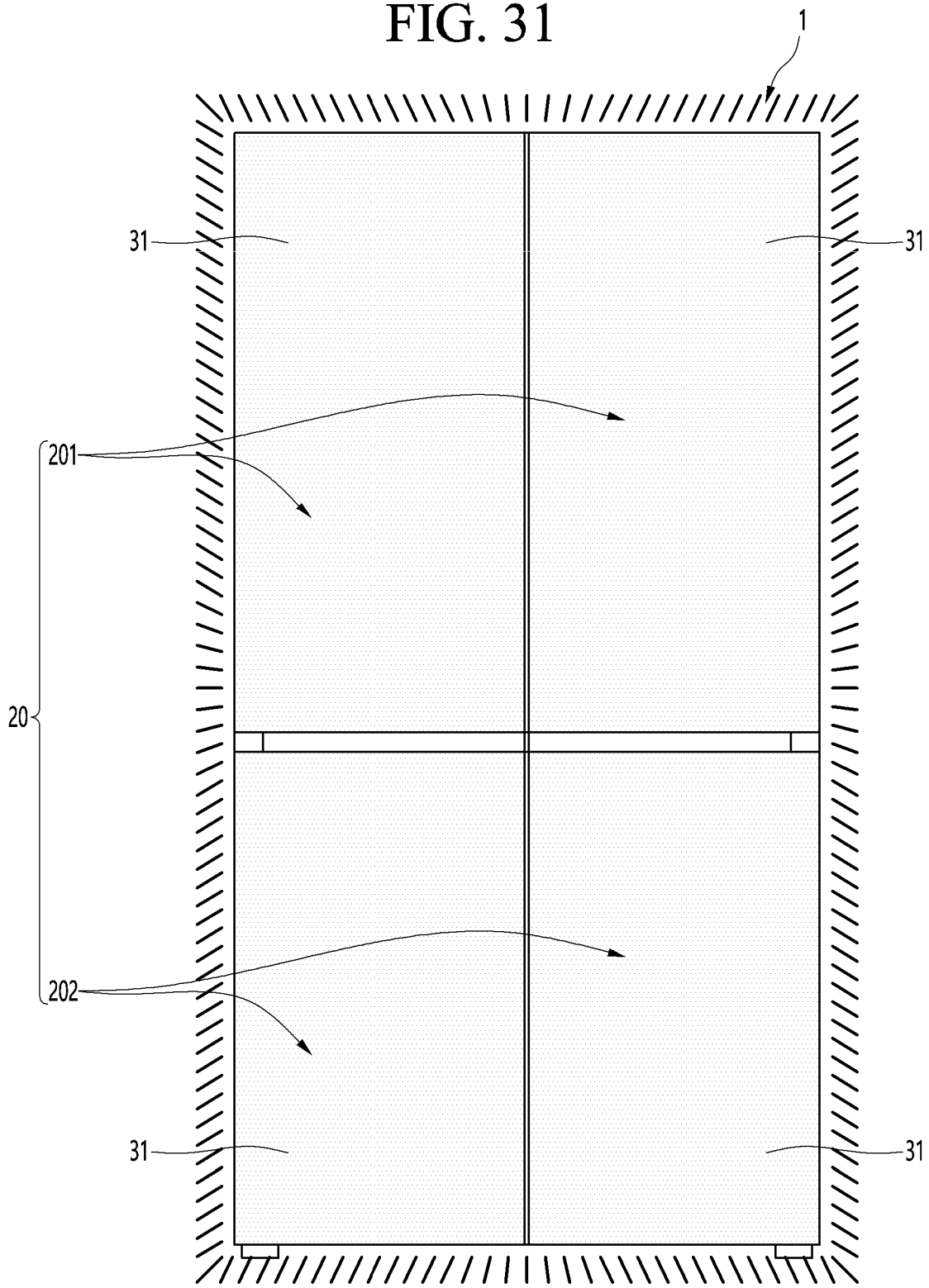
FIG. 31 is a front view illustrating the outer appearance of the front surface of the refrigerator, in which the lighting device is changed in color.

For example, as illustrated in FIG. 31, the controller 13 may instruct the front surface of the door 20 to glow with a third color different from the first color and the second color, and the lighting device 36 may cause the light source 362 to glow with the third color according to the instruction of the controller 13.

When the light source 362 glows with the third color, light with the third color may be transmitted through the front surface of the panel 31 by light reflected by the light guide plate 33, and the front appearance of the front surface of the door 20, that is, front appearance of the refrigerator 1 may have the third color.

Some of the plurality of doors 20 forming the front appearance of the refrigerator 1 may emit light or the plurality of doors 20 may independently emit light to form the front appearance of the refrigerator 1 with set color.

Figure 32:
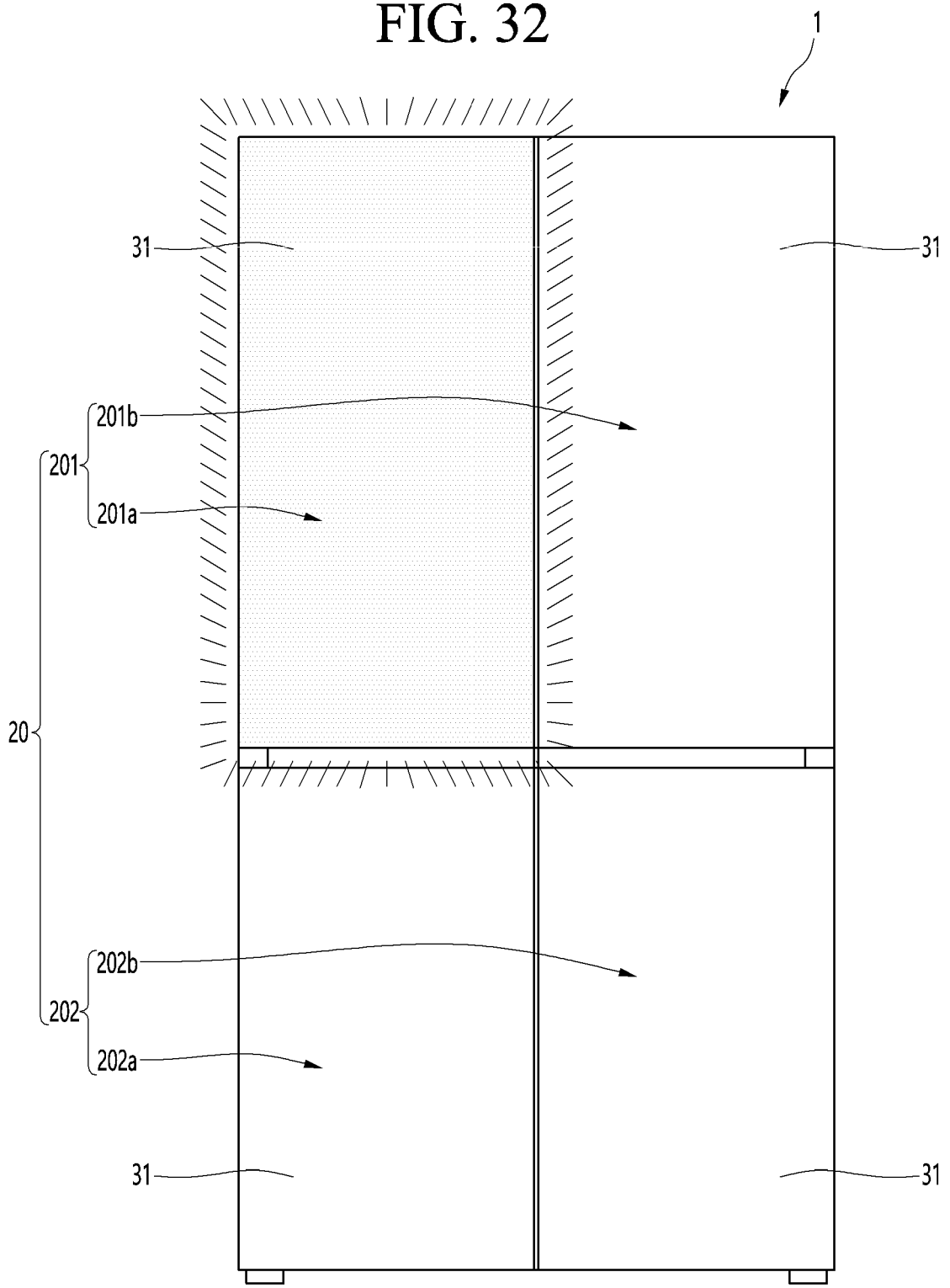
FIG. 32 is a front view illustrating the outer appearance of the front surface of the refrigerator in a state in which a portion of a plurality of doors emits light.

For example, as illustrated in FIG. 32, the refrigerator 1 may operate to cause some doors 20 of a plurality of doors to glow or glow with specific color. That is, all the lighting devices 36 included in the doors 20 may not be operated, but instead, only some 201*a* of all the doors 20 may glow. For example, any one door 201*a* of the refrigerating compartment door 201 may glow. That is, the left refrigerating compartment door 201*a* among the left refrigerating compartment door 201*a* and the right refrigerating compartment door 201*b* may glow. Of course, the door 20 may be any one of the freezing compartment doors 202.

As necessary, the left refrigerating compartment door 201*a* and the right refrigerating compartment door 201*b* may glow with different colors. At least two of the doors 20 may be sequentially changed in color and at least two of the doors 20 may be sequentially turned on or off.

In this case, the lighting device 36 included in the panel assembly 30 may be controlled by the controller 13 according to the aforementioned various conditions.

The refrigerating compartment door or the freezing compartment door among the doors may be controlled to glow with different colors.

Figure 33:
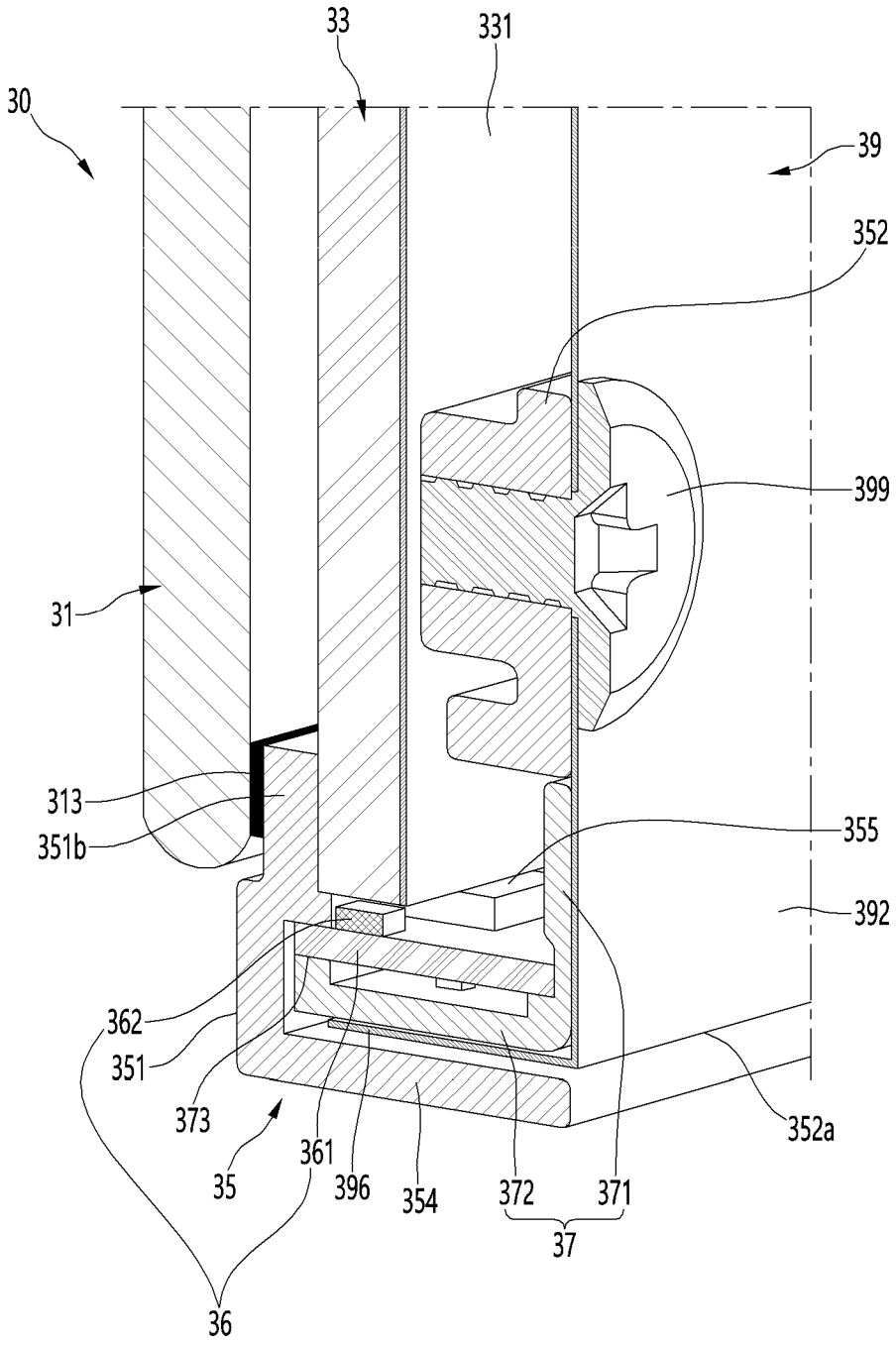
FIG. 33 is a front view illustrating the outer appearance of the front surface of the refrigerator in a state in which each of a refrigerating compartment door and a freezing compartment door of the doors emits light.

For example, as illustrated in FIG. 33, the controller 13 may control the lighting device 36 to cause one pair of the refrigerating compartment doors 201 to be seen with the first color. The controller 13 may control the lighting device 36 to cause one pair of the refrigerating compartment doors 201 to be seen with the second color.

That is, the refrigerating compartment door 201 and the freezing compartment door 202 may be distinguished therebetween with colors, and according to a temperature change inside the refrigerator, the colors of the refrigerating compartment door 201 and the freezing compartment door 202 may also be changed.

Thus, through the front color of the door 20, the user may intuitively recognize an operation state of each storage space as well as may distinguish between the refrigeration compartment and the freezing compartment.

There may be various other embodiments other than the aforementioned embodiments. Another embodiment of the present disclosure may have the same structure as the aforementioned embodiment except for the mounting structure of the panel and the light guide plate, and thus the same components as in the aforementioned embodiment use the same reference numeral, and a detailed description and illustration thereof may be omitted.

Hereinafter, another embodiment of the present disclosure will be described with reference drawings.

Figure 34:
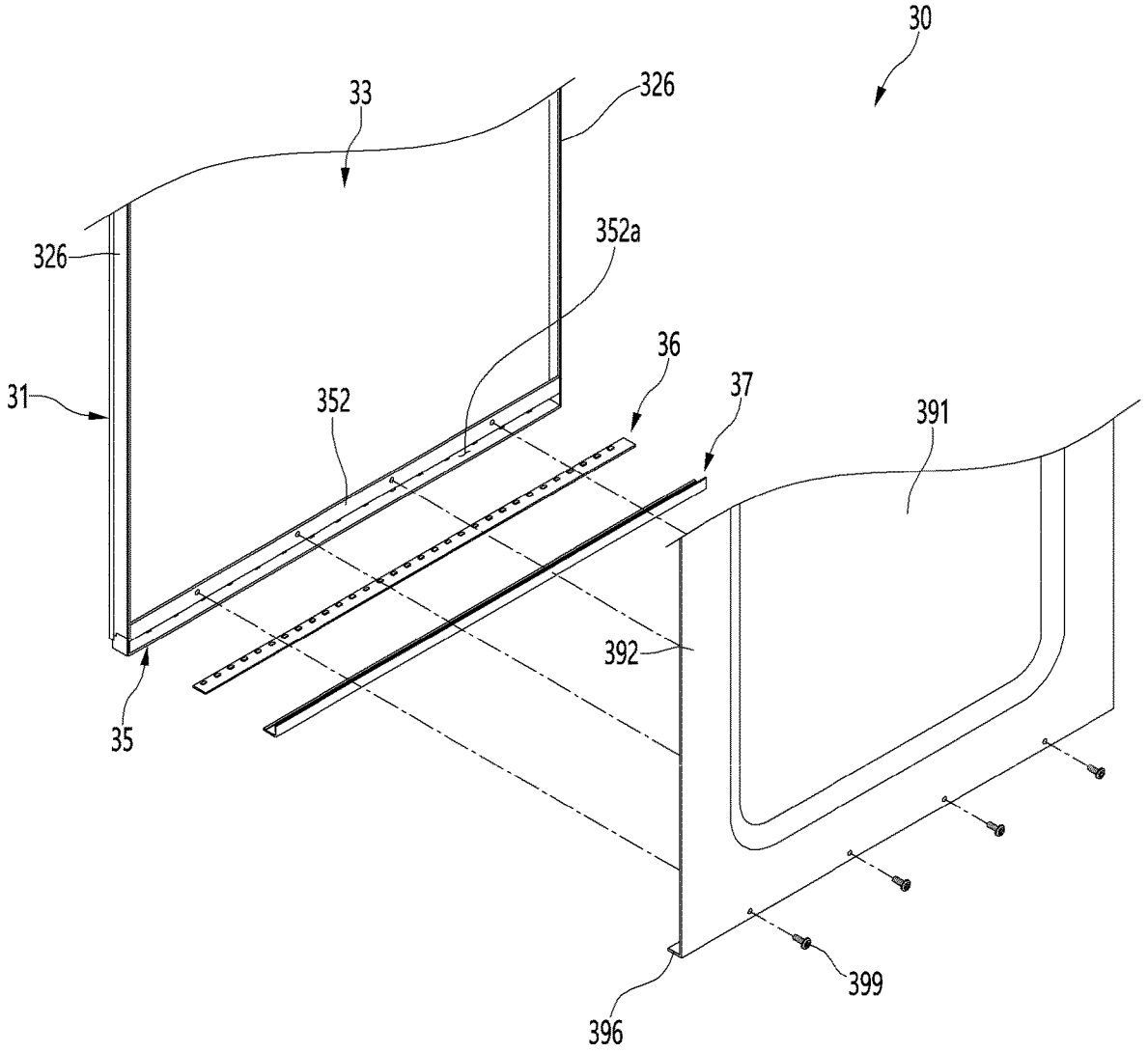
FIG. 34 is an exploded perspective view of a panel assembly according to another embodiment of the present disclosure.
Figure 35:
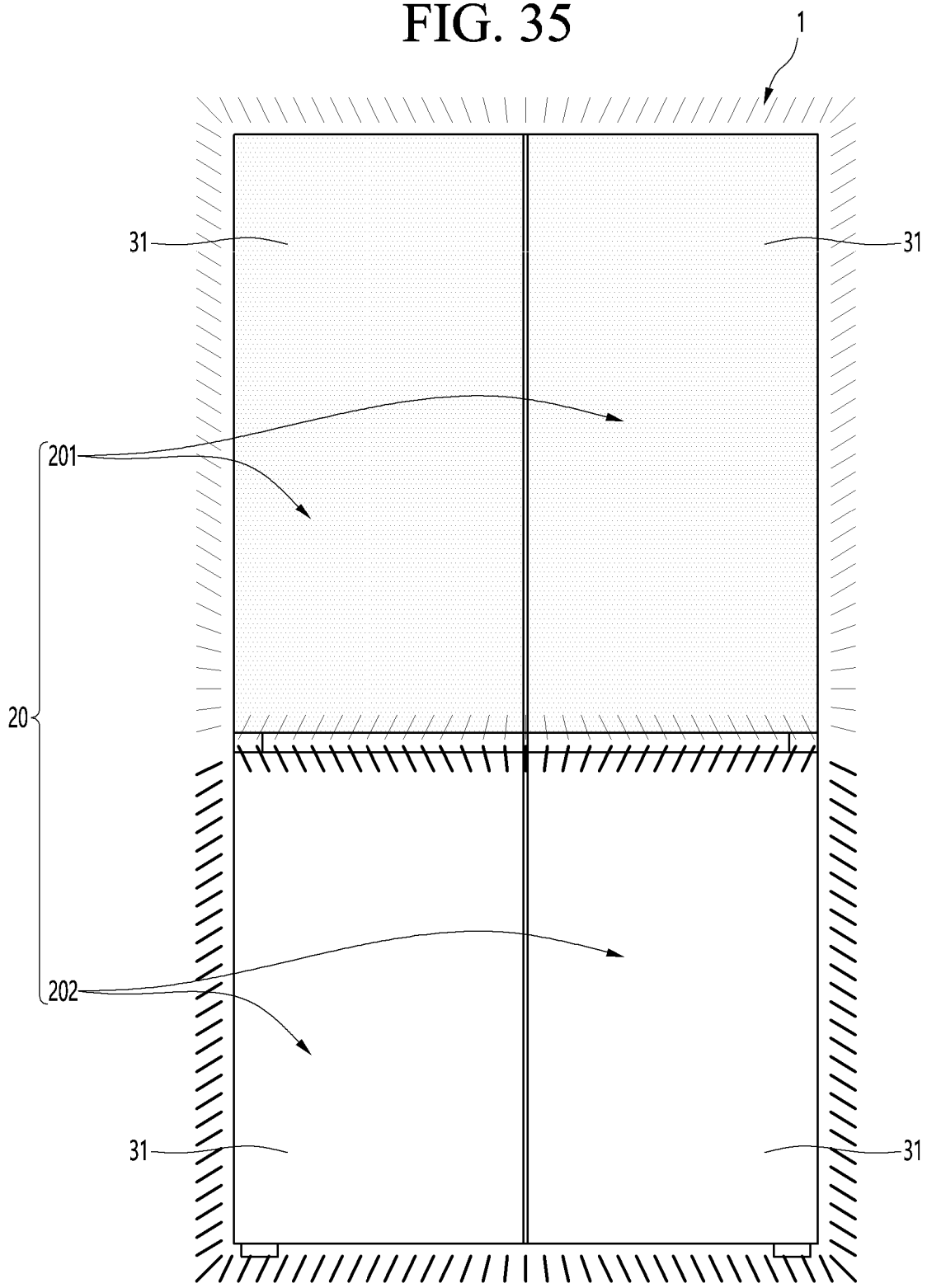
FIG. 35 is a cutaway perspective view of the panel assembly.

FIG. 34 is an exploded perspective view of a panel assembly according to another embodiment of the present disclosure. FIG. 35 is a cutaway perspective view of the panel assembly.

As illustrated in the drawings, a panel assembly 30 of a refrigerator 1 according to another embodiment may include a panel 31 defining a front surface of the panel assembly 30, a light guide plate 33 disposed at a rear side of the panel 31, a back cover 39 defining a rear surface of the panel assembly 30, and a lighting device 36 emitting light to the light guide plate 33.

The panel assembly 30 may include a lower bracket 35 defining a bottom surface of the panel assembly 30. In addition, the panel assembly 30 may further include an upper bracket 34 defining a top surface of the panel assembly 30.

The lower bracket 35 may include a lower bracket front surface portion 351, a lower bracket bottom surface portion 354, and a lower bracket rear surface portion 352.

The panel 31 may be mounted on a front surface portion of the lower bracket 35. A lower end of the panel 31 may be supported by the lower bracket front surface portion 351. In addition, the panel 31 and the lower bracket 35 may be coupled to each other by an adhesive member 313. In addition, the upper end of the panel 31 may be coupled to the upper bracket 34 by the adhesive member 313.

The light guide plate 33 may be disposed behind the panel 31 and may be spaced apart from the panel 31. In addition, the light guide plate 33 may be supported by a light guide plate support protruding from the lower bracket 35. In addition, a lower end of the light guide plate 33 may be fixed to the lower bracket 35. For example, the lower end of the light guide plate 33 may be fixed to the lower bracket front surface portion 351.

The lighting device 36 may be mounted on the lower bracket 35. For example, the lighting device 36 may be provided inside the lower bracket 35. The lighting device 36 may include a substrate 361 extending along the lower bracket 35 and a plurality of light sources 362 disposed on the substrate 361. For example, the light source 362 may be an LED. The light source 362 may be disposed at a position facing the lower end of the light guide plate 33 to emit light toward the lower end of the light guide plate 33.

A bracket opening may be defined in the lower bracket rear surface portion 352. The bracket opening 352*a* may have a size corresponding to that of the lighting device 36. In addition, the lighting device 36 may be mounted and separated through the bracket opening 352*a*. The lighting device 36 may be detached from the lower bracket 35 while the panel 31 and the light guide plate 33 are mounted.

In addition, a light supporter 37 may be further mounted on the lower bracket 35. The right supporter 37 may include a first supporting portion 372 on which the lighting device 36 is seated and a second supporting portion 371 that is in contact with the back cover 39. In addition, a substrate support 373 may be disposed on the first supporting portion 342 to support the substrate 361.

The light supporter 37 may be made of a metal material. In addition, the light supporter 37 may transfer heat generated by the lighting device 36 to the back cover 39 to dissipate the heat through the back cover 39. Therefore, even when the lighting device 36 is driven for a long time, it is possible to prevent the temperature of an outer surface of the panel 31 from increasing through effective heat dissipation and to improve durability of the lighting device 36.

The light supporter 37 may be accessible through the bracket opening 352*a*. In addition, the lighting device 36 and the light supporter 37 may be accessible through the bracket opening 352*a* in a state of being coupled to each other. In addition, when the back cover 39 is mounted, the bracket opening 352*a* may be shielded, and the lighting device 36 and the light supporter 37 may be maintained to be mounted on the lower bracket 35.

The back cover 39 may be made of a metal material and may be provided in a plate shape to define a rear surface of the panel assembly 30. In addition, a screw 399 may be coupled to each of upper end and lower end of the back cover 39 to be coupled to the upper bracket 34 and the lower bracket 35. Particularly, the lower end of the back cover 39 may be coupled to the lower bracket rear surface portion 352.

A cover bent portion 396 that is bent forward may be further disposed on a lower end of the back cover 39. The cover bent part 396 may be inserted into the bracket opening 352*a* and may be in contact with the lower bracket bottom surface part 354. In addition, the cover bent part 396 may also be in contact with a bottom surface of the light supporter 37, i.e., the first supporting portion 372.

Through this structure, when maintenance or replacement of the lighting device 36 is required, only the back cover 39 may be separated without disassembling the entire panel assembly 30 to maintain or replace the lighting device 36.

In detail, the panel assembly 30 is configured in an assembled module state and may be separated from the door body 40. In addition, if any limitation occurs in the lighting device 36 while the door 20 is in use, only the back cover 39 may be separated to allow access to the lighting device 36. Also, the panel assembly 30 may be completed again by mounting the back cover 39 after the repair or replacement of the lighting device 36.

In addition, the panel assembly 30 may further include a side member 326. The side member 326 may define each of left and right side surfaces of the panel assembly 30. In addition, the side member 326 may connect between the upper bracket 34 and the lower bracket 35 to provide the overall frame of the panel assembly 30.

In addition, the side member 326 may be coupled to each of both left and right ends of the panel 31 to fix the panel 31. For example, the side member 326 are coupled to each of both ends of rear left and right sides of the panel 31 and may be covered when viewed from the front.

In addition, the side member 326 may fix the light guide plate 33. An inner surface of the side member 326 may support both left and right ends of the light guide plate 33. Thus, movement of the light guide plate 33 in the left and right direction may be restricted.

In addition, although not shown in detail, a structure for supporting the panel 31 may protrude from or be recessed in the inner surface of the side member 326 to more stably fix the panel 31. In addition, a structure for supporting the light guide plate 33 may protrude from or be recessed in the inner surface of the side member 326 to more stably fix the light guide plate 33.

There may be various other embodiments other than the aforementioned embodiments. According to another embodiment of the present disclosure, the panel assembly may be shield an open front surface of the door body. Another embodiment of the present disclosure may have the same structure as the aforementioned embodiment except for some components of the door body, and thus the same components as in the aforementioned embodiment use the same reference numeral, and a detailed description thereof may be omitted.

Hereinafter, another embodiment of the present disclosure will be described with reference drawings.

Figure 36:
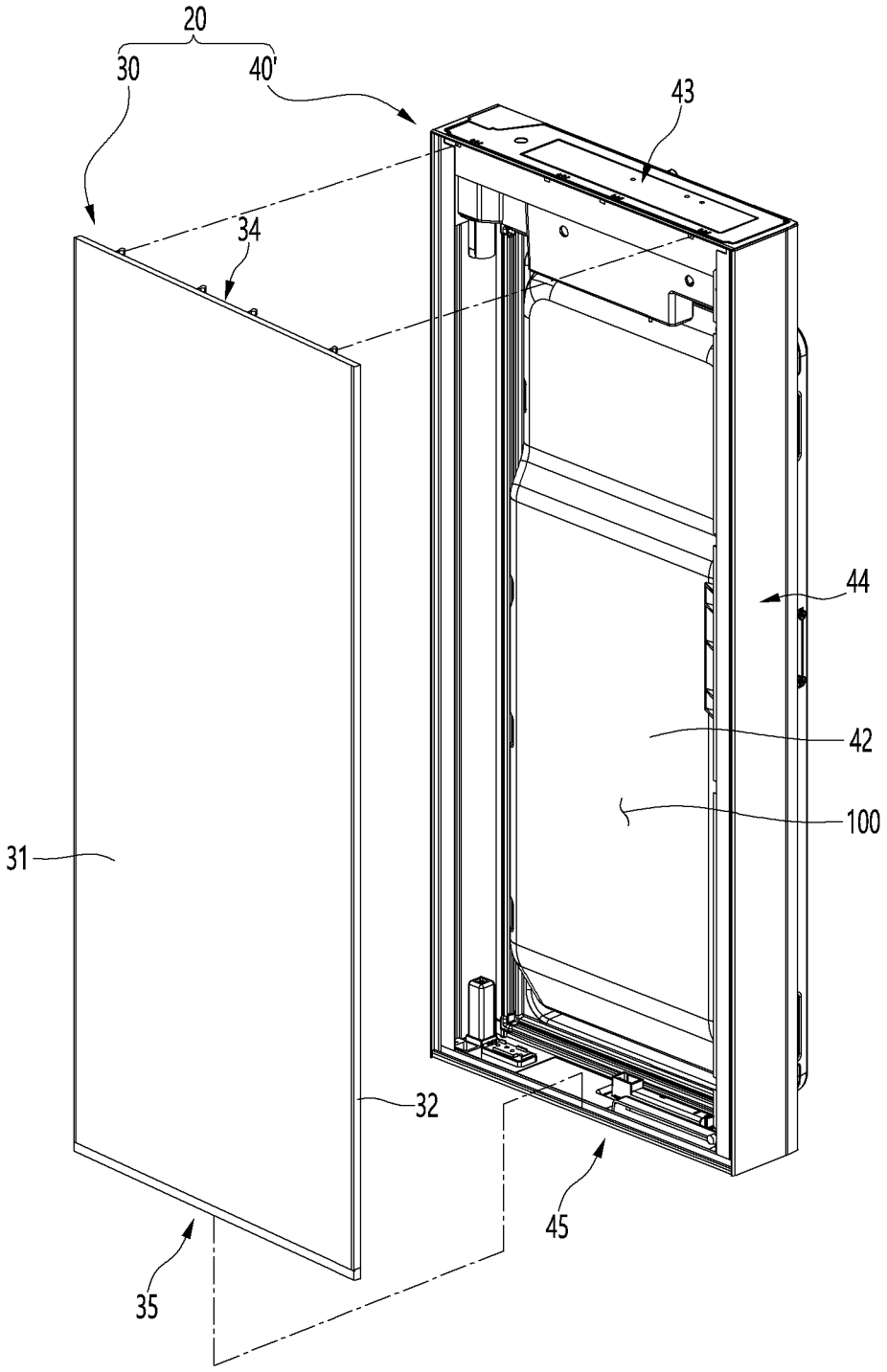
FIG. 36 is an exploded perspective view of a refrigerator door according to further another embodiment of the present disclosure.

FIG. 36 is an exploded perspective view of a refrigerator door according to further another embodiment of the present disclosure.

As shown in the drawing, the door 20 of the refrigerator according to another embodiment of the present disclosure may include the panel assembly 30 and a door body 40'. The panel assembly 30 may be coupled to the door body 40' to form a front surface of the door 20.

The overall structure of the panel assembly 30 may be the same as the aforementioned embodiment. That is, the panel assembly 30 may include the panel 31, the support member 32, the light guide plate 33, the upper bracket 34, the lower bracket 35, the lighting device 36, the right supporter 37, and the back cover 39, which are the same as those of the aforementioned embodiment, and thus a detailed description thereof will be omitted and may refer to the drawings of the aforementioned embodiments.

The door body 40' may include the door liner 42 forming a bottom surface of the door 20, the upper cap decoration 43 disposed on upper and lower ends of the door liner 42, and the side decoration 44 disposed on right and left side ends of the door liner 42. The upper cap decoration 43 and the lower cap decoration 45 may form upper and bottom surfaces of the door 20, and the side decoration 44 may form right and left side surfaces of the door 20.

In the state in which the door liner 42, the upper cap decoration 43, the lower cap decoration 45, and the side decoration 44 are coupled to each other, a body space 100 with an open front surface may be formed. The body space 100 may be shielded by the panel assembly 30.

That is, the panel assembly 30 may be coupled to the upper cap decoration 43, the lower cap decoration 45, and a front end of the side decoration 44, and a space in which an insulator is filled may be formed with the door liner 42 inside the door 20.

In the state in which the panel assembly 30 and the door body 40' are coupled to each other, an insulator may be filled in the door 20, and the insulating capability of the door 20 may be satisfied by filling the insulator in the body space 100.

In the state in which the door 20 is completely assembled, a bottom surface of the panel assembly 30, i.e., a rear surface of the back cover 39 may be in contact with the insulator. Thus, the insulator may not penetrate into a space inside the panel assembly 30 and may be protected by the back cover 39. The rear surface of the back cover 39 may be in contact with the insulator, and the panel assembly 30 may be firmly fixed to the door 20.

There may be various other embodiments other than the aforementioned embodiments. According to another embodiment of the present disclosure, the storage space may be partitioned into right and left sides, and the door includes a refrigerating compartment door and a freezing compartment door at right and left sides. Another embodiment of the present disclosure may have the same structure as the aforementioned embodiment except for arrangement of a storage space and a door, and thus the same components as in the aforementioned embodiment use the same reference numeral, and a detailed description thereof may be omitted.

Hereinafter, another embodiment of the present disclosure will be described with reference drawings.

Figure 37:
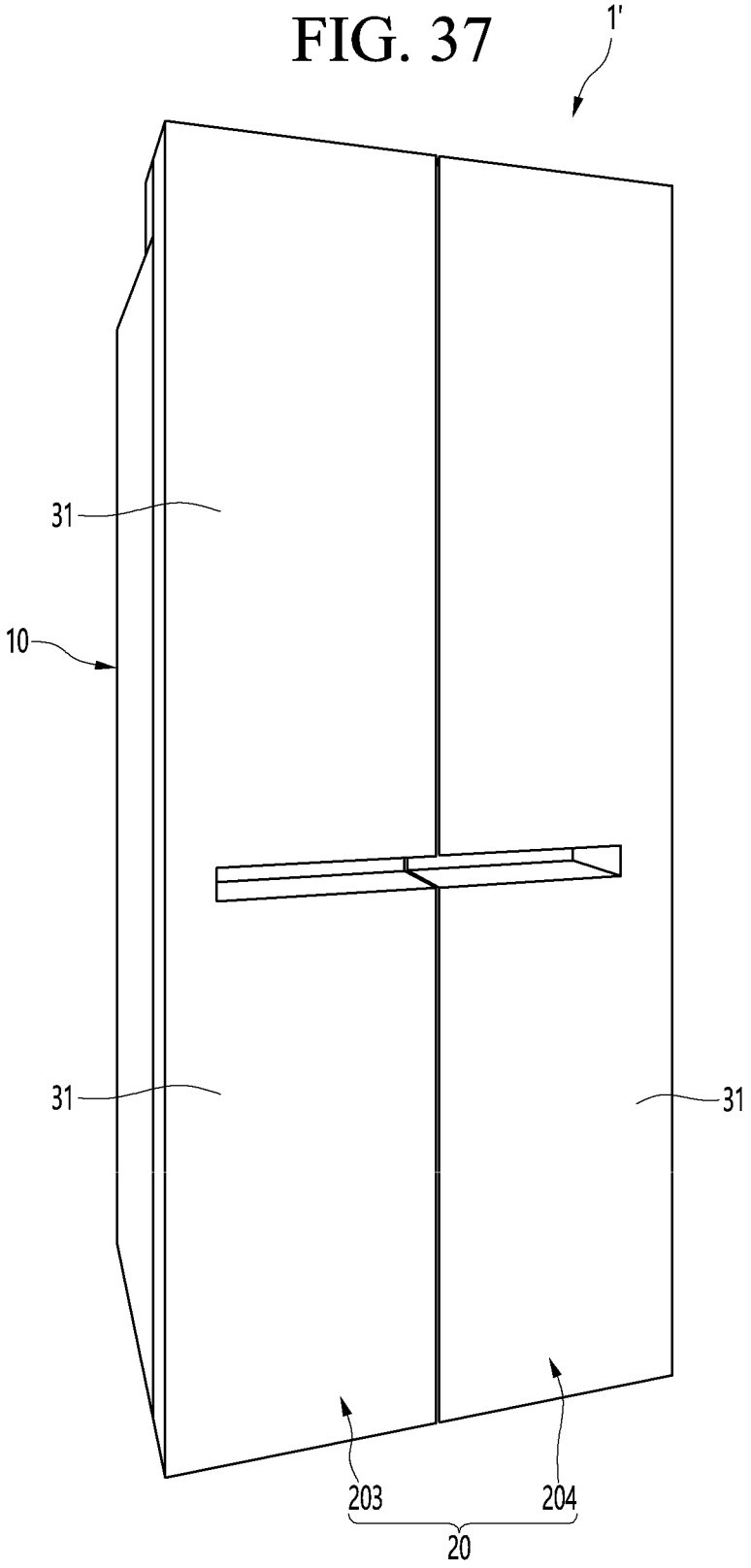
FIG. 37 is a perspective view of a refrigerator according to further another embodiment of the present disclosure.
Figure 38:
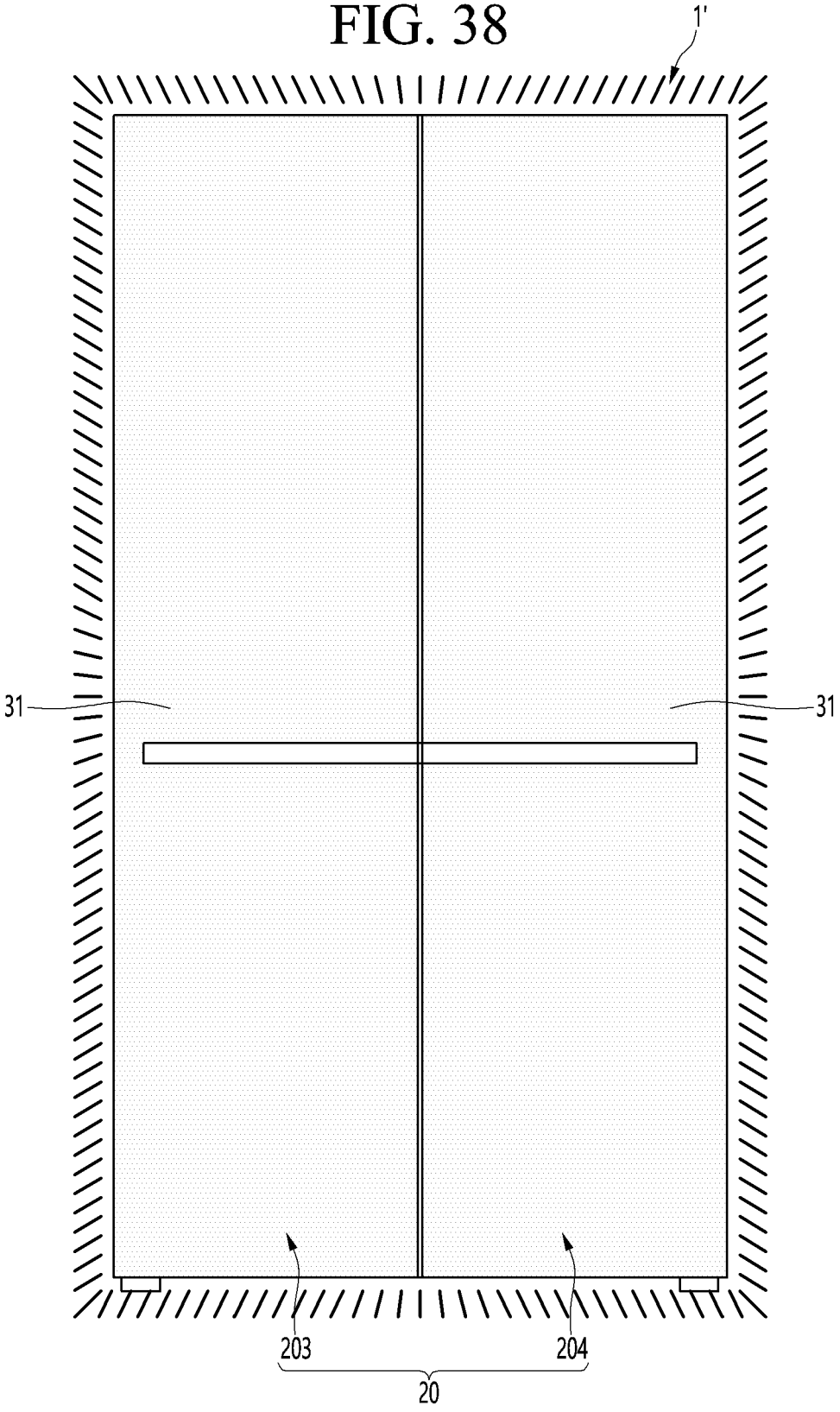

FIG. 37 is a perspective view of a refrigerator according to further another embodiment of the present disclosure. FIG. 38 is a front view of an outer appearance of the front surface of a refrigerator in the state in which a lighting device of the refrigerator is turned on.

As shown in the drawings, an outer appearance of a refrigerator l' according to another embodiment of the present disclosure may be formed by the cabinet 10 in which a storage space is formed, and the door 20 for opening and closing an open front surface of the cabinet 10.

The cabinet 10 may be divided into right and left sides. Although not shown, a left space of the cabinet 10 may be configured by a freezing compartment, and a right space of the cabinet 10 may be configured by a refrigerating compartment.

The door 20 may include a freezing compartment door 203 for opening and closing the freezing compartment and a refrigerating compartment door 204 for opening and closing the refrigerating compartment. The freezing compartment door 203 and the refrigerating compartment door 204 may be arranged in parallel to each other at right and left sides, and the refrigerating compartment and the freezing compartment may be configured to be opened and closed through rotation.

In the state in which the door 20 is closed, an outer appearance of the front surface of the refrigerator 1' may be formed by the door 20. The door 20 may include the door body 40 and the panel assembly 30. A detailed structure of the door 20 may be the same as the aforementioned embodiment and may be different therefrom except for the size and arrangement thereof, and thus a detailed description or illustration thereof may be omitted, and unexplained reference numerals in the drawings may refer to the aforementioned embodiment.

Color of the panel assembly 30 may be determined by the panel 31 configuring the front surface of the panel assembly 30. Thus, in the state in which the lighting device is turned off, the outer appearance of the front surface of the refrigerator 1' may be formed by color of the panel itself.

When the lighting device 36 is turned on under control of the controller 13, light emitted by the lighting device 36 may be seen through the panel 31 to change the panel 31 in color or brightness. In this case, under control of the controller 13, the lighting device 36 may emit light with various colors, and the panel 31 may be changed to various colors to glow. That is, in the state in which the door 20 is maintained to be assembled and mounted, color or brightness of the outer appearance of the front surface of the refrigerator l' may be changed resulting in change in the outer appearance of the front surface.

As necessary, the refrigerating compartment door 204 and the freezing compartment door 203 may glow with different colors, and the refrigerating compartment door 204 and the freezing compartment door 203 may glow with color selected to harmonize with surrounding furniture or an installation environment to harmonize with a surrounding environment. When an installation or usage environment or a usage condition is change, the outer appearance of the front surface of the refrigerator 1' may be freely changed according to the change.

There may be various other embodiments other than the aforementioned embodiments. According to another embodiment of the present disclosure, a panel assembly forming the exterior may be applied to other home appliances other than a refrigerator to change color of an outer appearance of the home appliance. Another embodiment of the present disclosure may have the same structure as the aforementioned embodiment except for the size and shape of a panel and an application target of the panel, and thus the same components as in the aforementioned embodiment use the same reference numeral, and a detailed description thereof may be omitted.

The following embodiments are the same as the aforementioned embodiments in terms of components of a panel assembly, and thus for detailed components, reference may be made to the description and drawings of the aforementioned embodiment, and a detailed description thereof is omitted to avoid repetition.

Hereinafter, another embodiment of the present disclosure will be described with reference drawings.

Figure 39:
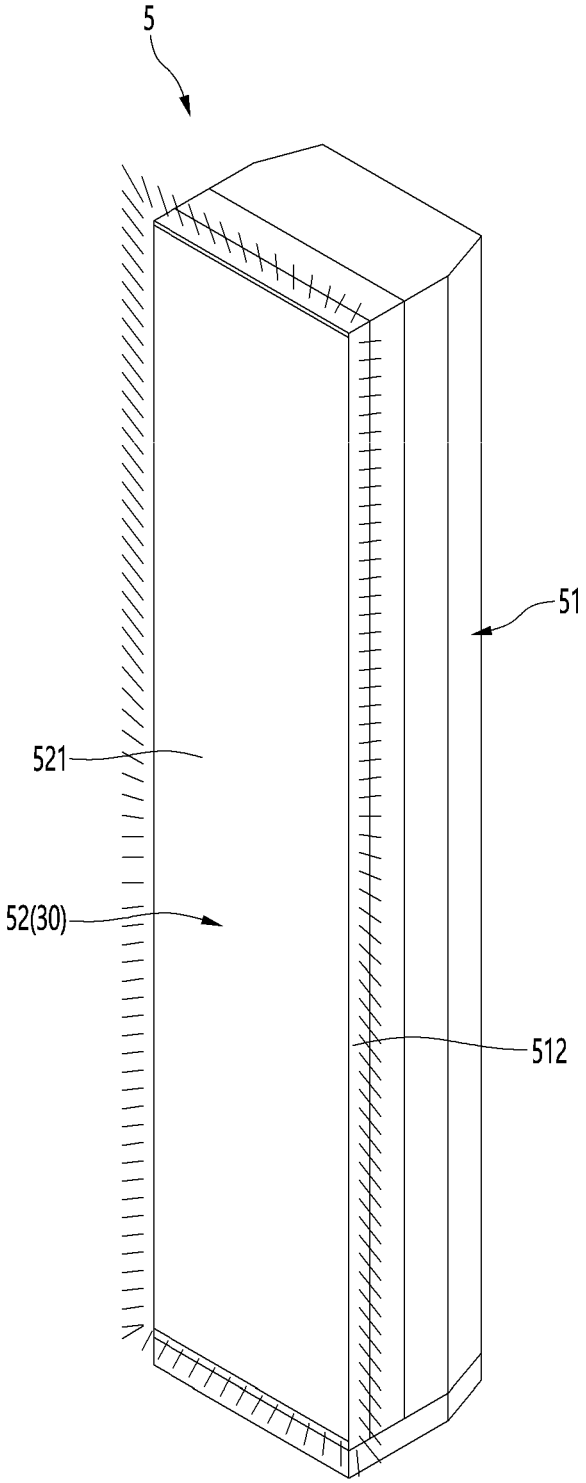
FIG. 39 is a perspective view illustrating an indoor unit of an air conditioner according to further another embodiment of the present disclosure.
Figure 40:
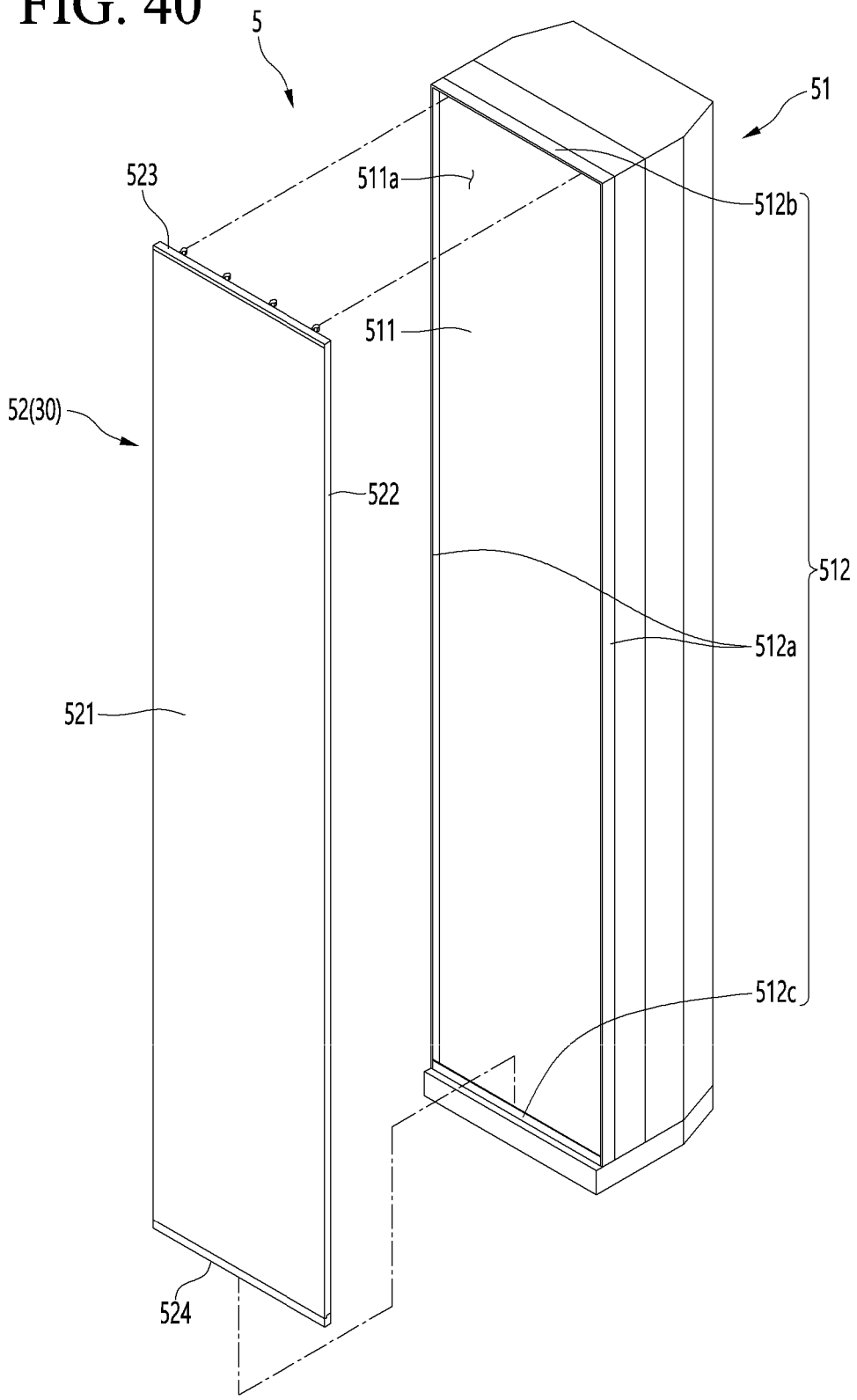
FIG. 40 is an exploded perspective view illustrating a dissembled panel assembly of the indoor unit.

FIG. 39 is a perspective view illustrating an indoor unit of an air conditioner according to further another embodiment of the present disclosure. FIG. 40 is an exploded perspective view illustrating a dissembled panel assembly of the indoor unit.

As shown in the drawings, an indoor unit 5 of the air conditioner according to another embodiment of the present disclosure may include a case 51 forming an outer shape, and a panel assembly 52 mounted on a front surface of the case 51 to form an outer appearance of the front surface of the indoor unit 5.

Although not shown in detail, in general, the case 51 may accommodate therein components making up a refrigeration cycle as well as a heat exchanger and a blower fan, and an absorption port for absorbing indoor air and a discharge port for discharging heat-exchanged air into a room may be formed at one side of the case 51.

A case border 512 may be formed at a circumference of a case front surface 511. The case border 512 may be formed to correspond to a shape of the panel assembly 52 and may protrude forward from the case front surface 511 to form a panel accommodation space 511*a* for accommodating the panel assembly 52 therein.

The case border 512 may include one pair of side borders 512*a* forming both side surfaces, an upper border 512*b* for connecting upper ends of the pair of side borders 512*a*, and a lower border 512*c* for connecting lower ends of the pair of side borders 512*a*.

The panel assembly 52 may form an outer appearance of the front surface of the indoor unit 5 and may be accommodated on an internal surface of the panel receiving space 410. A circumference surface of the panel assembly 52 may be supported by the case border 512. In particular, a lower end of the panel assembly 52 may be caught and restrained by the lower border 512*c*, and an upper end of the panel assembly 52 may be coupled to the upper border 512*b* to fixedly mount the panel assembly 52 on the front surface of the case 51.

The panel assembly 52 may have the same structure as the panel assembly 30 according to the aforementioned embodiment, and thus the front surface of the panel assembly 52 may glow with various colors under control of the controller 13.

The panel assembly 52 may include a panel 521 forming a front surface, a support member 522 on which the panel 521 is mounted, an upper bracket 523 mounted on an upper end of the support member 522 to form a top surface of the panel assembly 52, and a lower bracket 524 mounted on a lower end of the support member 522 to form a bottom surface of the panel assembly 52.

Although not shown, the light guide plate 33 may be mounted on the support member 522, and the lighting device 36 for emitting light to the light guide plate 33 may be provided on the lower bracket 524. The back cover 39 may be provided on a rear surface of the panel assembly 52.

As shown in FIG. 39, in the indoor unit 5 as configured above, when the lighting device 36 is turned on, the entire panel 521 may glow due to light emitted from the lighting device 36, and the outer appearance of the front surface of the indoor unit 5 may be formed by color corresponding to the color of the light emitted from the lighting device 36.

An operation of the lighting device 36 may be controlled according to control of the controller 13. Thus, the panel 521 may glow with various colors, and thus the outer appearance of the front surface of the indoor unit 5 may also correspond to various colors.

That is, outer color of the front surface of the indoor unit 5 may be freely changed under control of the lighting device 36 in the state in which the panel assembly 52 is maintained to be assembled and mounted without replacement of the panel assembly 52. Thus, the outer appearance of the indoor unit may be changed according to surrounding furniture or environments, and according to an operation state of the indoor unit 5, the operation state may be intuitively represented by changing the outer appearance of the indoor unit 5.

Figure 41:
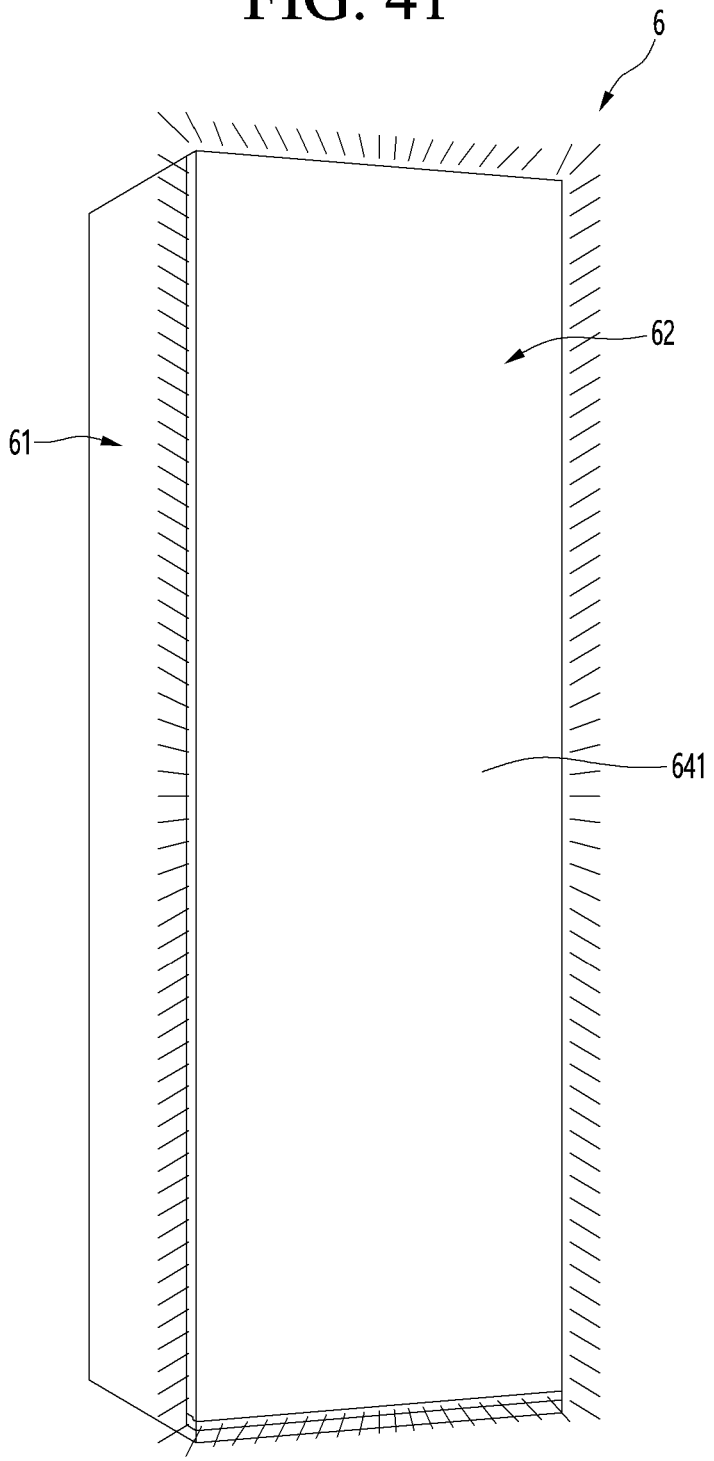
FIG. 41 is a perspective view of a clothing manager according to further another embodiment of the present disclosure.
Figure 42:
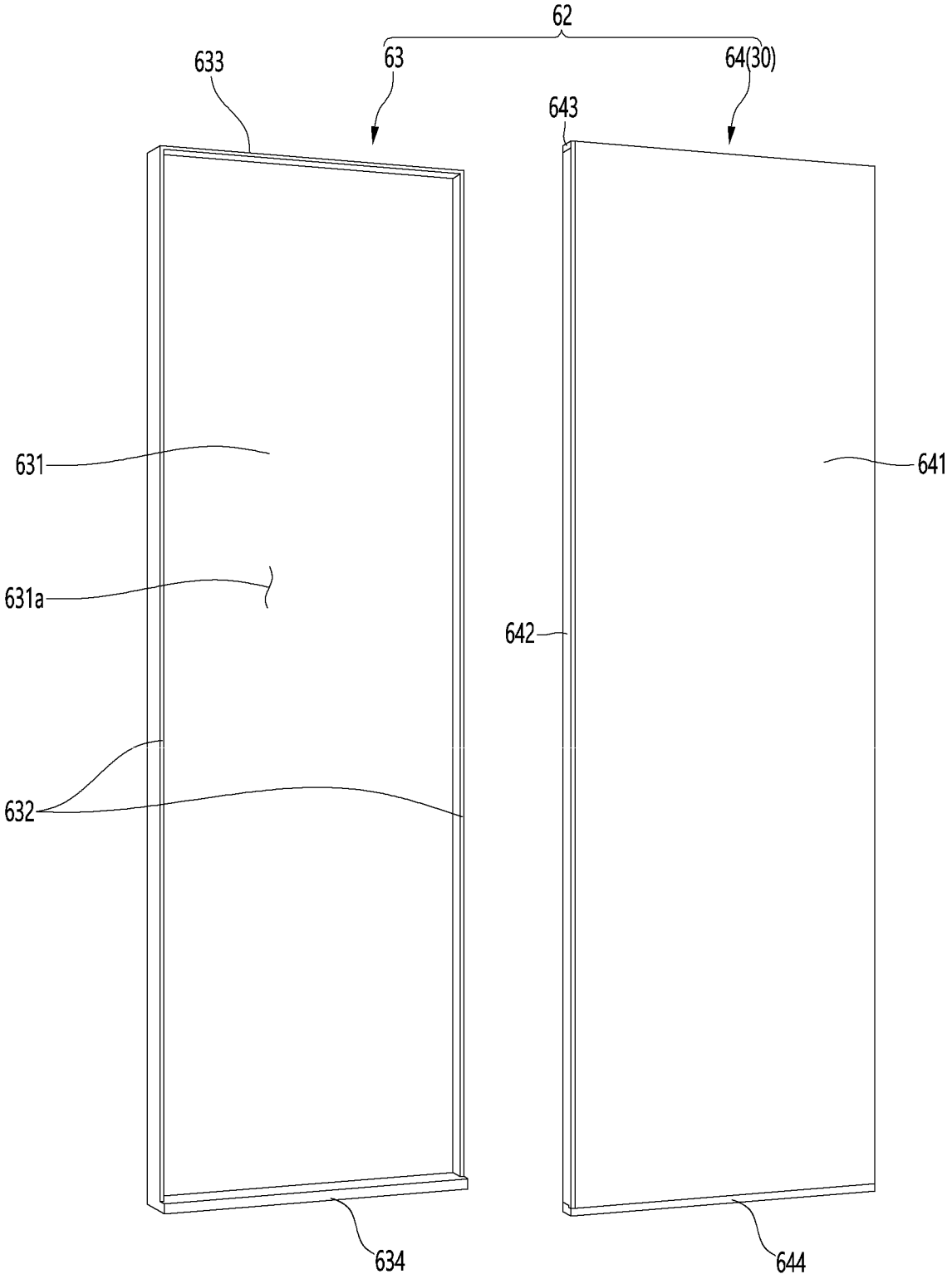
FIG. 42 is an exploded perspective view illustrating a door of the clothing manager.

FIG. 41 is a perspective view of a clothing manager according to further another embodiment of the present disclosure. FIG. 42 is an exploded perspective view illustrating a door of the clothing manager.

As shown in the drawings, an outer appearance of a clothing manager 6 according to another embodiment of the present disclosure may be formed by a case 61 forming a clothing accommodation space, and a door 62 for opening and closing an open front surface of the case 61.

Although not shown in detail, in general, the case 61 may include a clothing accommodation space for accommodating clothing, and a heat pump, a water tank, a steam generator, and an air circulation fan may be provided within a machine room separately formed from the clothing accommodation space.

A discharge port for discharging steam generated from the steam generator and dried air heated by the heat pump, and an absorption port for absorbing air from the clothing accommodation space may be formed inside the clothing accommodation space.

The door 62 may be rotatably mounted on the case 61, and in the state in which the door 62 is closed, the door 62 may form an outer appearance of the front surface of the clothing manager 6. The door 62 may include a door body 63 for opening and closing the clothing accommodation space, and a panel assembly 64 mounted on the door body 63 to form a front surface of the door 62.

A body plate 631 may be provided on a front surface of the door body 63 to form a front surface of the door body 63. A side decoration 632 extending in a vertical direction may be provided along right and left side ends of the door body 63, and right and left side surfaces of the door body 63 may be formed by the side decoration 632. A top surface of the door body 63 may be formed by an upper cap decoration 633 for connecting upper ends of the side decoration 632 at right and left sides, and a bottom surface of the door body 63 may be formed by a lower cap decoration 634 for connecting lower ends of the side decoration 632 at right and left sides.

The side decoration 632, the upper cap decoration 633, and the lower cap decoration 634 may protrude compared with the front surface of the body plate 631, and a panel accommodation space 631*a* in which the panel assembly 64 is accommodated may be formed in front of the body plate 631.

A lower end of the panel assembly 64 may be inserted into the lower cap decoration 634, and an upper end of the panel assembly 64 may be coupled to the upper cap decoration 633 to be fixedly mounted inside the panel accommodation space 631*a*. A circumference of the panel assembly 64 may be supported by the side decoration 632, the upper cap decoration 633, and the lower cap decoration 634.

The panel assembly 64 may have the same structure as the panel assembly 30 according to the aforementioned embodiment, and thus the front surface of the panel assembly 64 may glow with various colors under control of the controller 13.

The panel assembly 64 may include a panel 541 forming a front surface, a support member 642 on which the panel 541 is mounted, an upper bracket 643 mounted on an upper end of the support member 642 to form a top surface of the panel assembly 64, and a lower bracket 644 mounted on a lower end of the support member 642 to form a bottom surface of the panel assembly 64.

Although not shown, the light guide plate 33 may be mounted on the support member 642, and the lighting device 36 for emitting light to the light guide plate 33 may be provided on the lower bracket 644. The back cover 39 may be provided on a rear surface of the panel assembly 64.

As shown in FIG. 41, in the clothing manager 6 as configured above, when the lighting device 36 is turned on, the entire panel 541 may glow due to light emitted from the lighting device 36, and the outer appearance of the front surface of the clothing manager 6 may be formed by color corresponding to the color of the light emitted from the lighting device 36.

An operation of the lighting device 36 may be controlled according to control of the controller 13. Thus, the panel 541 may glow with various colors, and thus the outer appearance of the front surface of the clothing manager 6 may also correspond to various colors.

That is, outer color of the front surface of the clothing manager 6 may be freely changed under control of the lighting device 36 in the state in which the panel assembly 64 is maintained to be assembled and mounted without replacement of the panel assembly 64. Thus, the outer appearance of the clothing manager 6 may be changed according to surrounding furniture or environments, and according to an operation state of the clothing manager 6, the operation state may be intuitively represented by changing the outer appearance of the clothing manager 6.

Figure 43:
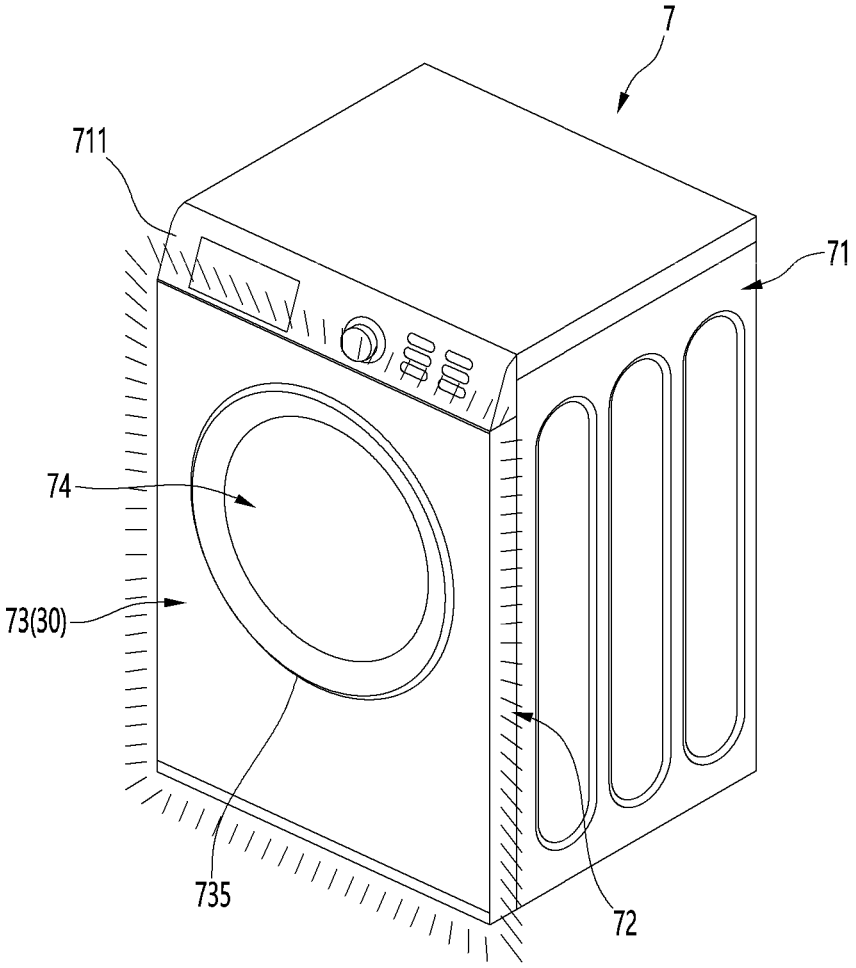
FIG. 43 is a perspective view of a washer according to further another embodiment of the present disclosure.
Figure 44:
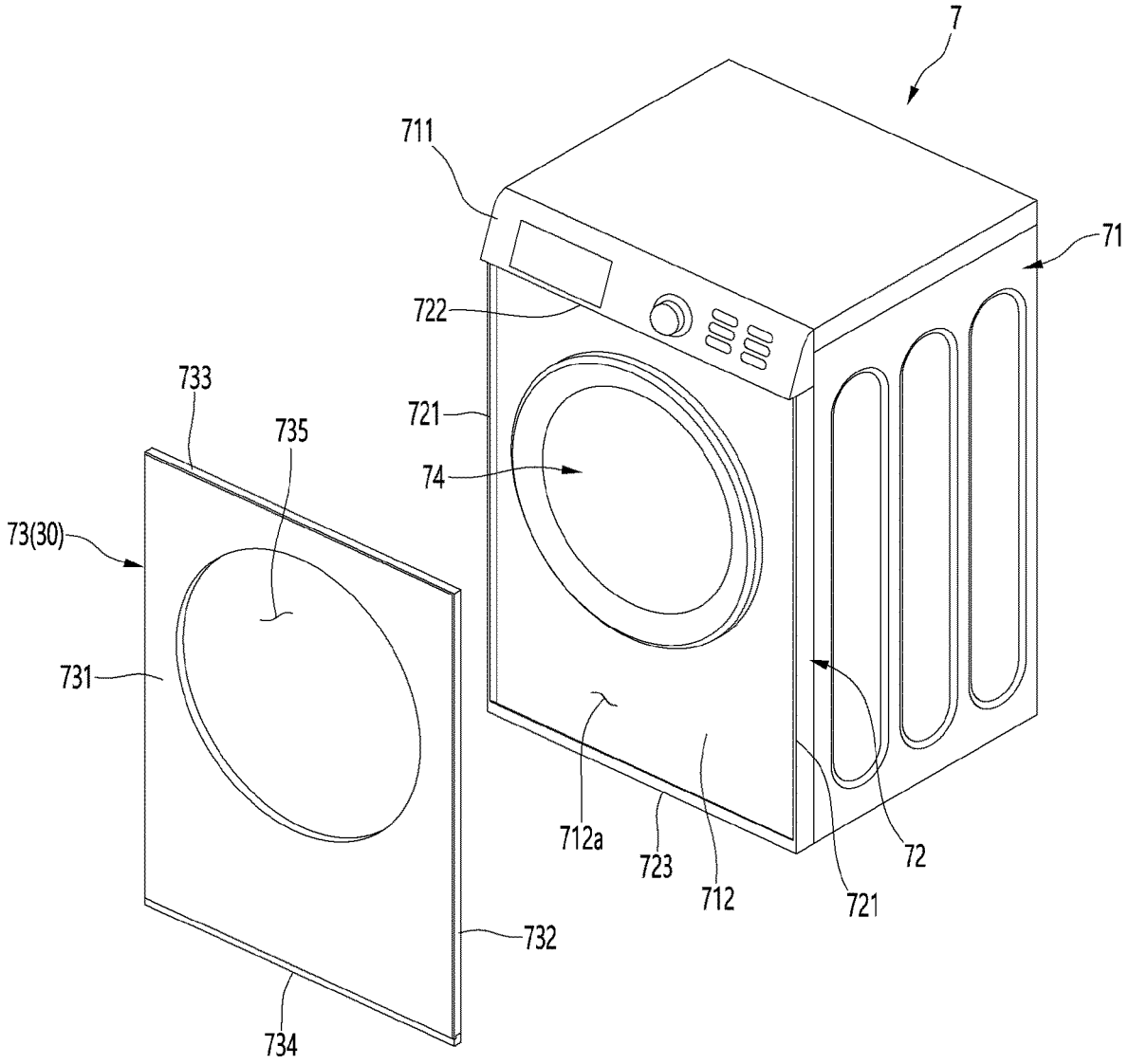
FIG. 44 is an exploded perspective view of a dissembled panel assembly of the washer.

FIG. 43 is a perspective view of a washer according to further another embodiment of the present disclosure. FIG. 44 is an exploded perspective view of a dissembled panel assembly of the washer.

As illustrated in the drawings, a washer 7 according to another embodiment of the present disclosure may include a case 71 forming an outer shape, and a panel assembly 73 mounted on a front surface of the case 71 to form an outer appearance of the front surface of the washer 7.

Although not shown in detail, in general, the case 71 may accommodate therein a drum and a tub that accommodate laundry therein, and a motor for rotation of the drum, and an opening connected to the drum may be formed in a front surface of the case 71.

A manipulator 711 for manipulating an operation of the washer 7 may be formed on an upper end of a front surface of the case 71. The manipulator 711 may include a plurality of buttons or knobs and may include a display.

A door 74 for opening and closing the opening may be mounted on the front surface of the case 71. The door 74 may be rotatably mounted, and in the state in which the door 74 is closed, the drum may be formed to see the inside of the drum.

A case border 72 may be formed at a circumference of a case front surface 712. The case border 72 may be formed to correspond to a shape of the panel assembly 73 and may protrude forward from the case front surface 712 to form a panel accommodation space 712*a* for accommodating the panel assembly 73 therein.

The case border 72 may include one pair of side borders 721 forming both side surfaces, an upper border 722 for connecting upper ends of the pair of side borders 721, and a lower border 723 for connecting lower ends of the pair of side borders 721.

The panel assembly 73 may form an outer appearance of the front surface of the washer 7 and may be mounted inside the panel accommodation space 712*a*. A circumference surface of the panel assembly 73 may be supported by the case border 72. In particular, a lower end of the panel assembly 73 may be caught and restrained by the lower border 723, and an upper end of the panel assembly 73 may be coupled to the upper border 722 to fixedly mount the panel assembly 73 on the front surface of the case 71.

A panel opening 735 may be formed in the panel assembly 73. The panel opening 735 may be formed with a size corresponding the door 74, and the panel opening 735 may be formed through the door 74 when the panel assembly 73. Thus, the front surface of the door 74 may be exposed through the panel assembly 73 when the panel assembly 73 is mounted.

The panel assembly 73 may have the same structure except for the panel opening 735 compared with the panel assembly 30 according to the aforementioned embodiment, and thus the front surface of the panel assembly 73 may glow with various colors under control of the controller 13.

The panel assembly 73 may include a panel 731 forming a front surface, a support member 732 on which the panel 731 is mounted, an upper bracket 733 mounted on an upper end of the support member 732 to form a top surface of the panel assembly 73, and a lower bracket 734 mounted on a lower end of the support member 732 to form a bottom surface of the panel assembly 73.

Although not shown, the light guide plate 33 may be mounted on the support member 732, and the lighting device 36 for emitting light to the light guide plate 33 may be provided on the lower bracket 734. The back cover 39 may be provided on a rear surface of the panel assembly 73.

As shown in FIG. 43, in the washer 7 as configured above, when the lighting device 36 is turned on, the entire panel 731 may glow due to light emitted from the lighting device 36, and the outer appearance of the front surface of the washer 7 may be formed by color corresponding to the color of the light emitted from the lighting device 36.

An operation of the lighting device 36 may be controlled according to control of the controller 13. Thus, the panel 731 may glow with various colors, and thus the outer appearance of the front surface of the washer 7 may also correspond to various colors.

That is, color of the outer appearance of the front surface of the washer 7 may be freely changed under control of the lighting device 36 in the state in which the panel assembly 73 is maintained to be assembled and mounted without replacement of the panel assembly 73. Thus, the outer appearance of the washer 7 may be changed according to surrounding furniture or environments, and according to an operation state of the washer 7, the operation state may be intuitively represented by changing the outer appearance of the washer 7.

Although not shown, a drier having the same structure of the outer appearance of the washer 7 may also have the same structure of the panel assembly thereof. A structure configured by the drier and the washer are vertically stacked and a structure configured by disposing the drier and the washer in one case may also have the same panel assembly.

Figure 45:
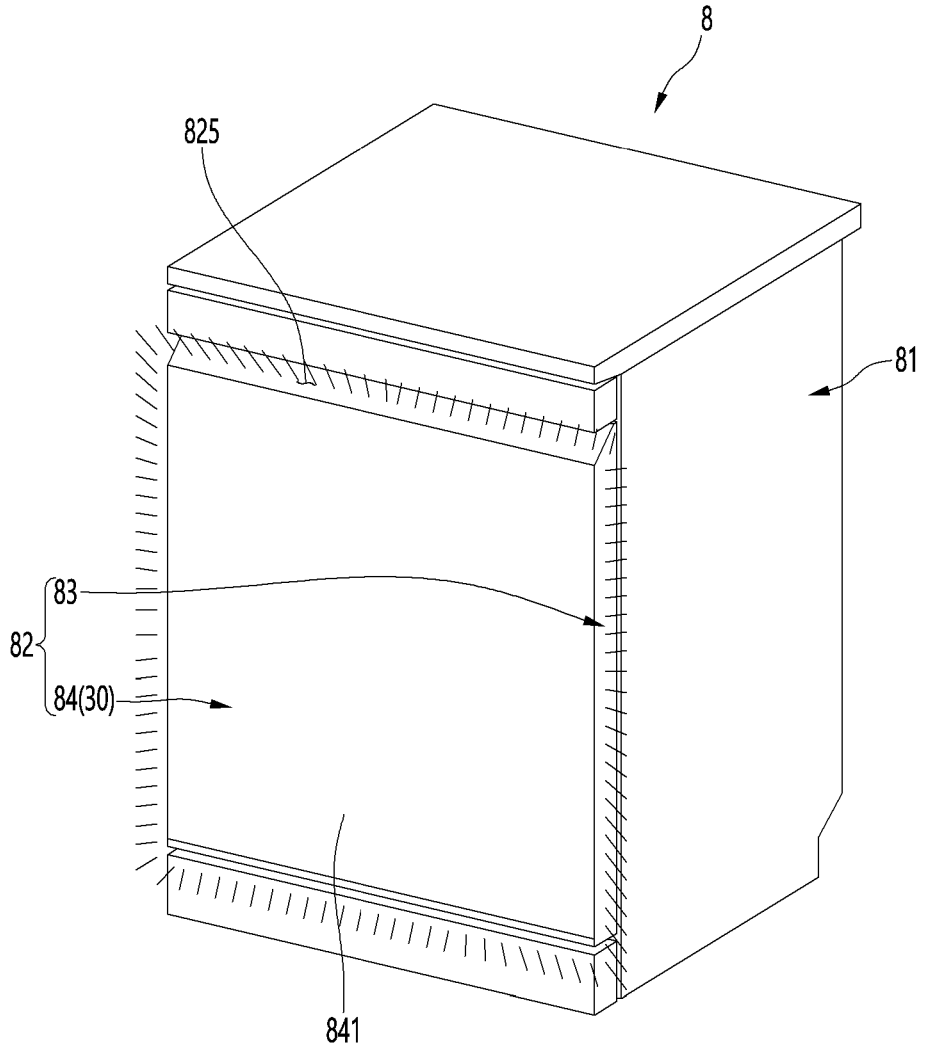
FIG. 45 is a perspective view of a dish washer according to further another embodiment of the present disclosure.
Figure 46:
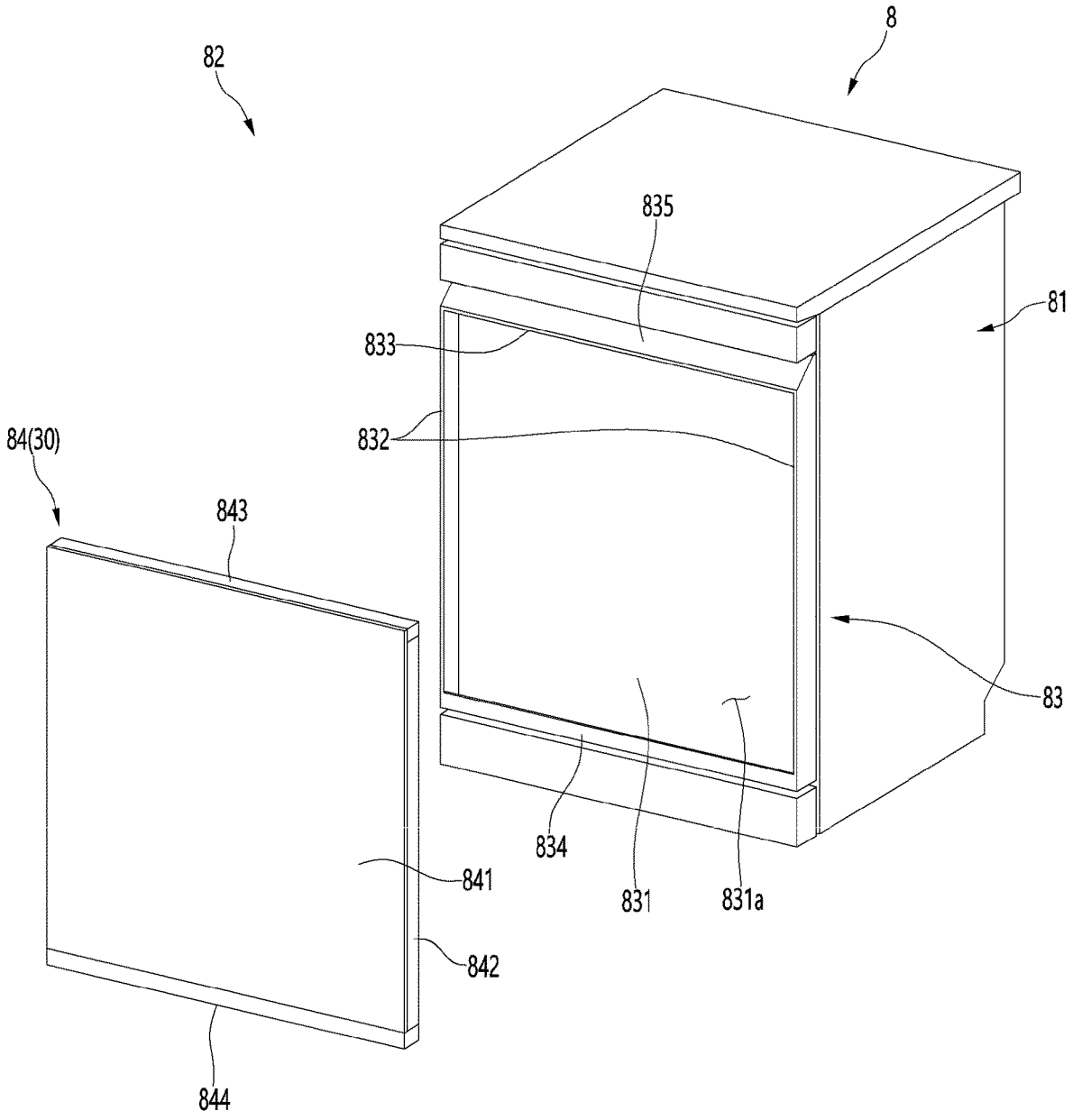
FIG. 46 is an exploded perspective view of a door of the dish washer.

FIG. 45 is a perspective view of a dish washer according to further another embodiment of the present disclosure. FIG. 46 is an exploded perspective view of a door of the dish washer.

As shown in the drawings, an outer appearance of a dish washer 8 according to another embodiment of the present disclosure may be formed by a case 81 forming a space for accommodating and washing dishes, and a door 82 for opening and closing an open front surface of the case 81.

Although not shown in detail, in general, a washing space may be formed inside the case 81, and a rack which is to be drawn in and out and on which dishes are accommodated, a nozzle for spraying water for washing dishes, and a pump and water tank for supplying washing water may be provided within the washing space.

A lower end of the door 82 may be rotatably mounted on the case 81, and in the state in which the door 82 is closed, the door 82 may form the outer appearance of the front surface of a dish washer 8. The door 82 may include a door body 83 for opening and closing the washing space, and a panel assembly 84 mounted on the door body 83 to form a front surface of the door 82.

A body plate 831 may be provided on a front surface of the door body 83 to form a front surface of the door body 83. A side decoration 832 extending in a vertical direction may be provided along right and left side ends of the door body 83, and right and left side surfaces of the door body 83 may be formed by the side decoration 832. An upper cap decoration 833 for connecting upper ends of the side decoration 832 at right and left sides, and a lower cap decoration 834 for connecting lower ends of the side decoration 832 at right and left sides may be provided.

A handle 835 for manipulation to open and close the door 82 may be recessed on the door body 83. A manipulator for manipulation of the dish washer 8 may also be formed at the upper end of the door body 83.

The side decoration 832, the upper cap decoration 833, and the lower cap decoration 834 may further protrude compared with a front surface of the body plate 831, and a panel accommodation space 831*a* in which the panel assembly 84 is accommodated may be formed in front of the body plate 831.

A lower end of the panel assembly 84 may be inserted into the lower cap decoration 834, and an upper end of the panel assembly 64 may be coupled to the upper cap decoration 833 to be fixedly mounted inside the panel accommodation space 831*a*. A circumference of the panel assembly 84 may be supported by the side decoration 832, the upper cap decoration 833, and the lower cap decoration 834.

The panel assembly 84 may have the same structure as the panel assembly 30 according to the aforementioned embodiment, and thus the front surface of the panel assembly 84 may glow with various colors under control of the controller 13.

The panel assembly 84 may include a panel 841 forming a front surface, a support member 842 on which the panel 841 is mounted, an upper bracket 843 mounted on an upper end of the support member 842 to form a top surface of the panel assembly 84, and a lower bracket 844 mounted on a lower end of the support member 842 to form a bottom surface of the panel assembly 84.

Although not shown, the light guide plate 33 may be mounted on the support member 842, and the lighting device 36 for emitting light to the light guide plate 33 may be provided on the lower bracket 844. The back cover 39 may be provided on a rear surface of the panel assembly 84.

As illustrated in FIG. 45, in the dish washer 8 as configured above, when the lighting device 36 is turned on, the entire panel 841 may glow due to light emitted from the lighting device 36, and the outer appearance of the front surface of the dish washer 8 may be formed by color corresponding to the color of the light emitted from the lighting device 36.

An operation of the lighting device 36 may be controlled according to control of the controller 13. Thus, the panel 841 may glow with various colors, and thus the outer appearance of the front surface of the dish washer 8 may also correspond to various colors.

That is, outer color of the front surface of the dish washer 8 may be freely changed under control of the lighting device 36 in the state in which the panel assembly 84 is maintained to be assembled and mounted without replacement of the panel assembly 84. Thus, the outer appearance of the dish washer may be changed according to surrounding furniture or environments, and according to an operation state of the dish washer 8, the operation state may be intuitively represented by changing the outer appearance of the dish washer 8.

Figure 47:
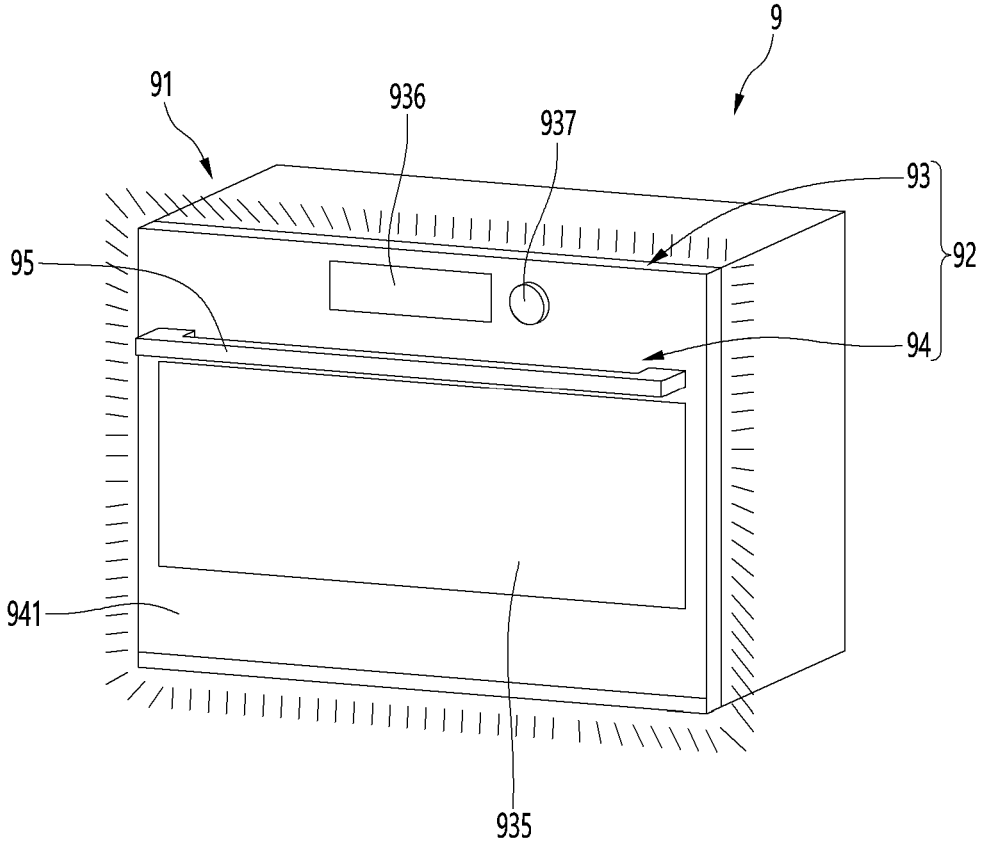
FIG. 47 is a perspective view of a cooking device according to further another embodiment of the present disclosure.
Figure 48:
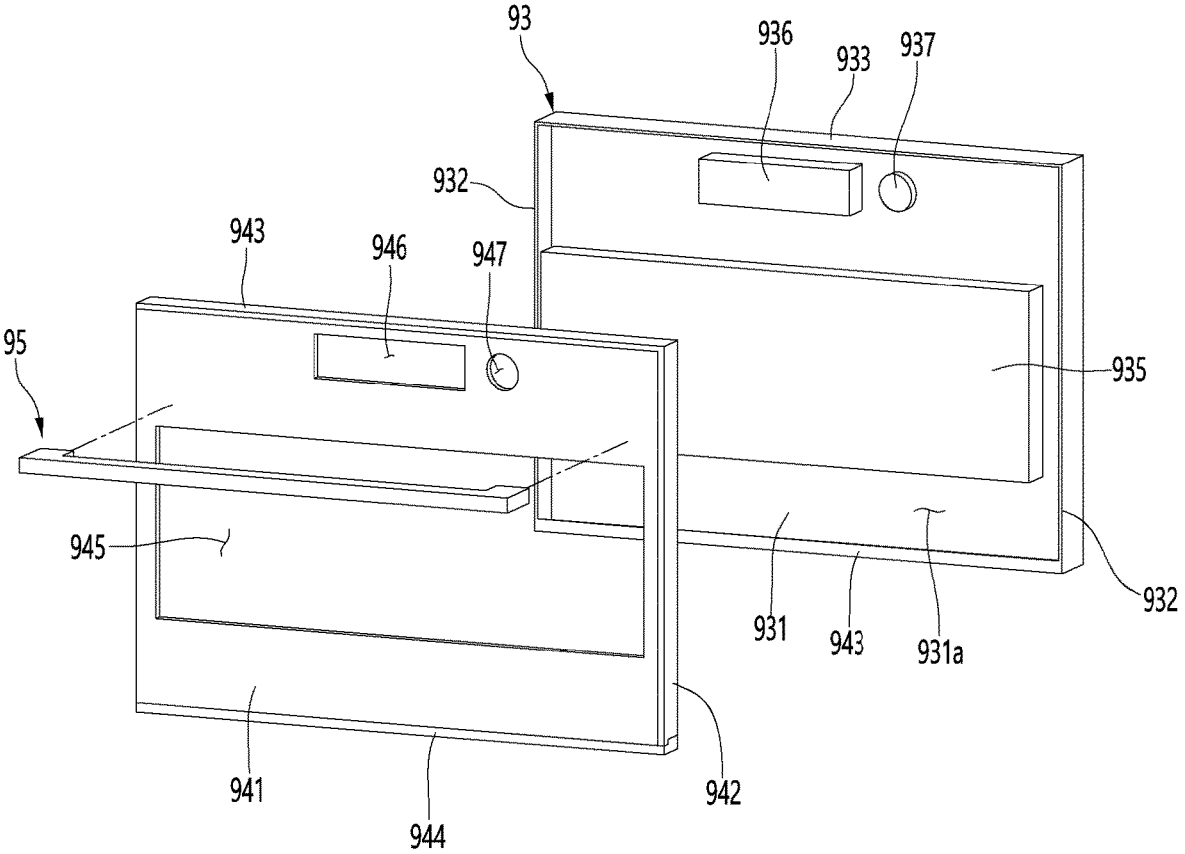
FIG. 48 is an exploded perspective view of the cooking device.

FIG. 47 is a perspective view of a cooking device according to further another embodiment of the present disclosure. FIG. 48 is an exploded perspective view of the cooking device.

As shown in the drawings, an outer appearance of a cooking device 9 according to another embodiment of the present disclosure may be formed a case 91 forming a space in which food is accommodated and cooking is performed, and a door 92 for opening and closing an open front surface of the case 91.

Although not shown in detail, in general, a cooking space may be formed inside the case 91, and a heater or a magnetron for cooling food, a fan for air circulation inside the cooking device, or a turntable that accommodated food and rotates may be provided inside the cooking space.

The door 92 may be rotatably mounted on the case 91, and in the state in which the door 92 is closed, the door 92 may form the outer appearance of the front surface of the cooking device 9. The door 92 may include a door body 93 for opening and closing the cooking space, and a panel assembly 94 mounted on the door body 93 to form a front surface of the door 92.

A body plate 931 may be provided on a front surface of the door body 93 to form a front surface of the door body 93. A side decoration 932 extending in a vertical direction may be provided along right and left side ends of the door body 93, and right and left side surfaces of the door body 93 may be formed by the side decoration 932. An upper cap decoration 933 for connecting upper ends of the side decoration 932 at right and left sides to form a top surface of the door body 93, and a lower cap decoration 934 for connecting lower ends of the side decoration 932 at right and left sides to form a bottom surface of the door body 93 may be provided.

A manipulator for manipulating an operation of the cooking device 9 may be formed above the door body 93. The manipulator may include a display 936, and a knob 936 or a button for manipulation. A sight window 935 for seeing the cooking space therethrough may be formed almost at the center of the door body 93.

The side decoration 932, the upper cap decoration 933, and the lower cap decoration 934 may further protrude compared with a front surface of the body plate 931, and a panel accommodation space 931*a* in which the panel assembly 94 is accommodated may be formed in front of the body plate 931.

A lower end of the panel assembly 94 may be inserted into the lower cap decoration 934, and an upper end of the panel assembly 64 may be coupled to the upper cap decoration 933 to be fixedly mounted inside the panel accommodation space 931*a*. A circumference of the panel assembly 94 may be supported by the side decoration 932, the upper cap decoration 933, and the lower cap decoration 934.

A plurality of panel openings 945, 946, and 947 may be formed on the panel assembly 94. The panel openings 945, 946, and 947 may include a display opening 946 formed with a corresponding size to the display 936 at a position corresponding thereto, a knob opening 947 formed with a corresponding size to the knob 936 at a position corresponding thereto, and a sight window opening 945 formed with a corresponding size to the sight window 935 at a position corresponding thereto.

Thus, when the panel assembly 94 is mounted, the display 936, the knob 936, and the sight window 935 may be exposed forward through the panel assembly 94.

Components of the panel assembly 94 may have the same structure as the panel assembly 30 according to the aforementioned embodiment except for the panel openings 945, 946, and 947, and thus the front surface of the panel assembly 94 may glow with various colors under control of the controller 13.

The panel assembly 94 may include a panel 941 forming a front surface, a support member 942 on which the panel 941 is mounted, an upper bracket 943 mounted on an upper end of the support member 942 to form a top surface of the panel assembly 94, and a lower bracket 944 mounted on a lower end of the support member 942 to form a bottom surface of the panel assembly 94.

Although not shown, the light guide plate 33 may be mounted on the support member 942, and the lighting device 36 for emitting light to the light guide plate 33 may be provided on the lower bracket 944. The back cover 39 may be provided on a rear surface of the panel assembly 94.

A handle 95 for manipulation to open and close the door 92 may be further provided on a front surface of the panel assembly 94.

As shown in FIG. 47, in the cooking device 9 as configured above, when the lighting device 36 is turned on, the entire panel 941 may glow due to light emitted from the lighting device 36, and the outer appearance of the front surface of the cooking device 9 may be formed by color corresponding to the color of the light emitted from the lighting device 36.

An operation of the lighting device 36 may be controlled according to control of the controller 13. Thus, the panel 941 may glow with various colors, and thus the outer appearance of the front surface of the cooking device 9 may also correspond to various colors.

That is, outer color of the front surface of the cooking device 9 may be freely changed under control of the lighting device 36 in the state in which the panel assembly 94 is maintained to be assembled and mounted without replacement of the panel assembly 94. Thus, the outer appearance of the cooking device 9 may be changed according to surrounding furniture or environments, and according to an operation state of the cooking device 9, the operation state may be intuitively represented by changing the outer appearance of the cooking device 9.

The refrigerator and the home appliance according to the embodiment may have the following effects.

In the refrigerator and the home appliance according to the embodiment, the outer appearance thereof may be defined by the panel assembly that defines the outer appearance of the front surface thereof. Particularly, the color of the panel assembly may be changed and displayed according to the color of the light irradiated from the lighting device, and thus, the color of the outer appearance of each of the refrigerator and the home appliance may be changed.

Thus, the outer appearance of each of the refrigerator and the home appliance may be freely changed without the replacement of the panel assembly, in particular, the color of each of the refrigerator and the home appliance in the state in which the panel assembly is mounted, and thus, the dramatic improvement of the outer appearance may be expected.

Particularly, the lighting device may emit the light having the various colors, and thus, the refrigerator and the home appliance may have the advantage of being able of variously changing the color of the outer appearance of each of the refrigerator and the home appliance in the state in which the panel assembly is mounted without the separate panel replacement.

In addition, the lighting device may have the structure mounted inside the lower bracket defining the end of the panel assembly, and the bracket opening shielded by the back cover may be defined in the lower bracket so that the lighting device is accessible through the bracket opening. Thus, when the service or replacement of the lighting device is required, the back cover may be separated to allow the lighting device to be accessible through the bracket opening so that the service or replacement is allowable, thereby improving the maintenance performance.

Particularly, when the lighting device is installed under the environment in which the repeated impact is applied such as a door, the service or replacement work is highly likely to occur, and due to the characteristics of the panel assembly that defines the color of the outer appearance, since even a limitation with some light sources severely deteriorates the outer appearance, the immediate action may be required. In this situation, since the lighting device is separated by the simple operation of separating the back cover without the need to replace or disassemble the entire panel assembly for the servicing or replacement of the lighting device, the effect in which the workability and maintenance performance are significantly improved may be expected.

In the panel assembly, the lighting device that is the main component of the panel assembly may be separated only by coupling or separating the screw coupled to the back cover, and the light guide plate, the support member, the upper bracket, and the lower bracket may be easily disassembled and assembled to improve the overall assembly workability.

Particularly, since the screw coupled to the back cover is the only coupling configuration, the panel assembly may be firmly assembled only by the simple assembly in all other configurations, and also, the assembly work time may be significantly shortened.

In addition, since there is no other coupling structure other than the screw coupled to the back cover, the panel assembly may have the slim structure as a whole.

In addition, to express the outer appearance of the panel assembly in the various colors, it may be inevitable that the lighting device operates for a long time to generate the heat in the lighting device.

The heat generated by the lighting device may be conducted to the back cover through the light supporter made of the metal and may be dissipated to the rear side of the panel assembly. In addition, the back cover may define the entire rear surface of the panel assembly to effectively dissipate the heat.

Particularly, the light supporter may include the first supporting portion and the second supporting portion, and the back cover may include the cover bent portion to maximize the contact area between the light supporter and the back cover and maximize the heat dissipation efficiency.

Thus, even if the user approaches the position adjacent to the lighting device during the opening/closing operation of the door due to the generation of the heat from the lighting device, the user may not feel the discomfort due to the heat. In addition, there may be the advantage of ensuring the stable operation of the lighting device by dissipating the heat so that the lighting device is not overheated even when the lighting device operates for a long time.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A refrigerator comprising:

a cabinet having a storage space; and a door configured to open and close the storage space, the door including a door body in which an insulating material is filled, and a panel assembly detachably mounted on the door body, wherein the panel assembly comprises:

a panel that defines a front surface of the door and that is configured to transmit light, a back cover that defines a rear surface of the panel assembly, a lower bracket that defines a bottom surface of the panel assembly, and a lighting device mounted on the lower bracket and configured to emit light to the panel, wherein the lower bracket defines a bracket opening through which the lighting device is accessible, and wherein the lower bracket protrudes below the panel, and the lighting device is disposed below a lower end of the panel.

2. The refrigerator according to claim 1, wherein the bracket opening is opened toward the door body.

3. The refrigerator according to claim 1, wherein the panel assembly further comprises a light supporter provided on the lower bracket and configured to support the lighting device from a lower side, and wherein the light supporter is accessible through the bracket opening.

4. The refrigerator according to claim 3, wherein the bracket opening has a size corresponding to a size of the light supporter, and wherein the lighting device is accessible through the bracket opening in a state of being mounted on the light supporter.

5. The refrigerator according to claim 3, wherein the light supporter is exposed through the bracket opening, and wherein the back cover is configured to cover the bracket opening so that the light supporter is restricted to the lower bracket.

6. The refrigerator according to claim 3, wherein the light supporter is made of a metal material and is in contact with the back cover to transfer heat of the lighting device to the back cover.

7. The refrigerator according to claim 6, wherein the light supporter comprises:

a first supporting portion configured to support the lighting device; and a second supporting portion extending from the first supporting portion to be in contact with the back cover.

8. The refrigerator according to claim 7, wherein the light supporter comprises a substrate support that is disposed at the first supporting portion and protrudes to support the lower side of the lighting device, and wherein the second supporting portion defines a substrate accommodation groove configured to accommodate a rear end of the lighting device.

9. The refrigerator according to claim 7, wherein the back cover comprises a cover bent portion that is disposed at a lower end of the back cover and bent forward, and wherein the cover bent portion is inserted into the bracket opening to be in contact with the first supporting portion.

10. A refrigerator comprising:

a cabinet having a storage space; and a door configured to open and close the storage space, the door including a door body in which an insulating material is filled, and a panel assembly detachably mounted on the door body, wherein the panel assembly comprises:

a panel that defines a front surface of the door and that is configured to transmit light, a back cover that defines a rear surface of the panel assembly, a lower bracket that defines a bottom surface of the panel assembly, a lighting device mounted on the lower bracket and configured to emit light to the panel, and a light guide plate disposed behind the panel and configured to guide the light emitted from the lighting device to the panel, wherein the lighting device comprises:

a substrate mounted inside the lower bracket, and a light source mounted on the substrate and configured to emit the light to an end of the light guide plate, wherein the lower bracket defines a bracket opening through which the lighting device is accessible, wherein the lower bracket comprises a light guide plate support disposed at a front surface of the lower bracket, the light guide plate support protruding backward and passing through a plurality of light sources, the plurality of light sources including the light source, and wherein the light guide plate support further protrudes from a top surface of the light source and supports a lower end of the light guide plate.

11. The refrigerator according to claim 10, wherein the lower bracket comprises a cover portion extending upward to prevent the light source from being exposed, and wherein an upper end of the cover portion extends upward relative to an upper end of the light source and a lower end of the panel.

12. The refrigerator according to claim 10, wherein the lower bracket comprises a guide protrusion protruding backward to be in contact with a front of the light source, and wherein, in a state in which the guide protrusion and the light source are in contact with each other, the light source is aligned vertically below a lower end of the light guide plate.

13. A refrigerator comprising:

a cabinet having a storage space; and a door configured to open and close the storage space, the door including a door body in which an insulating material is filled, and a panel assembly detachably mounted on the door body, wherein the panel assembly comprises:

a panel that defines a front surface of the door and that is configured to transmit light, a back cover that defines a rear surface of the panel assembly, a lower bracket that defines a bottom surface of the panel assembly, a lighting device mounted on the lower bracket and configured to emit light to the panel, a light guide plate disposed behind the panel and configured to guide the light emitted from the lighting device to the panel, a support member that is disposed on each of both side surfaces of the panel assembly and that extends vertically between the panel and the light guide plate, and an upper bracket that defines a top surface of the panel assembly, wherein the upper bracket is mounted on a top surface of the support member, wherein the lower bracket is mounted on a lower end of the support member, and wherein the lower bracket defines a bracket opening through which the lighting device is accessible.

14. The refrigerator according to claim 13, wherein upper and lower ends of the back cover are coupled to the upper bracket and the lower bracket by a screw, respectively, and wherein the back cover is configured to cover the bracket opening in a state of being coupled to the upper bracket and the lower bracket.

15. The refrigerator according to claim 14, wherein the support member is continuously disposed from a left end of the panel assembly to a right end of the panel assembly and is made of a material configured to transmit light.

16. The refrigerator according to claim 15, wherein the support member comprises:

a planar front surface portion on which the panel is mounted; and a side surface portion that protrudes backward from each of both left and right ends of the planar front surface portion and on which the light guide plate is mounted.

17. The refrigerator according to claim 16, wherein the support member defines a bracket insertion space opened vertically in each of upper and lower ends of the side surface portion, and wherein each of the upper bracket and the lower bracket is inserted into the bracket insertion space.

18. The refrigerator according to claim 16, wherein each of both left and right ends of the back cover is supported by the side surface portion.

* * * * *